US007250910B2

(12) United States Patent
Yoshikawa et al.

(10) Patent No.: US 7,250,910 B2
(45) Date of Patent: Jul. 31, 2007

(54) ANTENNA APPARATUS UTILIZING MINUTE LOOP ANTENNA AND RADIO COMMUNICATION APPARATUS USING THE SAME ANTENNA APPARATUS

(75) Inventors: Yoshishige Yoshikawa, Kashihara (JP); Yoshio Horiike, Shijonawate (JP); Yoshiyuki Yokoajiro, Yamatokooriyama (JP); Takayuki Matsumoto, Neyagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/544,139

(22) PCT Filed: Jan. 30, 2004

(86) PCT No.: PCT/JP2004/000890

§ 371 (c)(1),
(2), (4) Date: Jan. 4, 2006

(87) PCT Pub. No.: WO2004/070879

PCT Pub. Date: Aug. 19, 2004

(65) Prior Publication Data

US 2006/0114159 A1 Jun. 1, 2006

(30) Foreign Application Priority Data

| | | |
|---|---|---|
| Feb. 3, 2003 | (JP) | 2003-025604 |
| Sep. 3, 2003 | (JP) | 2003-311503 |
| Sep. 25, 2003 | (JP) | 2003-333227 |
| Oct. 17, 2003 | (JP) | 2003-357699 |
| Dec. 9, 2003 | (JP) | 2003-410023 |
| Dec. 10, 2003 | (JP) | 2003-411463 |
| Dec. 10, 2003 | (JP) | 2003-411464 |

(51) Int. Cl.
*H01Q 1/24* (2006.01)

(52) U.S. Cl. ..... 343/702; 343/748

(58) Field of Classification Search ..... 343/702, 343/700 MS, 748, 741, 742, 866, 867
See application file for complete search history.

(56) References Cited

U.S. PATENT DOCUMENTS 4,862,181 A * 8/1989 Ponce de Leon et al. .. 343/702

(Continued)

FOREIGN PATENT DOCUMENTS

JP 53-30977 8/1978

(Continued)

OTHER PUBLICATIONS

Institute of Electronics and Communication Engineers of Japan (IECE) editor, "*Antenna Engineering Handbook*", pp. 59-63, Ohm-sha Ltd., First Edition, issued on Oct. 30, 1980.

*Primary Examiner*—Hoanganh Le
(74) *Attorney, Agent, or Firm*—Wenderoth, Lind & Ponack, L.L.P.

(57) ABSTRACT

An antenna apparatus includes a minute loop antenna and at least one antenna element. The minute loop antenna is provided to be electromagnetically close to a dielectric substrate including a grounding conductor, has a predetermined number N of turns and a predetermined minute length, operates as a magnetic ideal dipole when a predetermined metal plate is located closely to the antenna apparatus, and operates as a current antenna when the metal plate is located apart from the antenna apparatus. The antenna element is connected to the minute loop antenna, and operates as a current antenna. In the antenna apparatus, one end of the antenna apparatus is connected to a feeding point, and another end of the antenna apparatus is connected to the grounding conductor of the dielectric substrate.

29 Claims, 39 Drawing Sheets

U.S. PATENT DOCUMENTS

| | | | | |
|---|---|---|---|---|
| 5,113,196 | A | 5/1992 | Ponce de Leon et al. | |
| 5,280,631 | A | 1/1994 | Nakahi et al. | |
| 5,300,938 | A * | 4/1994 | Maroun et al. | 343/702 |
| 5,767,813 | A | 6/1998 | Verma et al. | |
| 5,784,032 | A | 7/1998 | Johnston et al. | |
| 5,945,959 | A | 8/1999 | Tanidokoro et al. | |
| 6,061,025 | A | 5/2000 | Jackson et al. | |
| 6,133,886 | A | 10/2000 | Fariello et al. | |
| 6,204,819 | B1 | 3/2001 | Hayes et al. | |
| 2002/0018021 | A1 * | 2/2002 | Koyanagi et al. | 343/702 |
| 2003/0114118 | A1 | 6/2003 | Fukushima et al. | |

FOREIGN PATENT DOCUMENTS

| | | |
|---|---|---|
| JP | 7-44492 | 5/1995 |
| JP | 9-130132 | 5/1997 |
| JP | 10-126141 | 5/1998 |
| JP | 11-136025 | 5/1999 |
| JP | 2001-127540 | 5/2001 |
| JP | 3206825 | 7/2001 |
| JP | 2001-326514 | 11/2001 |
| JP | 2002-204114 | 7/2002 |

* cited by examiner 192
19mm
5mm
A3
C1
22
C2
10+11

102
19mm
5mm
5mm
A3
A1
A2
C1
22
C2
10+11

191
19mm
5mm
A3
C1
22
C2
10+11

101
19mm
5mm
5mm
A3
A1
A2
C1
22
C2
10+11

ANTENNA APPARATUS UTILIZING MINUTE LOOP ANTENNA AND RADIO COMMUNICATION APPARATUS USING THE SAME ANTENNA APPARATUS

TECHNICAL FIELD

The present invention relates to an antenna apparatus mainly for use in a radio communication apparatus, and also to a radio communication apparatus using the same antenna apparatus.

BACKGROUND ART

Conventionally, a loop antenna is used in a portable radio communication apparatus, in particular, a mobile telephone. A configuration of the loop antenna is disclosed in, for example, a prior art document of "Institute of Electronics and Communication Engineers of Japan (IECE) editor, "Antenna Engineering Handbook", pp. 59-63, Ohm-sha Ltd., First Edition, issued on Oct. 30, 1980". The total length of the loop antenna is normally about one wavelength, a structure of the loop antenna can be approximated to a structure, in which two half wavelength dipole antennas are aligned, based on its current distribution, and the loop antenna operates as a directional antenna having a directivity in a loop axis direction.

When the size of the loop antenna is reduced to have a total length of 0.1 wavelengths or less, a distribution of a current flowing in a loop conducting wire is substantially constant. The loop antenna in this state is referred to as a minute loop antenna. Since the present minute loop antenna is robuster over a noise electric field than a minute dipole antenna and its effective height can be easily calculated, the minute loop antenna is used as an antenna for use in magnetic field measurement.

The present minute loop antenna is widely employed as a small-sized one-turn antenna in the portable radio communication apparatus such as a pager or the like. Since an input resistance of the minute loop antenna is normally quite low, there have been developed a multi-turn minute loop antenna having a multi winding structure so as to remarkably stepwise increase the input resistance. It has been known that the minute loop antenna operates as a magnetic ideal dipole (or a magnetic current antenna) and exhibits a favorable antenna gain characteristic even when a metal plate, a human body or the like is located closely thereto.

SUMMARY OF THE INVENTION

The conventional minute loop antenna exhibits a favorable antenna gain characteristic when a conductor such as a metal plate, a human body or the like is located closely to the radio apparatus or the antenna, however, there is caused such a problem that the antenna gain decreases when the conductor is located apart therefrom.

It is an object of the present invention to provide an antenna apparatus and a radio communication apparatus using the same antenna apparatus, each capable of solving the above-mentioned problems, and attaining a antenna gain higher than a conventional minute loop antenna whether a conductor is located closely or apart therefrom.

According to the first aspect of the present invention, there is provided an antenna apparatus including a dielectric substrate, a minute loop antenna, and at least one antenna element. The dielectric substrate includes a grounding conductor. The minute loop antenna is provided to be electromagnetically close to the dielectric substrate, has a predetermined number N of turns, and has a predetermined minute length. The minute loop antenna operates as a magnetic ideal dipole when a predetermined metal plate is located closely to the antenna apparatus, and operates as a current antenna when the metal plate is located apart from the antenna apparatus. The above-mentioned at least one antenna element is connected to the minute loop antenna, and operates as a current antenna. In the antenna apparatus, one end of the antenna apparatus is connected to a feeding point, and another end of the antenna apparatus is connected to the grounding conductor of the dielectric substrate.

In the above-mentioned antenna apparatus, the above-mentioned at least one antenna element is preferably provided to be substantially parallel to a surface of the dielectric substrate.

The above-mentioned antenna apparatus preferably includes two antenna elements.

Further, in the above-mentioned antenna apparatus, the two antenna elements are preferably substantially linear and provided to be parallel to each other.

Furthermore, the above-mentioned antenna apparatus preferably further includes at least one first capacitor connected to at least one of the minute loop antenna and the antenna element. The above-mentioned at least one capacitor series-resonates with an inductance of the minute loop antenna.

In this case, the first capacitor is preferably connected so as to be inserted into a substantially central point of the antenna element. Further, the first capacitor is preferably formed by connecting a plurality of capacitor elements in series. Alternatively, the first capacitor is preferably formed by connecting a plurality of pairs of circuits in parallel, each pair of circuits being formed by connecting a plurality of capacitor elements in series.

Further, the above-mentioned antenna apparatus preferably further includes an impedance matching circuit connected to the feeding point, and the impedance matching circuit matches an input impedance of the antenna apparatus with a characteristic impedance of a feeding cable connected to the feeding point.

Furthermore, in the above-mentioned antenna apparatus, the minute loop antenna is preferably provided so that a loop axis direction of the minute loop antenna is substantially perpendicular to the surface of the dielectric substrate. Otherwise, the minute loop antenna is preferably provided so that a loop axis direction of the minute loop antenna is substantially parallel to the surface of the dielectric substrate. Alternatively, the minute loop antenna is preferably provided so that a loop axis direction of the minute loop antenna is inclined at a predetermined inclination angle with respect to the surface of the dielectric substrate.

Furthermore, in the above-mentioned antenna apparatus, the number N of turns of the minute loop antenna is preferably substantially set to $N=(n-1)+0.5$, where n is a natural number. In this case, the number N of turns of the minute loop antenna is preferably substantially set to $N=1.5$.

Further, the above-mentioned antenna apparatus preferably further includes at least one floating conductor, and a first switch device. The above-mentioned at least one floating conductor is provided to be electromagnetically close to the minute loop antenna and the antenna element. The first switch device selectively switches the floating conductor so as to or not to be connected to the grounding conductor, to change one of a directivity characteristic and a plane of polarization of the antenna apparatus.

In this case, the above-mentioned antenna apparatus preferably further includes two floating conductors provided to be substantially perpendicular to each other. The first switch device selectively switches the respective two floating conductors so as to or not to be connected to the grounding conductor, to change at least one of the directivity characteristic and the plane of polarization of the antenna apparatus.

In the above-mentioned antenna apparatus,

Further, the above-mentioned antenna apparatus preferably further includes a first reactance element, and a second switch device. The first reactance element is connected to at least one of the minute loop antenna and the antenna element, and the second switch device selectively switches the first reactance element so as to or not to be shorted, to change a resonance frequency of the antenna apparatus.

In this case, the second switch device preferably includes a high-frequency semiconductor device having a parasitic capacitance when the second switch device is turned off, and the antenna apparatus further includes a first inductor for substantially canceling the parasitic capacitance.

Further, the above-mentioned antenna apparatus preferably further includes a second reactance element having one end connected to at least one of the minute loop antenna and the antenna element, and a third switch device for selectively switching another end of the second reactance element so as to be grounded or not to be grounded, to change the resonance frequency of the antenna apparatus.

In this case, the above-mentioned antenna apparatus preferably further includes a third reactance element connected to at least one of the minute loop antenna and the antenna element.

Further, in the above-mentioned antenna apparatus, the third switch device preferably includes a high-frequency semiconductor device having a parasitic capacitance when the third switch device is turned off. The above-mentioned antenna apparatus further includes a second inductor for substantially canceling the parasitic capacitance.

Furthermore, there is preferably provided a plurality of above-mentioned antenna apparatuses, and a fourth switch device. The fourth switch device selectively switches the plurality of antenna apparatuses based on radio signals received by the plurality of antenna apparatuses, and connects a selected antenna apparatus to the feeding point.

In this case, the fourth switch device preferably grounds the unselected antenna apparatuses.

Further, in the above-mentioned antenna apparatus, the antenna apparatus is preferably formed on a surface of the dielectric substrate on which the grounding conductor is not formed.

In this case, the minute loop antenna is formed on a further dielectric substrate.

Further, in the above-mentioned antenna apparatus, the further dielectric substrate preferably includes at least one convex portion, and the dielectric substrate includes at least one hole portion fitted into the at least one concave portion of the dielectric substrate. The above-mentioned at least one convex portion of the further dielectric substrate is fitted into the at least one hole portion of the dielectric substrate, so that the further dielectric substrate is coupled with the dielectric substrate.

Alternatively, in the above-mentioned antenna apparatus, the dielectric substrate includes at least one convex portion, and the further dielectric substrate includes further at least one hole portion for being inserted and fitted into the at least one concave portion of the dielectric substrate. The above-mentioned at least one convex portion of the dielectric substrate is inserted and fitted into the at least one hole portion of the further dielectric substrate, so that the dielectric substrate is coupled with the further dielectric substrate.

Furthermore, the above-mentioned antenna apparatus preferably further includes a first connection conductor, and a second connection conductor. The first connection conductor is formed on the dielectric substrate, and is connected to the antenna element. The second connection conductor is formed on the further dielectric substrate, and is connected to the minute loop antenna. The first connection conductor is electrically connected to the second connection conductor when the dielectric substrate is coupled with the further dielectric substrate.

In this case, preferably, the first connection conductor includes a first conductor exposed section, which is a part of the first connection conductor and has a predetermined first area, the connection conductor being formed to be soldered so that the first connection conductor is electrically connected to the second connection conductor. The second connection conductor includes a second conductor exposed section, which is a part of the second connection conductor and has a predetermined second area, and the second connection conductor is formed to be soldered so that the second connection conductor is electrically connected to the first connection conductor.

According to the second aspect of the present invention, there is provided a radio communication apparatus including the above-mentioned antenna apparatus, and a radio communication circuit connected to the antenna apparatus.

DETAILED DESCRIPTION OF THE INVENTION

Preferred embodiments of the present invention are described hereinafter in detail with reference to the drawings. Components similar to each other are denoted by the same numerical references, and are not be described hereinafter in detail.

FIRST PREFERRED EMBODIMENT

Figure 1:
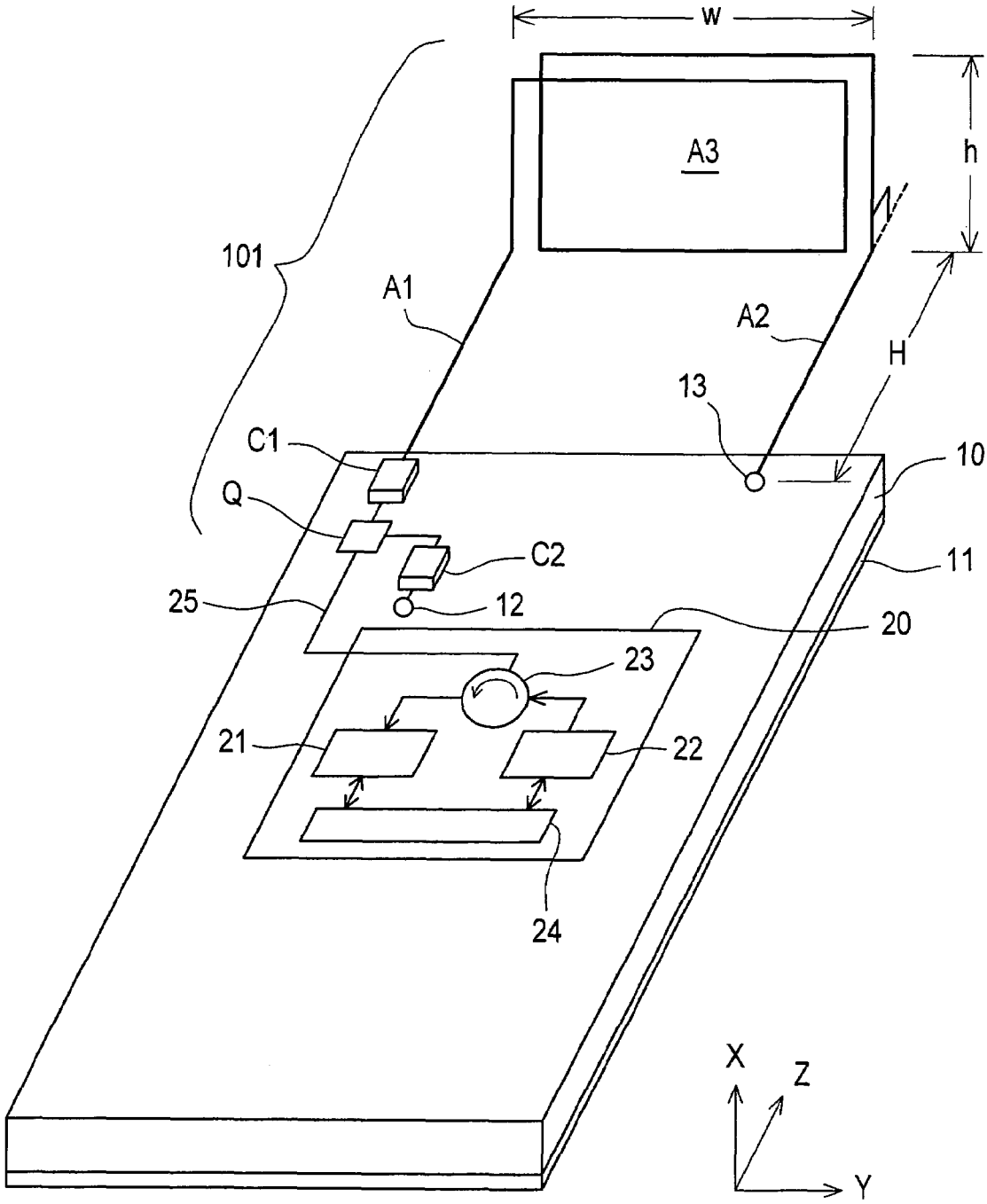
FIG. 1 is a perspective view showing a configuration of an antenna apparatus 101 according to a first preferred embodiment of the present invention.

FIG. 1 is a perspective view showing a configuration of an antenna apparatus 101 according to a first preferred embodiment of the present invention. In FIG. 1, the antenna apparatus 101 according to the first preferred embodiment is characterized by including the following:

(a) two antenna elements A1 and A2 which are substantially linear and arranged substantially in parallel to each other;

(b) a rectangular minute loop antenna A3, which is connected to be inserted between these antenna elements A1 and A2, where the rectangular minute loop antenna A3 is provided in a direction perpendicular to the antenna elements A1 and A2, and has a number N of turns (N=1.5); and (c) a capacitor C1 which is connected to be inserted between the antenna element A1 and a feeding point Q.

Referring to FIG. 1, the feeding point Q is provided on an upper left edge portion of a dielectric substrate 10 which has a grounding conductor 11 formed on the whole rear surface in a longitudinal direction of the dielectric substrate 10. The feeding point Q is connected to one end of the antenna element A1 through the capacitor C1, which constitutes a series resonance circuit together with an inductance of the minute loop antenna. Another end of the antenna element A1 is connected to one end of the antenna element A2 through the minute loop antenna A3. Another end of the antenna element A2 is connected to the grounding conductor 11 through a through-hole conductor 13 filled in a through hole, which penetrates the dielectric substrate 10 in the thickness direction thereof, so as to be grounded. Further, the feeding point Q is connected to the grounding conductor 11 through an impedance matching capacitor C2 and the through-hole conductor 12 so as to be grounded. In addition, the feeding point Q is connected to a circulator 23 of a radio communication circuit 20 formed on the dielectric substrate 10, through a feeding cable 25 such as a micro-strip line or the like. The impedance matching capacitor C2 is used to match an input impedance when the antenna apparatus 10 is seen at the feeding point Q, with a characteristic impedance of the feeding cable 25. In addition, in a manner similar to the through-hole conductor 13, the through-hole conductor 12 is of a conductor filled into a through hole which penetrates the dielectric substrate 10 in the thickness direction thereof. As shown in FIG. 1, a direction which is perpendicular to one surface of the dielectric substrate 10 is set as an X direction, a direction which is the longitudinal direction of the dielectric substrate 10 and is oriented from the dielectric substrate 10 toward the antenna apparatus 101 is set as a Z direction, and a direction which is perpendicular to the X direction and the Y direction and is parallel to a width direction of the dielectric substrate 10 is set as a Y direction.

A multi-layer substrate or the like can be used as the dielectric substrate 10, a glass epoxy substrate, a Teflon (trademark) substrate, a phenol substrate.

In the antenna apparatus 101 shown in FIG. 1, the antenna elements A1 and A2, each made of a linear conductor, have a length H, and are arranged to be parallel to each other and to extend in the Z direction. An axial direction of the minute loop antenna A3 is parallel to the Z direction, and a loop plane or loop surface of the minute loop antenna A3 is arranged to be perpendicular to the surfaces of the antenna elements A1 and A2 and the dielectric substrate 10. Further, the minute loop antenna A3 has a shape of rectangle having a number N of turns (N=1.5), a width "w", and a height "h", and then, the minute loop antenna A3 has a predetermined total length L (=3w+4h). The total length L is set to be equal to or more than 0.01λ and equal to or less than 0.5λ, preferably equal to or less than 0.2λ, more preferably equal to or less than 0.1λ, relative to a wavelength λ of a frequency of a radio signal used in the radio communication circuit 20 as described later. As a result, the minute loop antenna A3 is constituted. It is noted that an outer diameter (which is a length of one side of the rectangle or a diameter of a circle) of the minute loop antenna A3 is set to be equal to or more than 0.01λ and equal to or less than 0.2λ, preferably equal to or less than 0.1λ, more preferably equal to or less than 0.03λ.

Further, in the radio communication circuit 20, a radio signal received by the antenna apparatus 101 is inputted to the circulator 23 through the feeding point Q, and is inputted to a radio receiving circuit 21, and is subjected to processings such as high frequency amplification, frequency conversion, demodulation and the like by the radio receiving circuit 21, and data such as a voice signal, a video signal, a data signal or the like is taken out or extracted. A controller 24 controls operations of the radio receiver circuit 21 and a radio transmitter circuit 22. The radio transmitter circuit 22 modulates a radio carrier wave according to the data to be transmitted such as a voice signal, a video signal a data signal or the like, amplifies the power of the modulated radio carrier wave, and outputs the power-modulated radio carrier wave to the antenna apparatus 101 through the circulator 23 and the feeding point Q. Thereafter, the radio signal is radiated from the antenna apparatus 101. The controller 24 is connected to a predetermined external apparatus through an interface circuit (not shown), makes a radio signal that includes data from the external apparatus be radiated from the antenna apparatus 101, and makes the data included in the radio signal received by the antenna apparatus 101 be outputted to the external apparatus.

Figure 4:
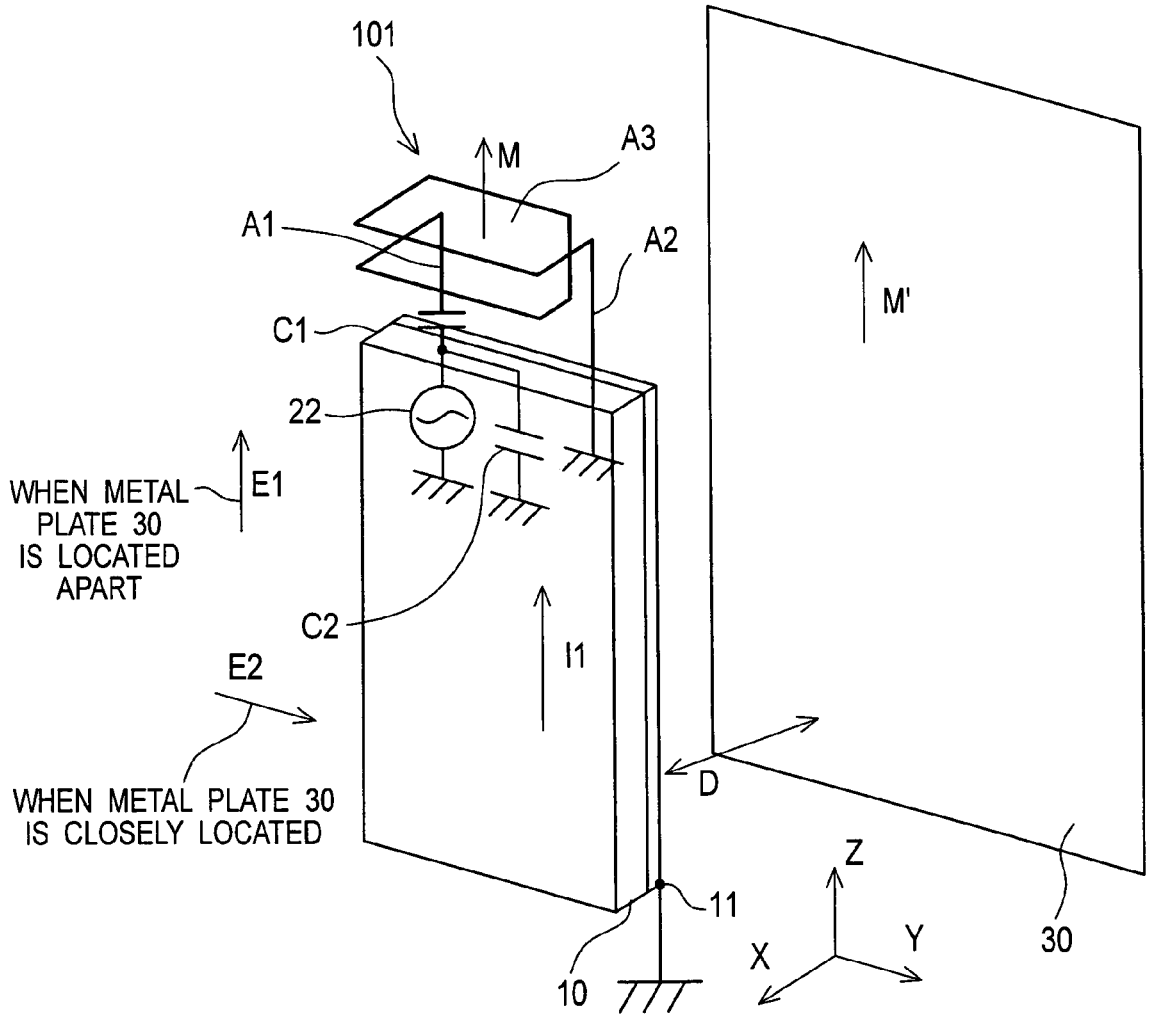
FIG. 4 is a perspective view showing a state in which a metal plate 30 is located closely to the antenna apparatus 101 shown in FIG. 1.

The antenna apparatus 101 as constituted as mentioned above includes the following:

(a) the dielectric substrate 10 including the grounding conductor 11;

(b) the minute loop antenna A3 which is provided to be electromagnetically close to the dielectric substrate 10 so as to be electromagnetically coupled with the grounding conductor 11 (i.e., so as to substantially apply an electromagnetic field induced by a coil of the minute loop antenna A3 to the grounding conductor 11 when a high-frequency signal flows in the minute loop antenna A3), where the minute loop antenna A3 operates as a magnetic ideal dipole (or a magnetic current antenna) including a main beam having a directivity parallel to a direction perpendicular to a metal plate 30 shown in FIG. 4 when the metal plate 30 is located closely to the antenna apparatus 101, and where the minute loop antenna A3 operates as a current antenna when the metal plate 30 is located apart from the antenna apparatus 101, as is described later in detail with reference to FIGS. 4 to 7; and (c) the two antenna elements A1 and A2, each of which operate as current antennas (or a so-called transmission line antenna) including a main beam having a directivity in a direction perpendicular to a longitudinal direction of the conductor of each of the antenna elements A1 and A2, (d) wherein one end of the antenna element A1 is connected to the radio communication circuit 20 through the feeding point Q, and one end of the antenna element A2 is connected to the connection conductor 11 so as to be grounded, and this leads to the antenna apparatus 101 serving as an unbalanced antenna.

By thus constituting the antenna apparatus 101, the antenna apparatus 101 can attain a higher antenna gain in a combined directivity characteristic of a combination of a vertically polarized wave (which is defined hereinafter as a polarized wave in the Z direction when the dielectric substrate 10 is provided to stand so as to be perpendicular to the ground as shown in FIG. 4) and a horizontally polarized wave (which is defined hereinafter as a polarized wave in the Y direction when the dielectric substrate 10 is provided to stand so as to be perpendicular to the ground as shown in FIG. 4) than that of the conventional minute loop antenna. The antenna apparatus 101 can attain quite a higher antenna gain not only when the metal plate 30 which is described later with reference to FIG. 4 is located closely to the antenna apparatus 101, but also even when the antenna apparatus 101 is located apart from the metal plate 30.

The antenna apparatus 101 as constituted as mentioned above is installed in a predetermined housing together with the radio communication circuit 20 as provided on the dielectric substrate 10 so as to constitute a radio communication apparatus. The configuration of the antenna apparatus according to the present embodiment is similarly applicable to antenna apparatuses according to the following preferred embodiments.

In the first preferred embodiment, the two antenna elements A1 and A2 are employed. However, the present invention is not limited to this, and the antenna apparatus 101 may include at least one antenna element A1 or A2. Further, the minute loop antenna A3 has a shape of rectangular, however, the present invention is not limited to this, and the loop antenna A3 may have the other shape such as a circular shape, an elliptic shape, a polygonal shape or the like. A loop of the minute loop antenna A3 may have a shape of spiral coil or volute coil. The number N of turns of the minute loop antenna A3 may not be limited to 1.5, and it may be the other number N of turns as be described later in detail. Further, although the capacitor C1 is used in the antenna apparatus 101, the present invention is not limited to this, and the antenna apparatus 101 may be constituted without any capacitor C1. Although the impedance matching capacitor C2 is used in the antenna apparatus 101, the present invention is not limited to this. An impedance matching inductor or an impedance matching circuit which is a combination of a capacitor and an inductor may be used in place of the impedance matching capacitor C2. When the impedance matching circuit is not required, it is not always necessary to provide the same. These modified embodiments can be similarly applied to the following embodiments and modified embodiments of those embodiments.

A method of determining a capacitance of the capacitor C1 of the antenna apparatus 101 is next described below.

In the antenna apparatus 101 shown in FIG. 1, the capacitor C1 and the inductance of the minute loop antenna A3 are connected in series to the radio transmitter circuit 22 or the feeding point Q, and the capacitor C1 is set so as to substantially cancel a reactance of the inductance. Another end of the minute loop antenna A3 is connected to the grounding conductor 11. The inductance of the minute loop antenna A3 is set to be larger, that is, the reactance of the inductance is set to be larger, and the capacitance of the capacitor C1 is set to be smaller, that is, the reactance of the capacitor C1 is set to be larger. Therefore, a larger amplitude of the high-frequency voltage is generated at a connection point between the inductance of the minute loop antenna A3 and the capacitor C1. The reason why the high-frequency voltage amplitude is generated at the connection point is as follows. Generally speaking, when an LC resonance circuit resonates, an impedance Z of the LC resonance circuit is represented by $Z=L/(R\cdot C)=Q\omega L$ (where $R=R1+Rc$; R1 denotes a radiation resistance, Rc denotes a loss resistance, and Q denotes a quality factor). When an identical power is supplied to the LC resonance circuit, a voltage amplitude is increased in proportional to the inductance L. In addition, by increasing the inductance L and reducing the capacitor C, a resonance impedance is increased. It is noted that the inductance of the minute loop antenna A3 is coupled with a free space in an electric field and an electromagnetic field, and has a radiation resistance against the free space. Due to this, when a larger amplitude of the high-frequency voltage is generated at the connection point, a radiation energy radiated to the free space is increased, and a favorable larger antenna gain can be attained.

In an implemental example which is manufactured on trial by the inventors of the present invention, the antenna apparatus 101 operates as the antenna apparatus 101 in a 429 MHz band. The capacitance of the capacitor C1 is set to 1 pF, and therefore, an absolute value |Z| of the impedance Z becomes a larger value of 371Ω. By substantially setting the absolute value |Z| of the impedance of the capacitor C1 to 200Ω or more, a larger antenna gain can be attained. When the capacitance of the capacitor C1 is determined, the magnitude of the minute loop antenna A3 can be determined substantially uniquely according to a condition of the resonance frequency.

By designing the capacitance of the capacitor C1 to be smaller than that as set in the above-mentioned implemental example, the absolute value |Z| of the impedance can be set quite larger. However, because of the influence of a parasitic capacitance or the like, it is difficult for the actual antenna apparatus 101 to stably obtain an equal resonance frequency. It is considered that a range of the absolute value |Z| of the impedance of about 200Ω to 2,000Ω can be easily realized. The absolute value may be set to exceed this range. Further, the antenna gain is improved to be larger when the absolute value |Z| of the impedance of the capacitor C1 is set to be larger. This is because the inductance of the corresponding minute loop antenna A3 can be increased.

The antenna apparatus 101 according to the first preferred embodiment as constituted as mentioned above includes the two antenna elements A1 and A2 and the minute loop antenna A3. Therefore, the structure of the antenna apparatus 101 is quite simple, and the small-sized and lightweight antenna apparatus 101 can be produced at low cost.

SECOND PREFERRED EMBODIMENT

Figure 2:
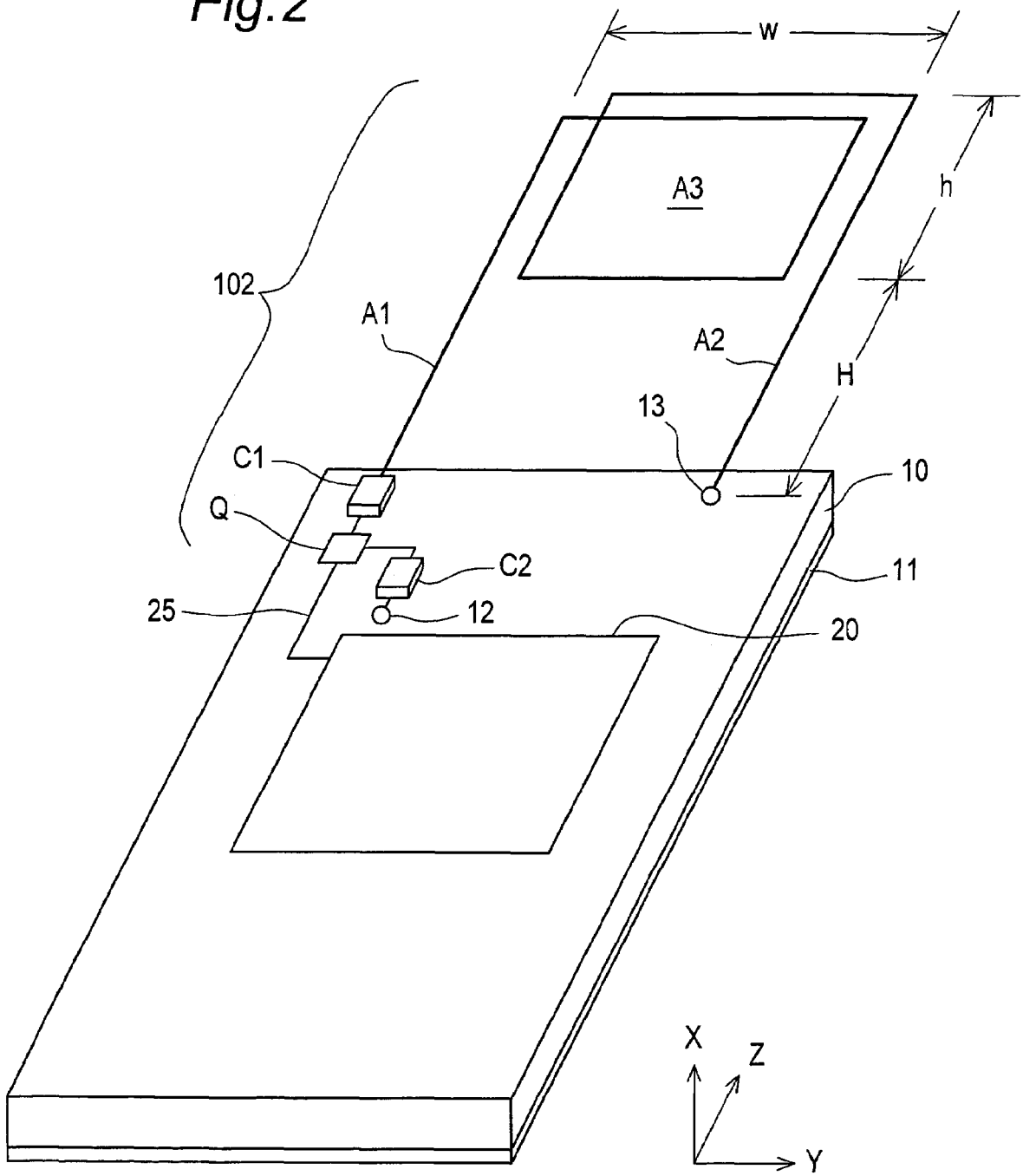
FIG. 2 is a perspective view showing a configuration of an antenna apparatus 102 according to a second preferred embodiment of the present invention.

FIG. 2 is a perspective view showing a configuration of an antenna apparatus 102 according to a second preferred embodiment of the present invention. In FIG. 2, the antenna apparatus 102 according to the second preferred embodiment is characterized, as compared with the antenna apparatus 101 according to the first preferred embodiment, in that a loop axis direction of a minute loop antenna A3 is parallel to the X direction, that is, a loop surface of the minute loop antenna A3 is arranged substantially on the same plane as two antenna elements A1 and A2. In the antenna apparatus 102 as thus constituted, the loop axis direction of the minute loop antenna A3 is parallel to the X direction. In addition, the minute loop antenna A3 effectively operates as a current antenna and has an improved antenna gain for a vertically polarized wave when a metal plate 30 is located apart from the antenna apparatus 102 as described later in detail (See FIG. 14).

THIRD PREFERRED EMBODIMENT

Figure 3:
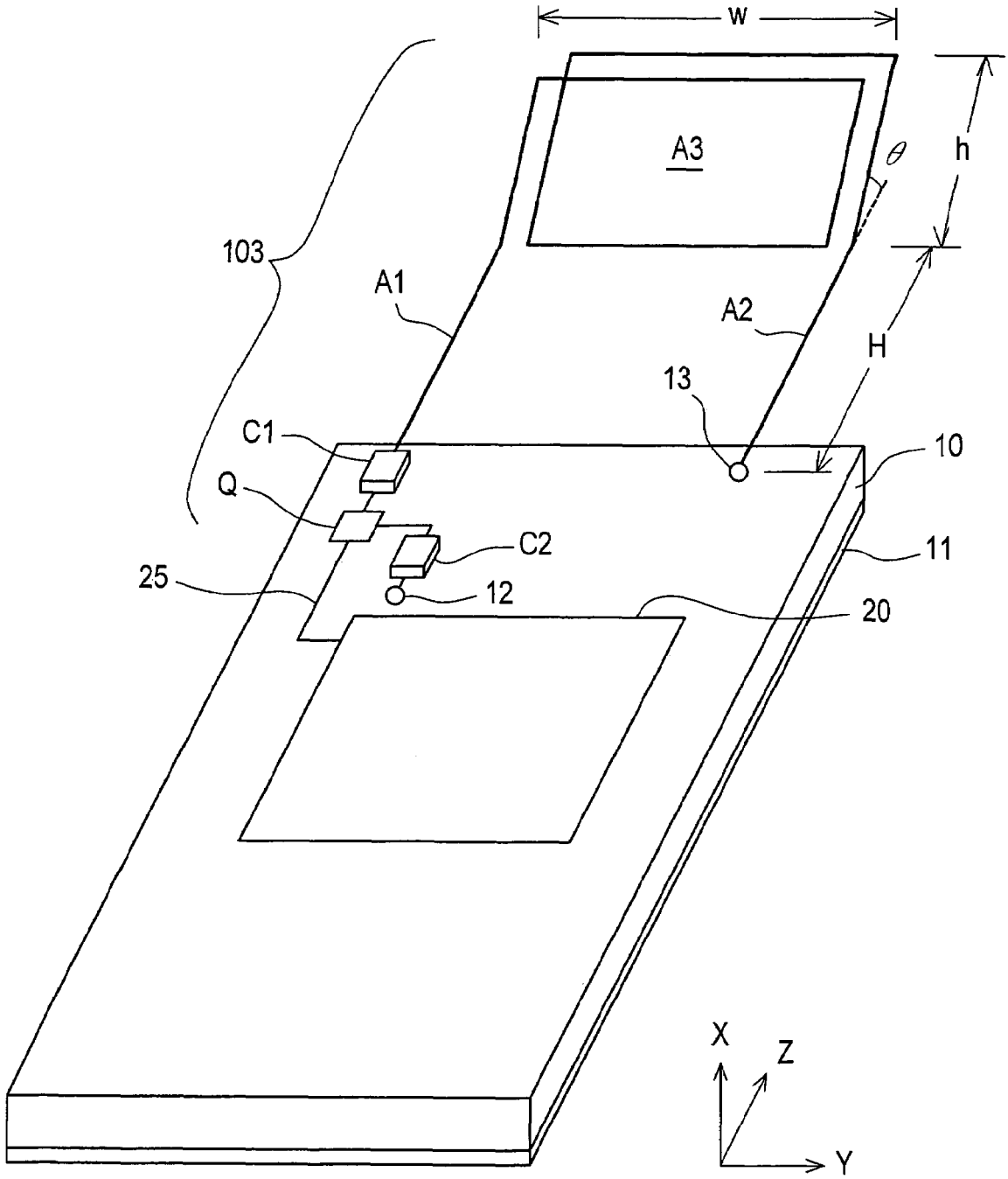
FIG. 3 is a perspective view showing a configuration of an antenna apparatus 103 according to a third preferred embodiment of the present invention.

FIG. 3 is a perspective view showing a configuration of an antenna apparatus 103 according to a third preferred embodiment of the present invention. The antenna apparatus 103 according to the third preferred embodiment is characterized, as compared with the antenna apparatus 101 according to the first preferred embodiment, in that a minute loop antenna A3 is arranged so that the loop axis direction of the minute loop antenna A3 is inclined by a predetermined inclination angle θ (0<θ<90°) from the Z direction, relative to an axis between a connection point between the minute loop antenna A3 and an antenna element A1 and that between the minute loop antenna A3 and an antenna element A2. The antenna apparatus 103 as thus constituted operates as a combination of the antenna apparatuses 101 and 102, and have a feature of the operation of the antenna apparatus 101 and that of the antenna apparatus 102. Accordingly, the antenna apparatus 103 can exhibit a directivity characteristic which compensates for disadvantages of the antenna apparatuses 101 and 102, and has an improved integrated antenna gain on a vertically polarized wave and a vertically polarized wave.

Experiments on Antenna Apparatus According to Preferred Embodiments and Results of the Experiments FIG. 4 is a perspective view showing a state in which the metal plate 30 is located closely to the antenna apparatus 101 shown in FIG. 1.

Referring to FIG. 4, the dielectric substrate 10 is provided to stand so as to be perpendicular to the ground, and is arranged so that the grounding conductor 11 as formed on the rear surface of the dielectric substrate 10 opposes to the metal plate 30. In this case, it is assumed that the distance between the grounding conductor 11 and the metal plate 30 is defined as a distance D. When the antenna apparatus 101 is located apart from the metal plate 30, the antenna apparatus 101 operates in a current type operation in a manner similar to that of a monopole antenna subjected to top-loading by a coil part of the minute loop antenna A3. Then a current 11 is induced in the grounding conductor 11, and a plane of polarization of the electric field as radiated in the X direction becomes a plane E1 in the Z direction. On the other hand, when the metal plate 30 is located closely to the dielectric substrate 10, the antenna apparatus 101 operates in a magnetic current type operation in a manner similar to that of the minute loop antenna on which a magnetic current M' is induced on the surface of the metal plate 30 by a magnetic current M of the coil part of the minute loop antenna A3, and then, a plane of polarization becomes a plane E2 in the Y direction. In other words, the antenna apparatus 101 exhibits a characteristic of switching over between the current type operation and the magnetic current type operation depending on presence or absence of the metal plate 30.

Figure 5:
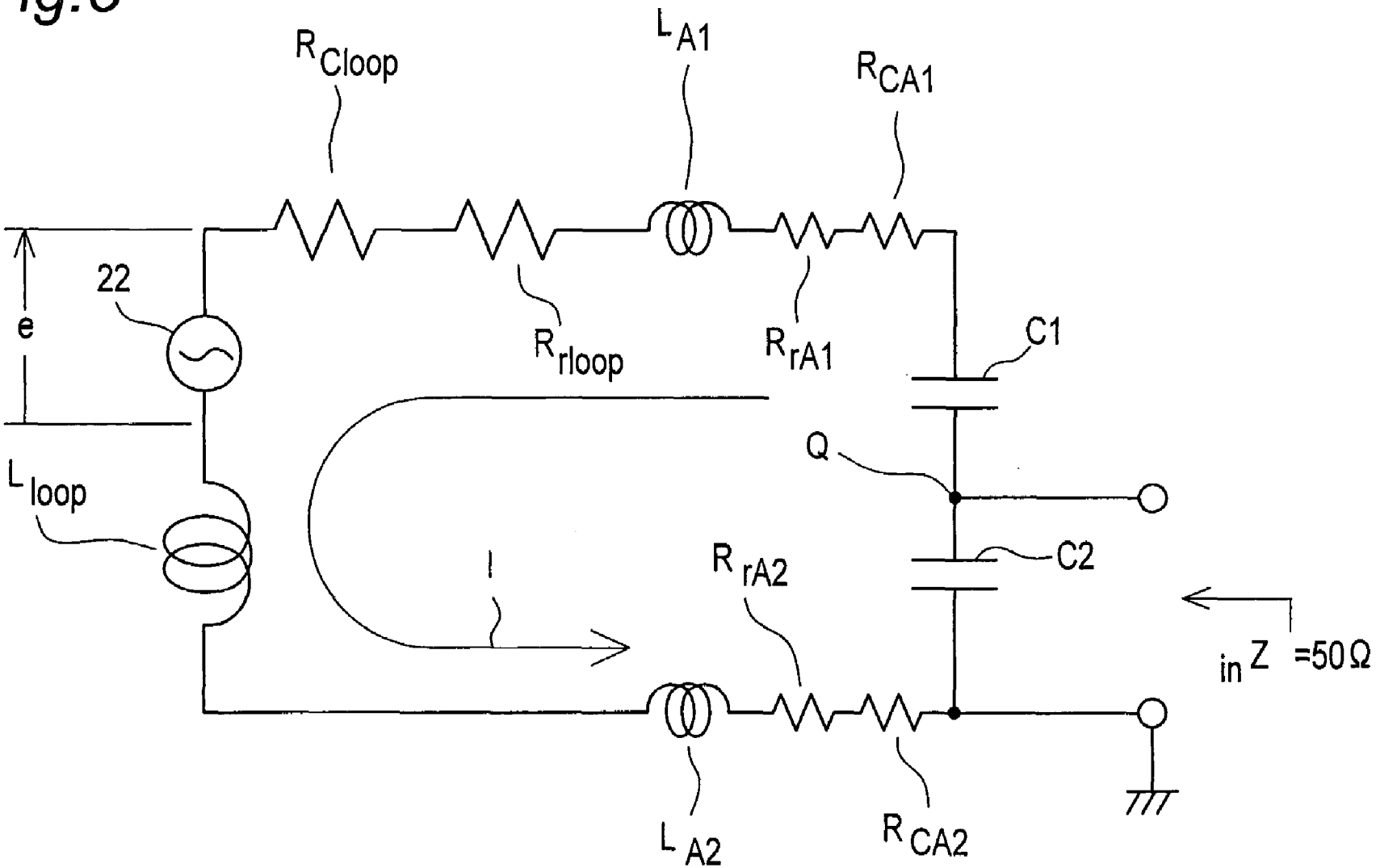
FIG. 5 is a circuit diagram showing an equivalent circuit of the antenna apparatus 101 shown in FIG. 1.

FIG. 5 is a circuit diagram showing an equivalent circuit of the antenna apparatus 101 shown in FIG. 1. In the equivalent circuit shown in FIG. 5, the impedance matching capacitor C2 is connected between the feeding point Q which is an input terminal of the antenna apparatus 101, and the grounding conductor 11, so that the feeding point Q is connected to the grounding conductor 11 through the following circuit elements:

(a) The capacitor C1 for series resonance;

(b) A loss resistance $R_{CA1}$ of the antenna element A1;

(c) A radiation resistance $R_{rA1}$ of the antenna element A1;

(d) An inductance $L_{A1}$ of the antenna element A1;

(e) A radiation resistance $R_{rloop}$ of the minute loop antenna A3;

(f) A loss resistance $R_{Cloop}$ of the minute loop antenna A3;

(g) An induction voltage "e";

(h) An inductance $L_{loop}$ of the minute loop antenna A3;

(i) An inductance $L_{A2}$ of the antenna element A2;

(j) A radiation resistance $R_{rA2}$ of the antenna element A2; and (k) A loss resistance $R_{CA2}$ of the antenna element A2.

A radiation resistance $R_r$ and a loss resistance $R_C$ of the whole antenna apparatus 101 are represented by the following Equations, respectively:

$$R_r=R_{rA1}+R_{rA2}+R_{rloop} \quad (1); \text{ and}$$

$$R_C=R_{CA1}+R_{CA2}+R_{Cloop} \quad (2).$$

If it is assumed that a current flows in the antenna apparatus 101 shown in FIG. 5 is I, a radiation power $P_r$ and a loss power $P_C$ are represented by the following Equations, respectively:

$$P_r=(1/2)I^2R_r \quad (3); \text{ and}$$

$$P_C=(1/2)I^2R_C \quad (4).$$

An input power $P_{in}$ which is inputted to the antenna apparatus 101 is represented by the following Equation:

$$P_{in}=P_r+P_C \quad (5).$$

Accordingly, a radiation efficiency η of the antenna apparatus 101 is represented by the following Equation:

$$\eta=P_r/P_{in}=R_r/(R_r+R_C) \quad (6).$$

Consequently, the operation and characteristic of the antenna apparatus 101 can be analyzed using the above Equations.

Figure 6:
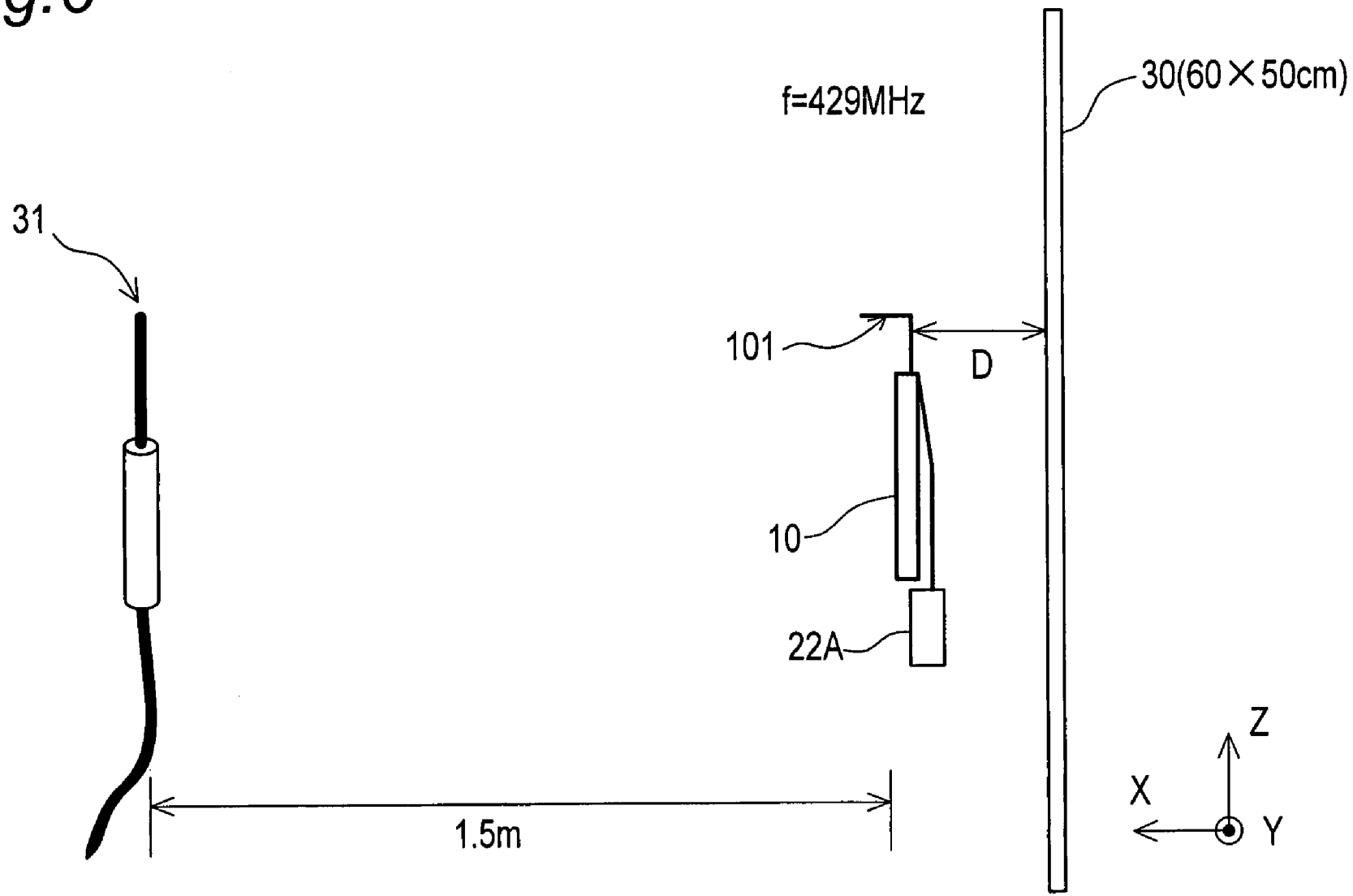
FIG. 6 is a front view showing an experiment system for use in an experiment which is executed in the state of FIG. 4.

FIG. 6 is a front view showing an experiment system as employed for an experiment which is executed in the state of FIG. 4. As shown in FIG. 6, the antenna apparatus 101 as formed on the dielectric substrate 10 and connected to an external oscillator 22A is located either closely to or apart from the metal plate 30 by a distance D. When the distance D at that time is changed, an antenna gain [dBd] in the X direction is measured with a half wavelength dipole set as a reference gain using a sleeve antenna 31 apart by a distance of 1.5 m in the X direction from the antenna apparatus 101 and having a longitudinal direction parallel to the Z direction. During the measurement, a measurement frequency is set to 429 MHz, dimensions of the dielectric substrate 10 are 29 mm×63 mm, the length of each of the antenna elements A1 and A2 is 10 mm, a height "h" of the minute loop antenna A3 is eight mm, and a width of the minute loop antenna A3 is 29 mm. Each of the elements A1, A2, and A3 of the antenna apparatus 101 is formed by bending or folding a cupper wire having 0.8 mm ϕ, and the capacitance of the capacitor C1 is 1 pF.

Figure 7:
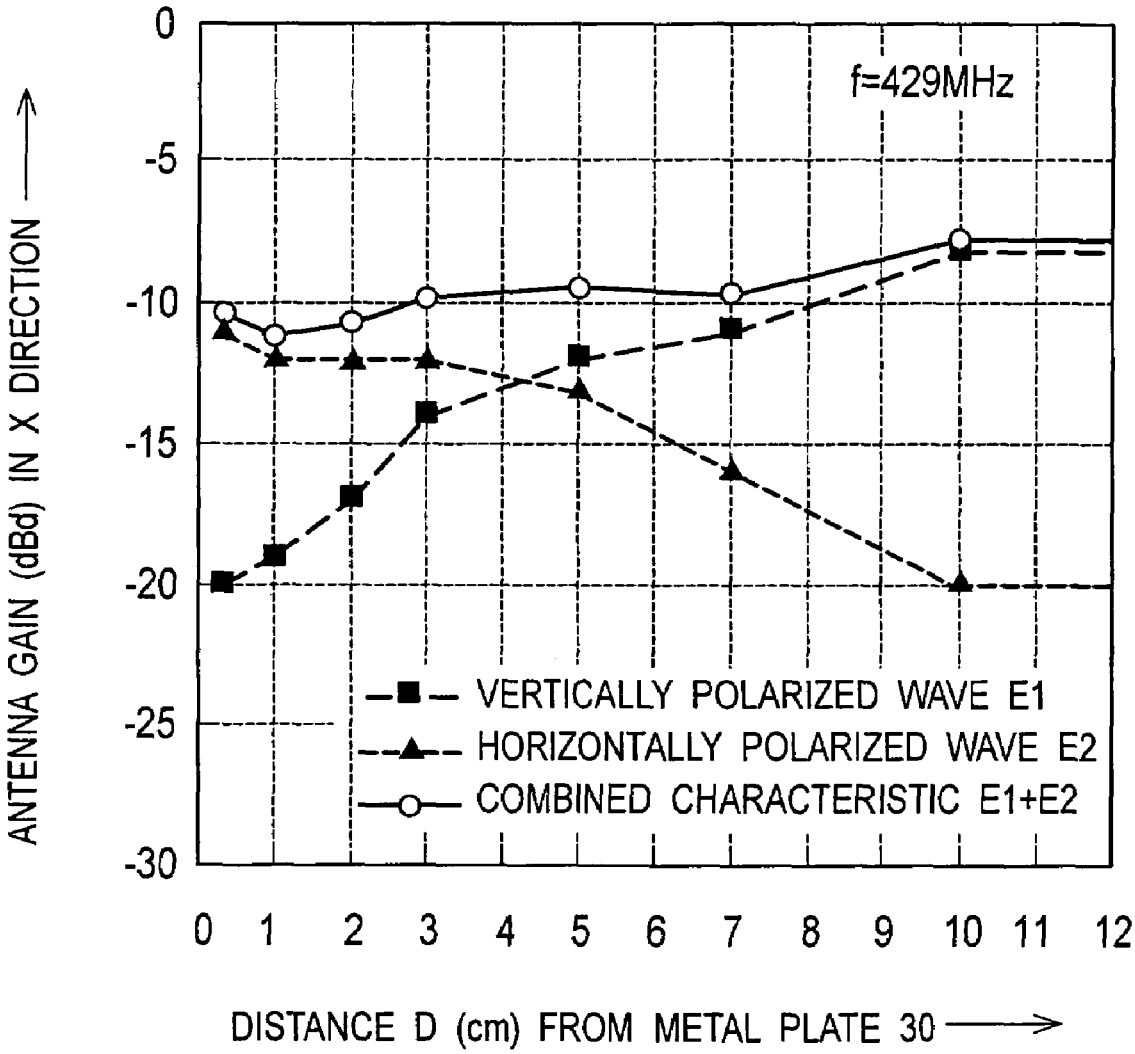
FIG. 7 is a graph showing results of the experiment of FIG. 6, and showing an antenna gain in an X direction relative to a distance D from the metal plate 30 to the antenna apparatus 101.

FIG. 7 is a graph showing results of the experiment of FIG. 6, and showing an antenna gain in the X direction relative to the distance D from the metal plate 30 to the antenna apparatus 101. As is apparent from FIG. 7, when the metal plate 30 is located apart from the antenna apparatus 101, a vertically polarized wave component (in the Z direction) is larger, and radiation by a current 11 flowing in the grounding conductor 11 of the dielectric substrate 10 is dominant. Next, when the metal plate 30 is located closely to the antenna apparatus 101 by a distance D of four cm or less, the vertically polarized wave component is suddenly reduced and a horizontally polarized wave component (in the Y axis direction) increases instead. In this case, the coil part of the minute loop antenna A3 operates as a magnetic ideal dipole (or a magnetic current antenna). In this case, it can be seen that a combined characteristic of a combination of the vertically polarized wave component and the horizontally polarized wave component has a relatively small change in the gain according to the distance D from the metal plate 3. Accordingly, the antenna apparatus 101 can attain the antenna gain equal to or larger than a predetermined antenna gain whether the metal plate 30 is located closely to or apart from the antenna apparatus 101.

Figures 8, 9, 10, 11:
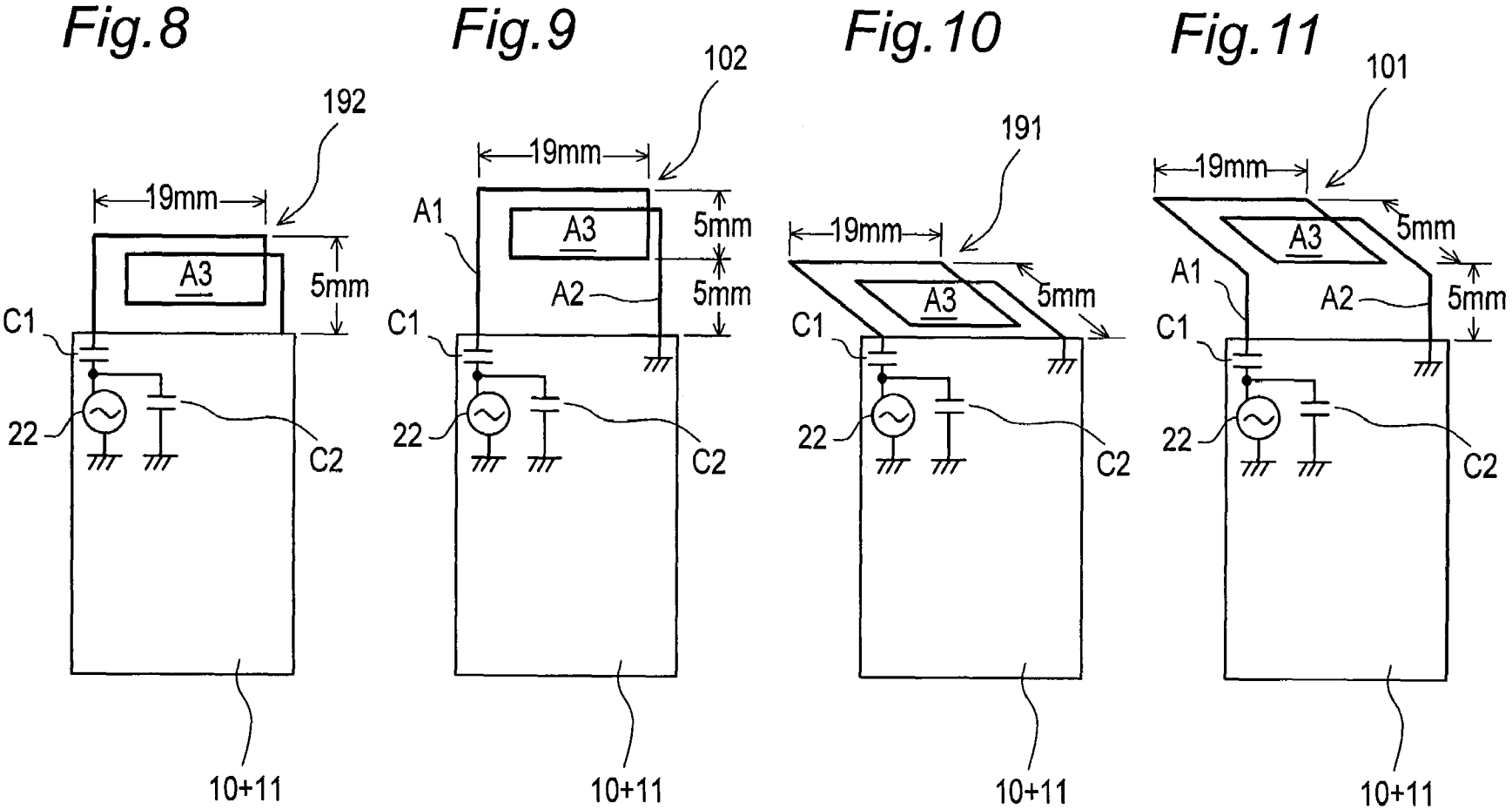
FIG. 8 is a plan view showing a configuration of an antenna apparatus 192 according to a second comparison example as used for the experiment of FIG. 6.
FIG. 9 is a plan view showing a configuration of an antenna apparatus 102 according to a second preferred embodiment as used for the experiment of FIG. 6.
FIG. 10 is a plan view showing a configuration of an antenna apparatus 191 according to a first comparison example as used for the experiment of FIG. 6.
FIG. 11 is a plan view showing a configuration of the antenna apparatus 101 according to the first preferred embodiment as used for the experiment of FIG. 6.

FIG. 8 is a plan view showing a configuration of an antenna apparatus 192 according to a second comparison example for use in the experiment of FIG. 6. As shown in FIG. 8, the antenna apparatus 192 according to the second comparison example does not include antenna elements A1 and A2 but includes only a minute loop antenna A3 parallel to the surface of the dielectric substrate 10. It is noted that dimensions of the dielectric substrate 10 are 19 mm×27 mm, which are applied to FIGS. 9 to 11 in a manner similar to that of above.

FIG. 9 is a plan view showing a configuration of an antenna apparatus 102 according to a second preferred embodiment for use in the experiment of FIG. 6. As shown in FIG. 9, the antenna apparatus 102 according to the second preferred embodiment is constituted by including the antenna elements A1 and A2 and a minute loop antenna A3 parallel to a surface of a dielectric substrate 10 in a manner similar to that of FIG. 2.

FIG. 10 is a plan view showing a configuration of an antenna apparatus 191 according to a first comparison example for use in the experiment of FIG. 6. As shown in FIG. 10, the antenna apparatus 191 according to the first comparison example does not includes antenna elements A1 and A2 but includes only a minute loop antenna A3 perpendicular to a surface of the dielectric substrate 10.

FIG. 11 is a plan view showing a configuration of the antenna apparatus 101 according, to the first preferred embodiment for use in the experiment of FIG. 6. As shown in FIG. 11, the antenna apparatus 101 according to the first preferred embodiment is constituted by including the antenna elements A1 and A2, and the minute loop antenna A3 perpendicular to a surface of the dielectric substrate 10.

In FIGS. 8 to 11, dimensions of the antenna apparatuses 101, 102, 191, and 192 for use in the experiment are those shown in the respective figures.

Figure 12:
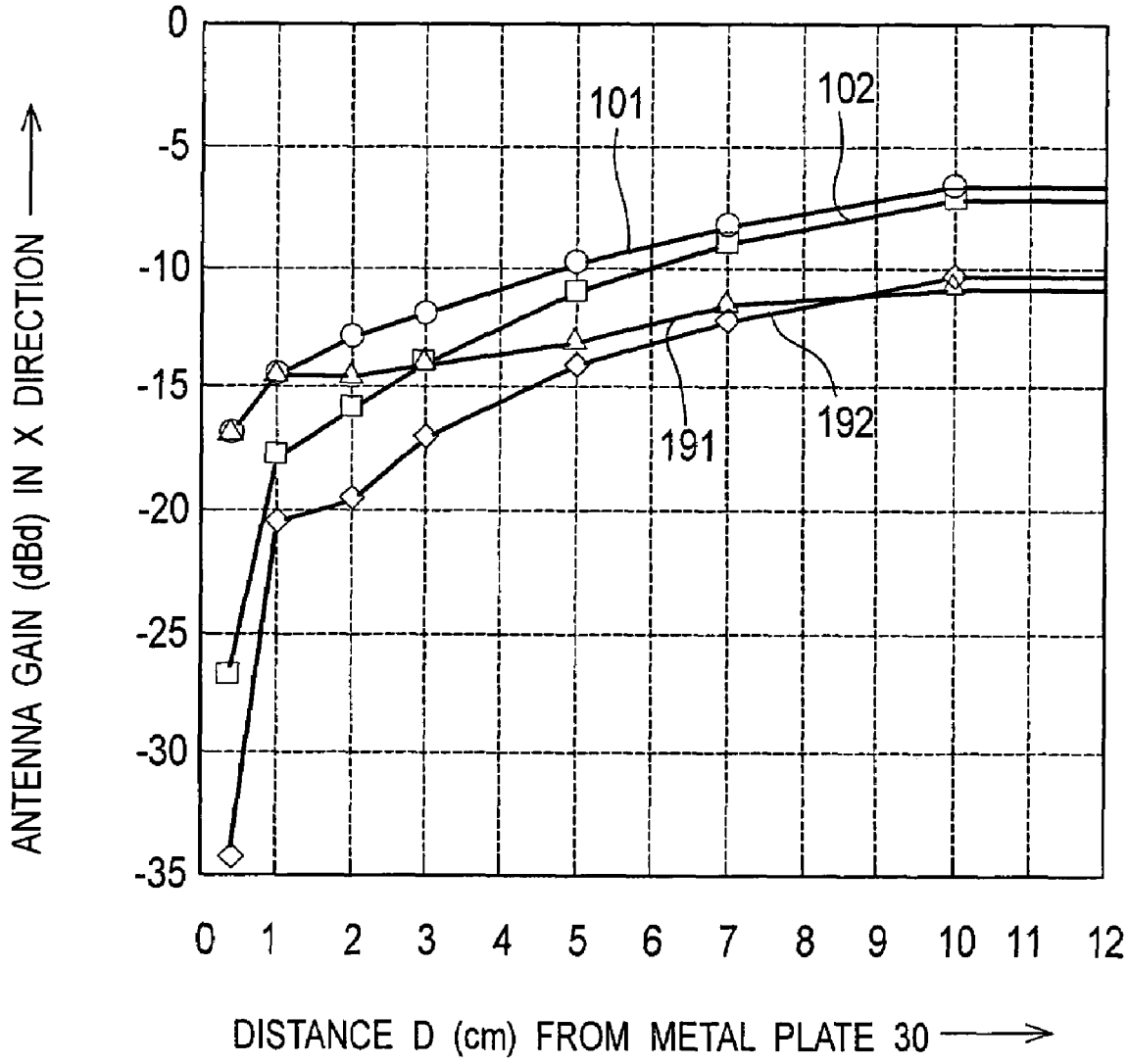
FIG. 12 is a graph showing results of the experiment of FIG. 6 for use in the respective antenna apparatuses shown in FIGS. 8 to 11, and showing an antenna gain in the X direction relative to the distance D from the metal plate 30 to the respective antenna apparatuses.

FIG. 12 is a graph showing results of the experiment of FIG. 6 for the respective antenna apparatuses shown in FIGS. 8 to 11, and showing an antenna gain in the X direction relative to the distance D from the metal plate 30 to the respective antenna apparatuses. As is apparent from FIG. 12, when the metal plate 30 is located apart from the antenna apparatus 101 or 102 which includes the antenna elements A1 and A2, the antenna apparatus 101 or 102 can attain a antenna gain larger than the antenna apparatus 191 or 192 which does not include the antenna elements A1 and A2. Further, when the antenna apparatus is located closely to the metal plate 30, the antenna apparatus 101 or 191 which includes the minute loop antenna A3 perpendicular to the surface of the dielectric substrate 10 can attain a antenna gain larger than the antenna apparatus 102 or 192 which includes the minute loop antenna A3 horizontal to the surface of the dielectric substrate 10. Therefore, if the antenna apparatus includes the antenna elements A1 and A2 and the minute loop antenna A3 perpendicular to the surface of the dielectric substrate 10, the antenna apparatus can attain a larger antenna gain whether the antenna apparatus is located apart from or closely to the metal plate 30.

Figure 13:
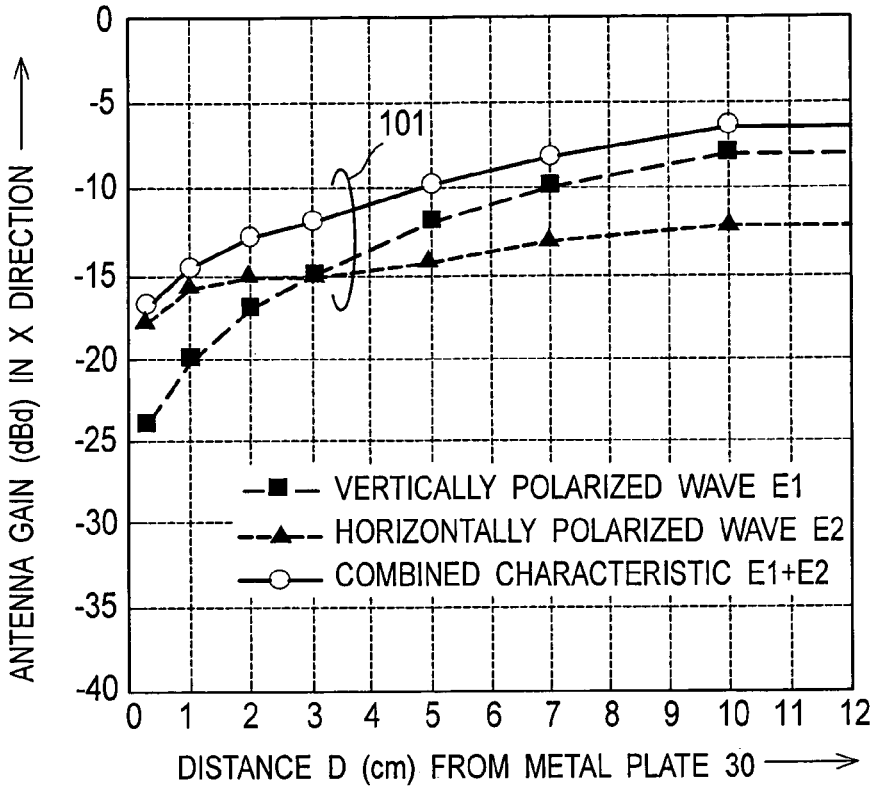
FIG. 13 is a graph showing results of the experiment of FIG. 6 for use in the antenna apparatus 101 shown in FIG. 11, and showing an antenna gain in the X direction relative to the distance D from the metal plate 30 to each antenna apparatus.
Figure 14:
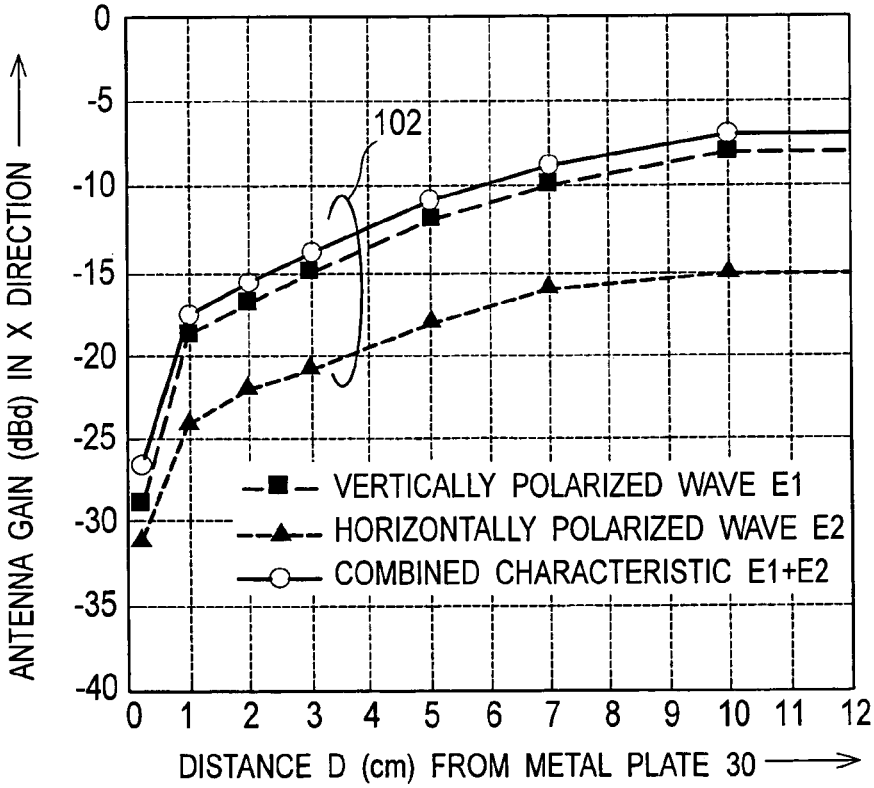
FIG. 14 is a graph showing results of the experiment of FIG. 6 for use in the antenna apparatus 102 shown in FIG. 9, and showing an antenna gain in the X direction relative to the distance D from the metal plate 30 to each antenna apparatus.
Figure 15:
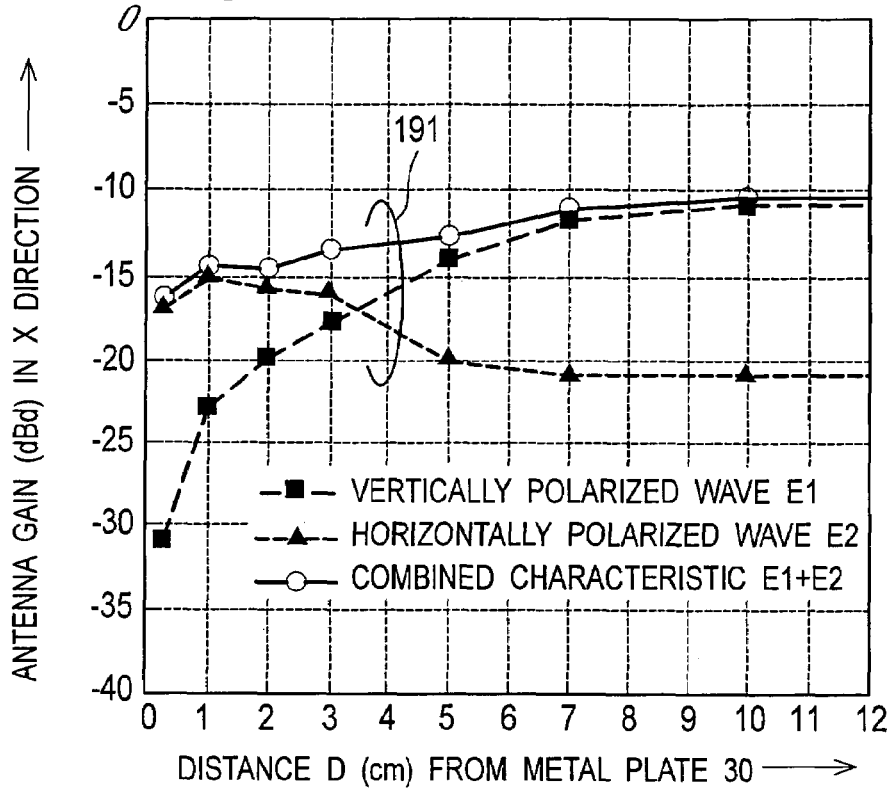
FIG. 15 is a graph showing results of the experiment of FIG. 6 for use in the antenna apparatus 191 shown in FIG. 10, and showing an antenna gain in the X direction relative to the distance D from the metal plate 30 to each antenna apparatus.
Figure 16:
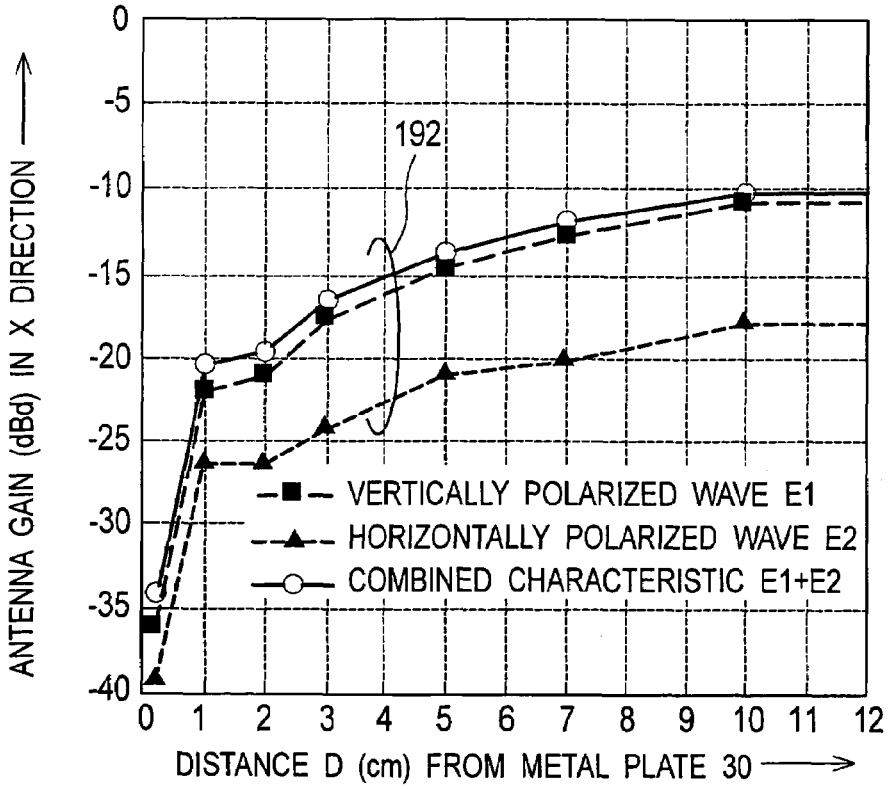
FIG. 16 is a graph showing results of the experiment of FIG. 6 for use in the antenna apparatus 192 shown in FIG. 8, and showing an antenna gain in the X direction relative to the distance D from the metal plate 30 to each antenna apparatus.

FIG. 13 is a graph showing results of the experiment of FIG. 6 for the antenna apparatus 101 shown in FIG. 11, and showing an antenna gain in the X direction relative to the distance D from the metal plate 30 to each antenna apparatus. FIG. 14 is a graph showing results of the experiment of FIG. 6 for the antenna apparatus 102 shown in FIG. 9, and showing an antenna gain in the X direction relative to the distance D from the metal plate 30 to each antenna apparatus. FIG. 15 is a graph showing results of the experiment of FIG. 6 for the antenna apparatus 191 shown in FIG. 10, and showing an antenna gain in the X direction relative to the distance D from the metal plate 30 to each antenna apparatus. FIG. 16 is a graph showing results of the experiment of FIG. 6 for the antenna apparatus 192 shown in FIG. 8, and showing an antenna gain in the X direction relative to the distance D from the metal plate 30 to each antenna apparatus.

These FIGS. 13 to 16 are graphs showing changes in polarized wave components of the antenna gain of the respective antenna apparatuses 101, 102, 191 and 192. As is apparent from FIGS. 13 to 16, when the antenna apparatus is located apart from the metal plate 30, the antenna apparatus 101 or 102 which includes the antenna elements A1 and A2 can attain an antenna gain larger than the antenna apparatus 191 or 192 which does not include the antenna elements A1 and A2 due to an increase in the vertically polarized wave component. In addition, when the antenna apparatus is located closely to the metal plate 30, the antenna apparatus 101 or 191 which includes the minute loop antenna A3 perpendicular to the surface of the dielectric substrate 10 can attain an antenna gain larger than the antenna apparatus 102 or 192 which includes the minute loop antenna A3 horizontal to the surface of the dielectric substrate 10 due to an increase in the horizontally polarized wave component.

A coil axis direction of the minute loop antenna A3 is next described. The coil axis direction of the minute loop antenna A3 is preferably set to be parallel to the longitudinal direction of the dielectric substrate 10 as shown in FIG. 1. By thus setting, even when the metal plate 30 is located closely to the antenna apparatus, a reduction in gain is characteristically smaller. Alternatively, the coil axis direction of the minute loop antenna A3 may be set to be perpendicular to the dielectric substrate 10 as shown in FIG. 2. In this case, the antenna gain can be made to be larger since the minute loop antenna A3 can be located further apart from the grounding conductor 11 by the antenna elements A1 and A2. When the metal plate 30 is not located closely to the antenna apparatus 102, the antenna apparatus 102 shown in FIG. 2 can attain an antenna gain larger than the antenna apparatus 101 shown in FIG. 1. In addition, the antenna apparatus 102 shown in FIG. 2 does not exhibit any large main beam directivity characteristic, i.e., can attain a directivity characteristic close to the omni-directivity. Further, when the minute loop antenna A3 is perpendicular to the dielectric substrate 10 and the metal plate 30 is located on both ends side of the minute loop antenna A3, the antenna apparatus 102 shown in FIG. 2 can radiate the radio wave in a direction opposite to the metal plate 30. Therefore, it can be understood that even when the metal plate 30 is located closely to the front of the radio communication apparatus, gain reduction is small.

Figure 17:
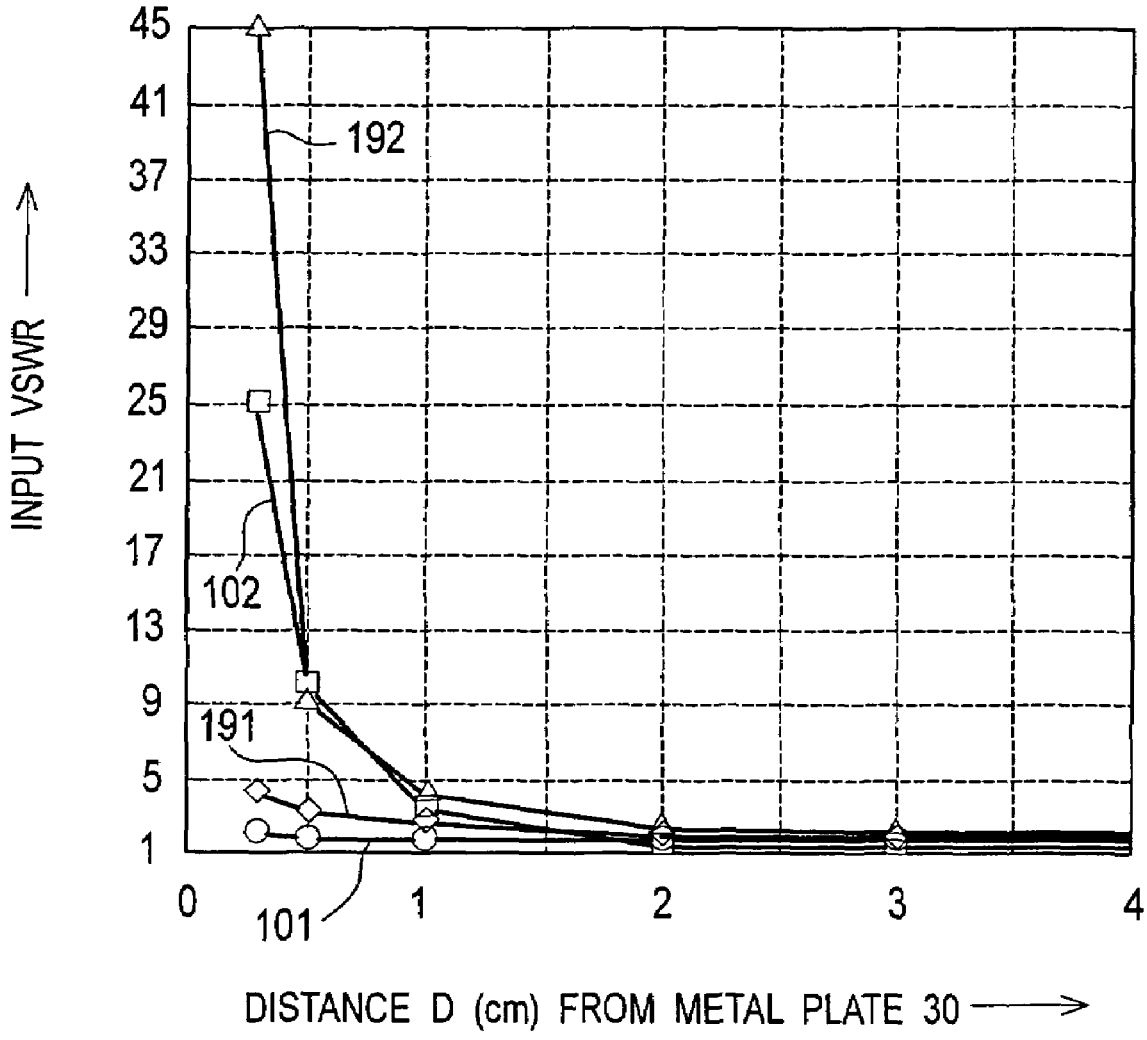
FIG. 17 is a graph showing results of the experiment of FIG. 6 for use in the respective antennas shown in FIGS. 8 to 11, and showing an input voltage standing-wave ratio (referred to as an input VSWR hereinafter) at feeding points Q of the respective antenna apparatuses relative to the distance D from the metal plate 30 to the antenna apparatuses.

FIG. 17 is a graph showing results of the experiment of FIG. 6 for the respective antennas shown in FIGS. 8 to 11, and showing an input voltage standing-wave ratio (referred to as an input VSWR hereinafter) at the feeding points Q of the respective antenna apparatuses relative to the distance D from the metal plate 30 to the antenna apparatuses. As is apparent from FIG. 17, the antenna apparatus 101 or 191 which includes the minute loop antenna A3 perpendicular to the surface of the dielectric substrate 10 has a relatively small deterioration in the input VSWR when the metal plate 30 is located closely to the antenna apparatus. Further, the antenna apparatus 101 which includes the antenna elements A1 and A2 has a smaller deterioration in the input VSWR.

Figure 18:
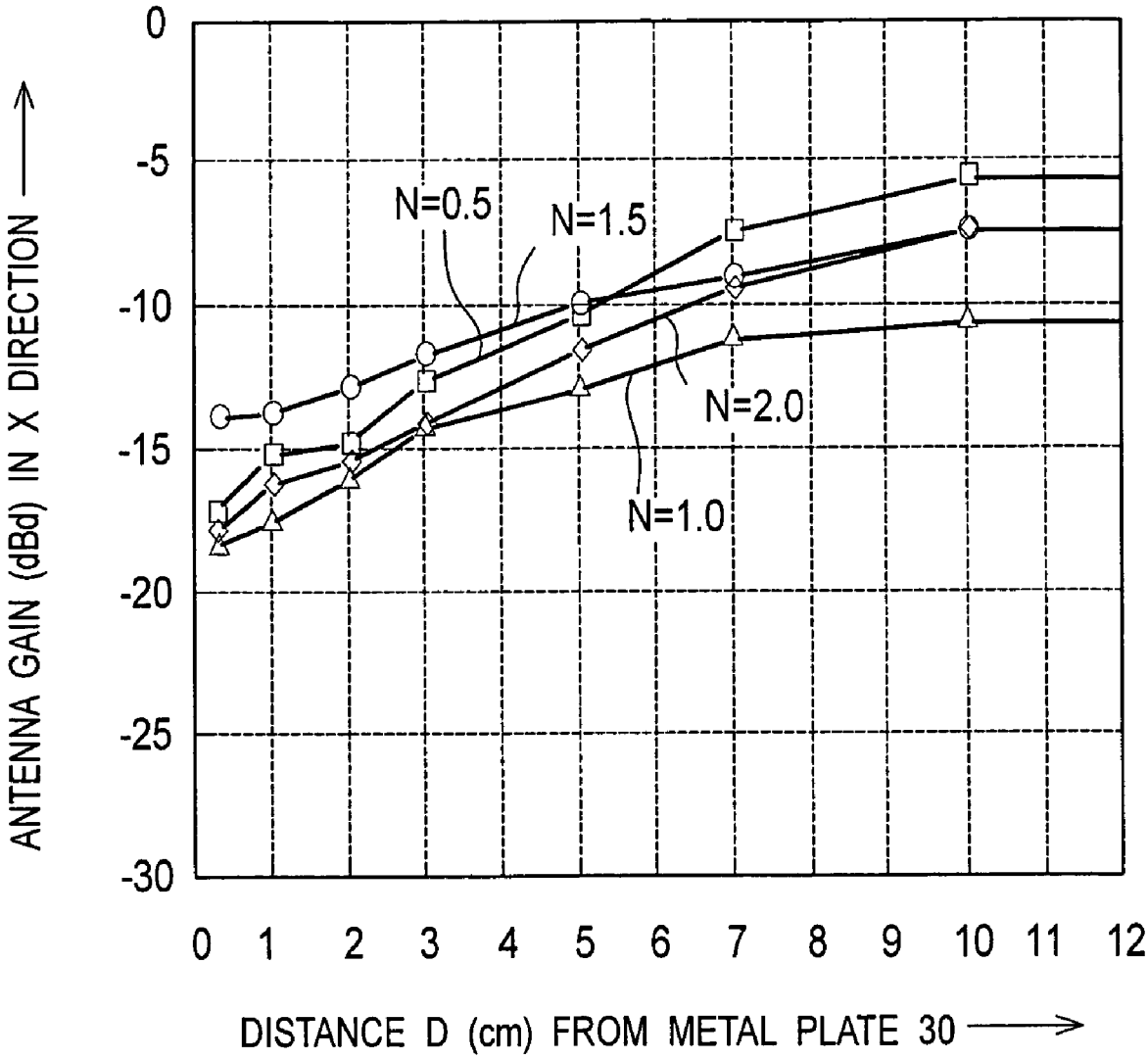
FIG. 18 is a graph showing results of the experiment of FIG. 6 for use in the antenna apparatus 101 shown in FIG. 1, and showing an antenna gain in the X direction relative to the distance D from the metal plate 30 to each antenna apparatus when the number N of turns of the loop antenna A3 is set as a parameter.

FIG. 18 is a graph showing results of the experiment of FIG. 6 for the antenna apparatus 101 shown in FIG. 1, and showing an antenna gain in the X direction relative to the distance D from the metal plate 30 to each antenna apparatus when the number N of turns of the loop antenna A3 is set as a parameter. As is apparent from FIG. 18, the antenna gain when the metal plate 30 is located closely to the antenna apparatus becomes the maximum at the number N of turns of 1.5. The reason is considered with reference to FIGS. 19 to 22 showing an operation of the antenna apparatus 101.

Figure 20:
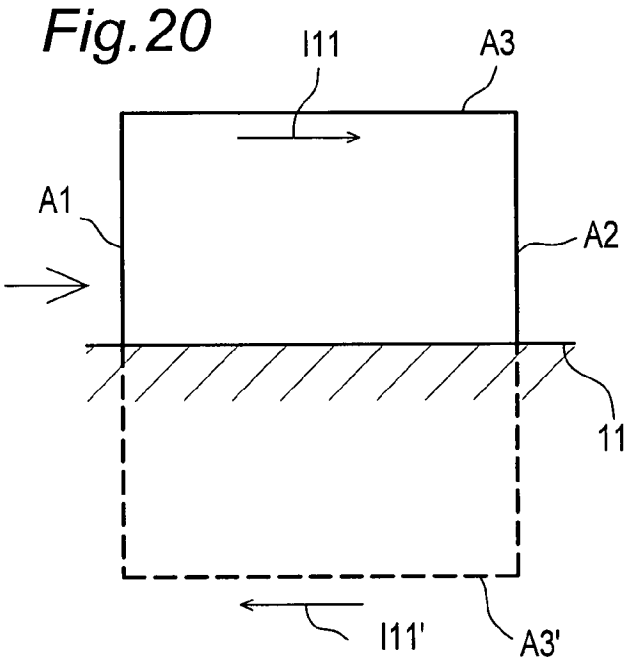
FIG. 20 is a schematic front view showing an apparent operation state in the operation shown in FIG. 19.
Figure 19:
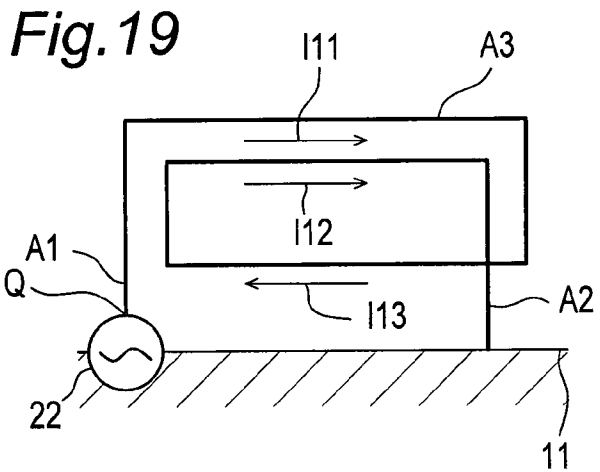
FIG. 19 is a schematic front view showing an operation of the antenna apparatus 101 shown in FIG. 1 when the number N of turns is 1.5.
Figure 22:
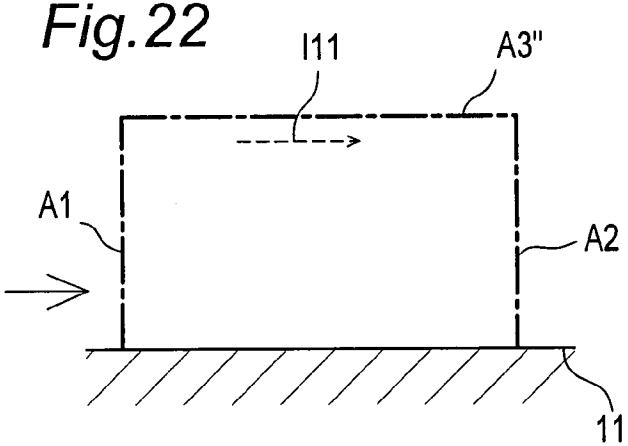
FIG. 22 is a schematic front view showing an apparent operation state in the operation shown in FIG. 21.
Figure 21:
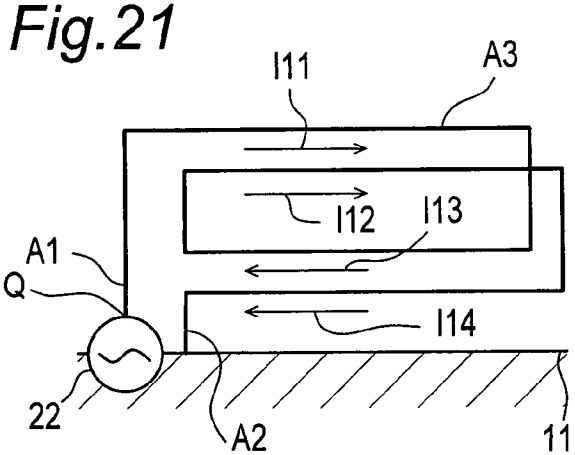
FIG. 21 is a schematic front view showing an operation of the antenna apparatus 101 shown in FIG. 1 when the number N of turns is 2.

FIG. 19 is a schematic front view showing an operation of the antenna apparatus 101 shown in FIG. 1 when the number N of turns is 1.5. FIG. 20 is a schematic front view showing an apparent operation state in the operation shown in FIG. 19. FIG. 21 is a schematic front view showing an operation of the antenna apparatus 101 shown in FIG. 1 when the number N of turns is 2. FIG. 22 is a schematic front view showing an apparent operation state in the operation shown in FIG. 21.

Referring to FIG. 19, high-frequency currents I11, I12 and I13 in a horizontal direction which flow in the 1.5-turn coil of the minute loop antenna A3 are shown. The minute loop antenna A3 operates as a magnetic ideal dipole (or a magnetic current antenna) which apparently has a large loop which is constituted by including the current I11 and an apparent current I11' by a mirror image A3' of a magnetic current shown in FIG. 20 since the currents I12 and I13 are opposite in the direction and substantially equal in magnitude to each other, and cancel each other. If the number of turns of the coil of the minute loop antenna A3 is two, the currents I11 and I13 cancel each other and the current I12 and I14 cancel each other as shown in FIG. 21. Therefore, as shown in FIG. 22, the apparent current I11 is reduced, and the antenna gain greatly deteriorates. In this way, by setting the number N of turns of the coil of the minute loop antenna A3 to about 1.5, it is possible to attain a larger antenna gain, and at the same time, to reduce the size of the antenna apparatus.

In the present preferred embodiment, the number N of turns of the minute loop antenna A3 is set to about 1.5. However, it may not be strictly or correctly 1.5. Concretely, if the number N of turns is within a range from 1.2 to 1.8, a relatively larger antenna gain can be attained. In addition, even if the number N of turns of the minute loop antenna A3 is about 0.5, about 2.5, or the like, a favorable antenna characteristic can be attained. If the number N of turns is about 2.5, in particular, the size of the antenna can be made to be smaller than that of the antenna having the number of turns of about 1.5. In addition, by setting the number N of turns of the minute loop antenna A3 to about (n−1)+0.5 (where "n" is a natural number), a larger antenna gain can be attained. Concretely, the number N of turns may be set to about 0.5, about 1.5, about 2.5, about 3.5, about 4.5, or the like.

Figure 23:
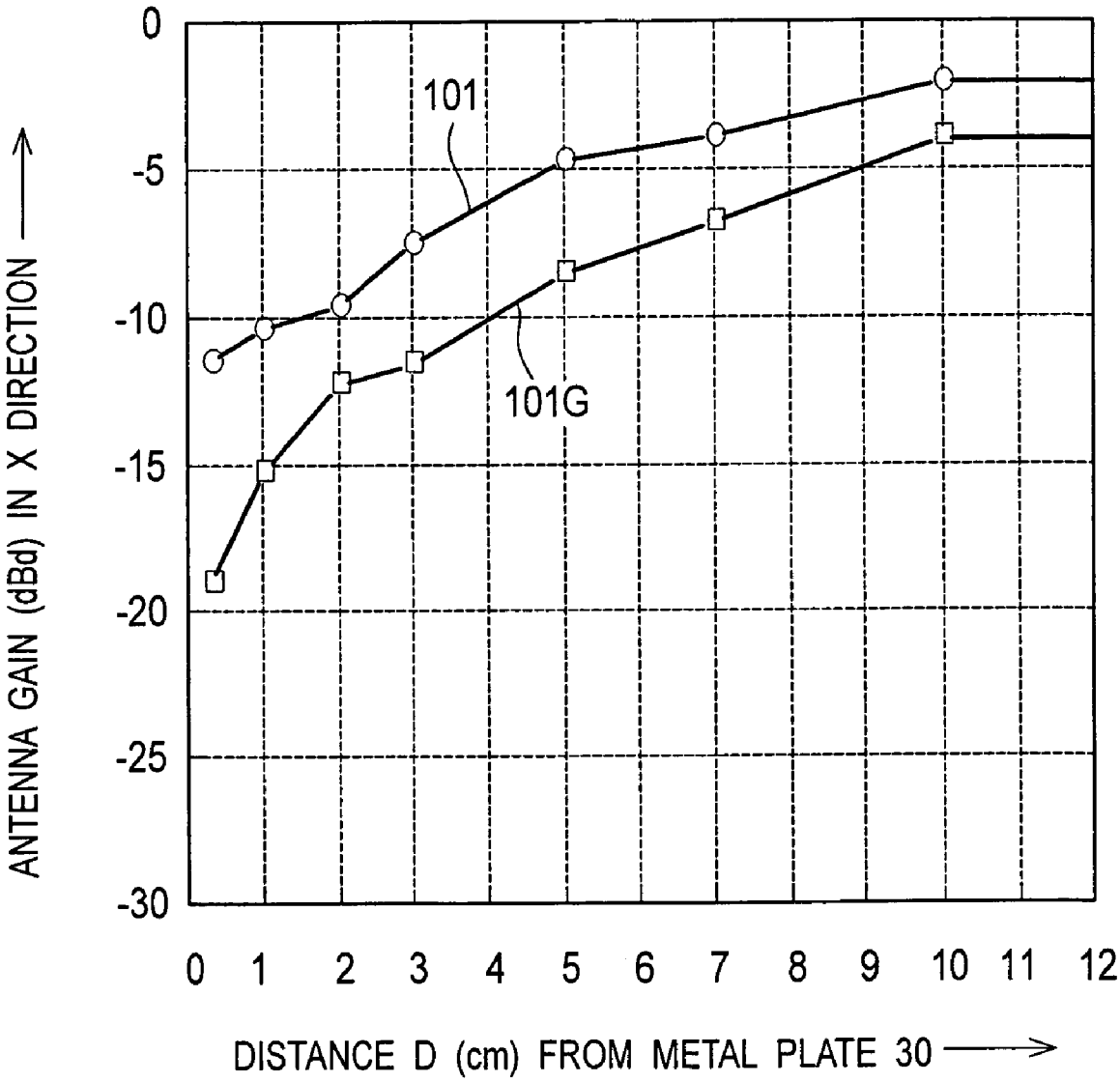
FIG. 23 is a graph showing an antenna gain in the X direction relative to the distance D from the metal plate 30 to each antenna apparatus, and showing an effect when an element width of the antenna element A2 of the antenna apparatus 101 shown in FIG. 1 is increased.
Figure 24:
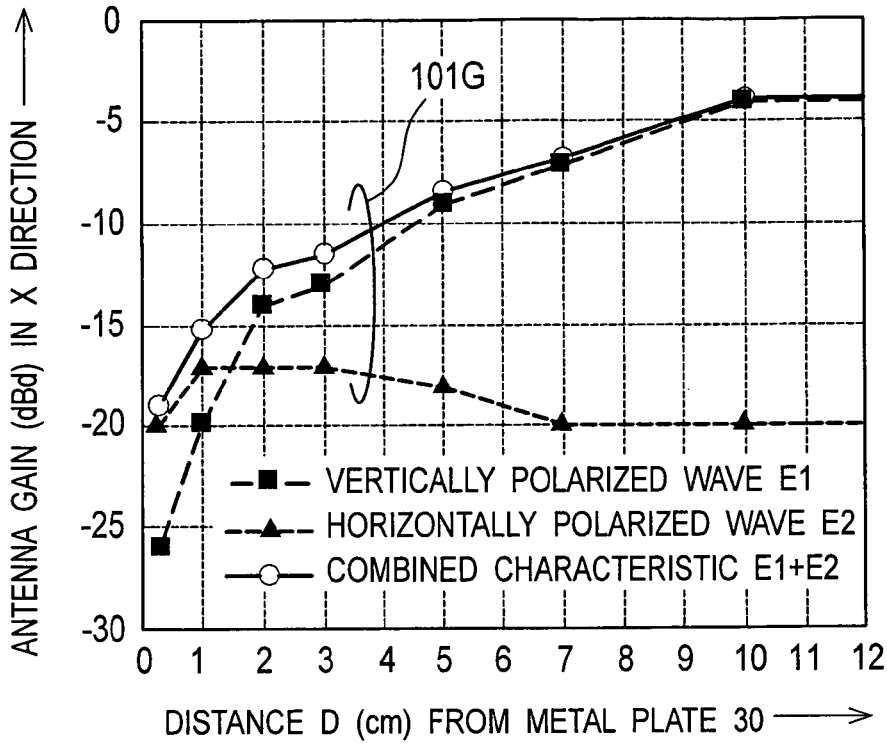
FIG. 24 is a graph showing an antenna gain in the X direction relative to the distance D from the metal plate 30 to each antenna apparatus when the element width of the antenna element A2 of the antenna apparatus 101 is increased.
Figure 25:
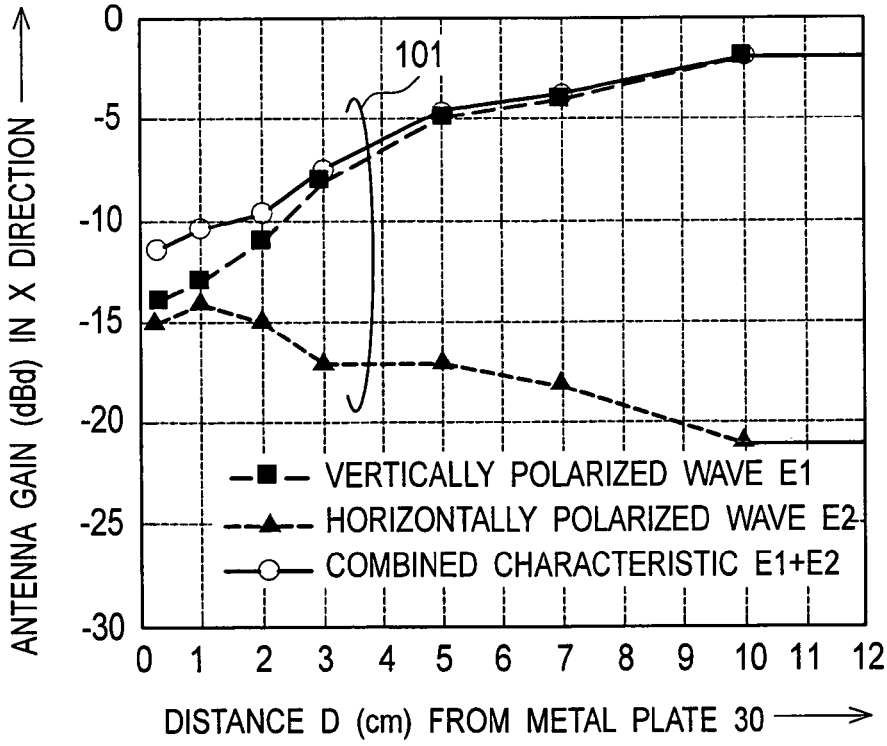
FIG. 25 is a graph showing an antenna gain in the X direction relative to the distance D from the metal plate 30 to each antenna apparatus when the element width of the antenna element A2 of the antenna apparatus 101 shown in FIG. 1 is not increased, that is, an antenna gain of the antenna apparatus 101 in the X direction shown in FIG. 1.

FIG. 23 is a graph showing an antenna gain in the X direction relative to the distance D from the metal plate 30 to each antenna apparatus, and showing an effect when an element width of the antenna element A2 of the antenna apparatus 101 shown in FIG. 1 is increased (the antenna apparatus in this state is denoted by 101G in FIG. 23). FIG. 24 is a graph showing an antenna gain in the X direction relative to the distance D From the metal plate 30 to each antenna apparatus when the element width of the antenna element A2 of the antenna apparatus 101 shown in FIG. 1 is increased. FIG. 25 is a graph showing an antenna gain in the X direction relative to the distance D from the metal plate 30 to each antenna apparatus when the element width of the antenna element A2 of the antenna apparatus 101 shown in FIG. 1 is not increased, that is, an antenna gain of the antenna apparatus 101 in the X direction shown in FIG. 1.

The experiments of FIGS. 23 to 25 are conducted while a width of the strip conductor of the antenna element A2 is increased up to about half the width of the dielectric substrate 10 in an antenna apparatus 107 shown in FIG. 30 as described later. In the antenna apparatus 101G in this state, the right antenna element A2 is set substantially into a state of a grounding conductor, so that the antenna apparatus 101G is equivalent to an antenna apparatus which does not include the antenna element A2. In other words, as is apparent from FIG. 23, an antenna gain of the antenna apparatus 101 including the antenna element A2 is extremely larger than that of the antenna apparatus 101G of the comparison example which does not include the antenna element A2.

As described above, according to the antenna apparatus 101 of the first embodiment, when the distance D from the metal plate 30 is set to be smaller, the operation of the antenna apparatus 101 is switched over from the current type operation to the magnetic current type operation, so that a favorable radiation gain is constantly attained. The inventors of the present invention included a radio module of the radio communication apparatus, to which the antenna apparatus 101 is applied, in each household electric appliance, and performed a characteristic evaluation. As a result, a refrigerator and an air-conditioner had a favorable antenna gain of −10 dBd and −11 dBd, respectively, as the maximum antenna gain in the directivity measurement.

A relationship between the magnitude and the number N of turns of the coil of the minute loop antenna A3 and the length of each of the antenna elements A1 and A2 is described. By appropriately adjusting the relationship, the input VSWR hardly changes whether the metal plate 30 is present or not, and this keeping a balanced relationship. The reason is as follows. According to the experiments conducted by the inventors of the present invention, when the metal plate 30 is located closely to the antenna apparatus, the inductances of the antenna elements A1 and A2 are reduced but the inductance of the coil of the minute loop antenna A3 is increased. The grounds for this are the following measurement results. When the number N of turns of the minute loop antenna A is relatively smaller (N=0.5 or 1), the resonance frequency changes to a higher side when the metal plate 30 is located closely to the antenna apparatus. When the number N of turns is relatively larger (N=1.5 or 2), the resonance frequency changes to a smaller side.

FOURTH PREFERRED EMBODIMENT

Figure 26:
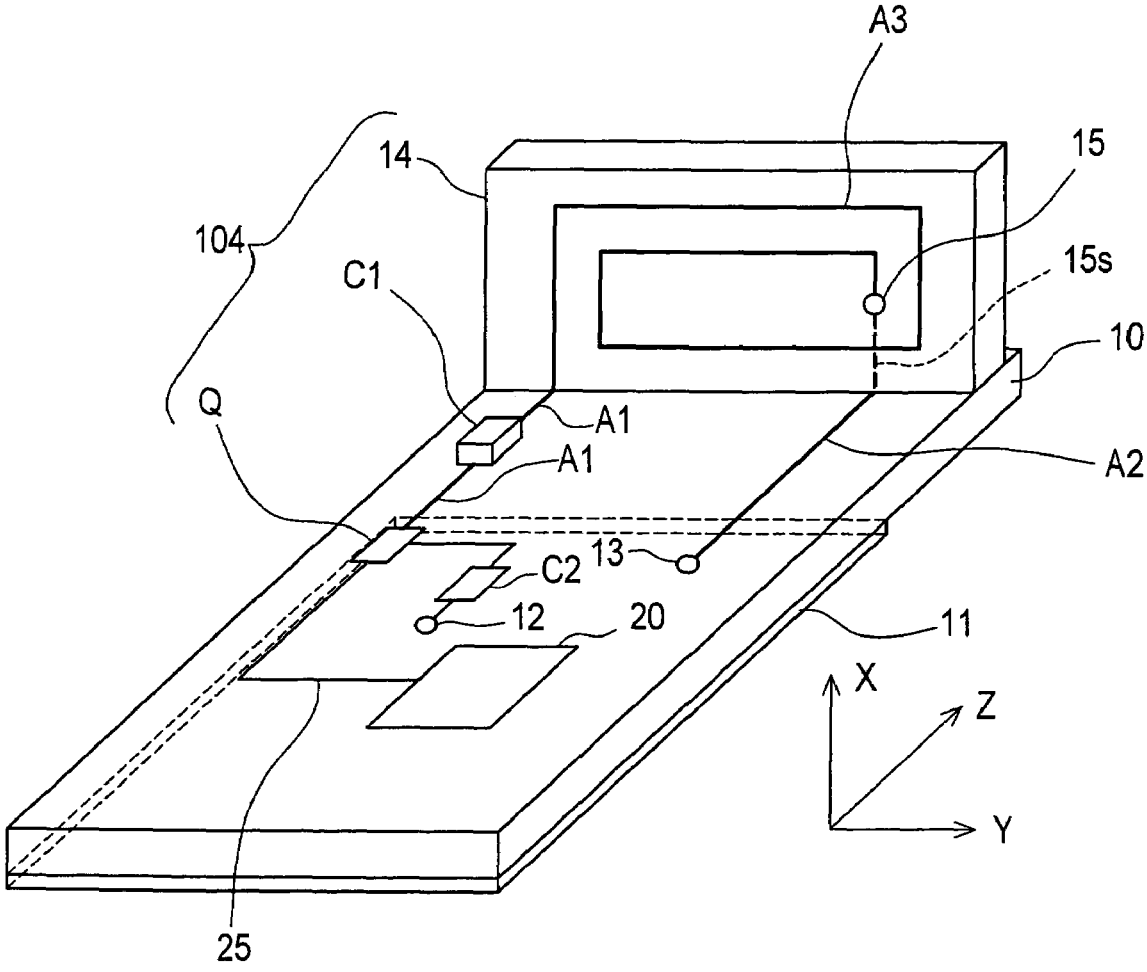
FIG. 26 is a perspective view showing a configuration of an antenna apparatus 104 according to a fourth preferred embodiment of the present invention.

FIG. 26 is a perspective view showing a configuration of an antenna apparatus 104 according to a fourth preferred embodiment of the present invention. Referring to FIG. 26, the antenna apparatus 104 according to the fourth preferred embodiment differs from the antenna apparatus 101 according to the first preferred embodiment shown in FIG. 1 in the following respects.

(1) The antenna elements A1 and A2 are constituted by forming copper foil strip conductors on the dielectric substrate 10 using the printed wiring method, respectively. It is noted that any grounding conductor 11 is not formed on a rear surface of an inner-part edge portion of the dielectric substrate 10, on which the antenna elements A1 and A2 are formed.

(2) In the inner-part edge portion of the dielectric substrate 10 in the longitudinal direction thereof, the dielectric substrate 14 perpendicular to the dielectric substrate 10 and substantially equal in width to the dielectric substrate 10 is provided to stand by bonding such as that using an adhesive or the like.

(3) The minute loop antenna A3 is constituted by forming a copper foil strip conductor on the dielectric substrate 14 using the printed wiring method. In an end portion of the minute loop antenna A3 as located near the ground side, the through-hole conductor 15 is formed by filling a conductor into a through hole which penetrates the dielectric substrate 14 in the thickness direction thereof. In addition, the end portion of the minute loop antenna A3 as located near the ground side is connected to the antenna element A2 through a strip conductor 15*s* formed on a rear surface of the dielectric substrate 14 through the through-hole conductor 15.

(4) The capacitor C1 is connected not near the feeding point Q but preferably and generally at the central point of the antenna element A1 as shown in FIG. 26. The function and advantageous effects thereof are described later in detail with reference to FIGS. 32 to 34.

As the dielectric substrates 10 and 14, any kinds of substrates can be used such as a glass epoxy substrate, a Teflon (trademark) substrate, a ceramic substrate, a paper phenol substrate, a multilayer substrate, or the like.

In the present preferred embodiment, since the antenna elements A1 and A2 and the minute loop antenna A3 are formed using strip conductors, they can be produced with a high dimensional accuracy using the printed wiring method. As for a copper foil strip conductor on an ordinary glass epoxy substrate, the variation in the width of the strip conductor is about within ±30 μm when the strip conductors are mass-produced. Therefore, the variation in the impedance of the antenna apparatus using the strip conductors can be reduced. Further, the capacitor C1 can be constituted by, for example, a chip capacitor. A higher-accuracy chip capacitor is commercially available. For example, a high-accuracy chip capacitor having a capacitance of several pico-farads has a capacitance error of ±0.1 pF.

Accordingly, by using these strip conductors and the chip capacitor serving as the capacitor C1 for use in the antenna apparatus 104, it is possible to suppress the variation in the resonance frequency of the antenna apparatus 104. Further, since the antenna structure can be assembled on the dielectric substrate 10 of a printed wiring board on which the radio communication circuit 20 is mounted, the parts to be assembled are hardly present, the dimensional accuracy can be improved. In addition, because of the small variation in the resonance frequency of the antenna apparatus 104, a step of adjusting the resonance frequency can be omitted during manufacturing. Since structures other than the dielectric substrates 10 and 14 are unnecessary in the antenna apparatus 104, the size of the antenna apparatus 104 can be reduced and the cost of the apparatus 104 can be reduced.

Moreover, the high-frequency resistance of a copper strip conductor having a relatively large width (e.g., a strip conductor width of about 0.5 to 2 mm) is relatively low, so that the coil of the minute loop antenna A3 can exhibit a Q-value of about 100 or more. In addition, the chip capacitor of the capacitor C1 having a capacitance of about 0.5 to 10 pF and a Q-value of 100 or more can be easily obtained. Due to this, the antenna apparatus 104 having a smaller loss and a larger gain can be realized. Furthermore, in this antenna apparatus 104, the strip conductor serving as the minute loop antenna A3 is formed on the dielectric substrate 14 of a printed wiring board. Therefore, the antenna apparatus 104 advantageously has a higher flexibility in an insertion position of the capacitor C1 to be mounted.

In the present preferred embodiment as mentioned above, the strip conductor serving as the minute loop antenna A3 is formed on the dielectric substrate 14. However, the present invention is not limited to this, and for example, a coiled conducting wire may be used as the minute loop antenna A3 as shown in FIG. 1.

FIFTH PREFERRED EMBODIMENT

Figure 27:
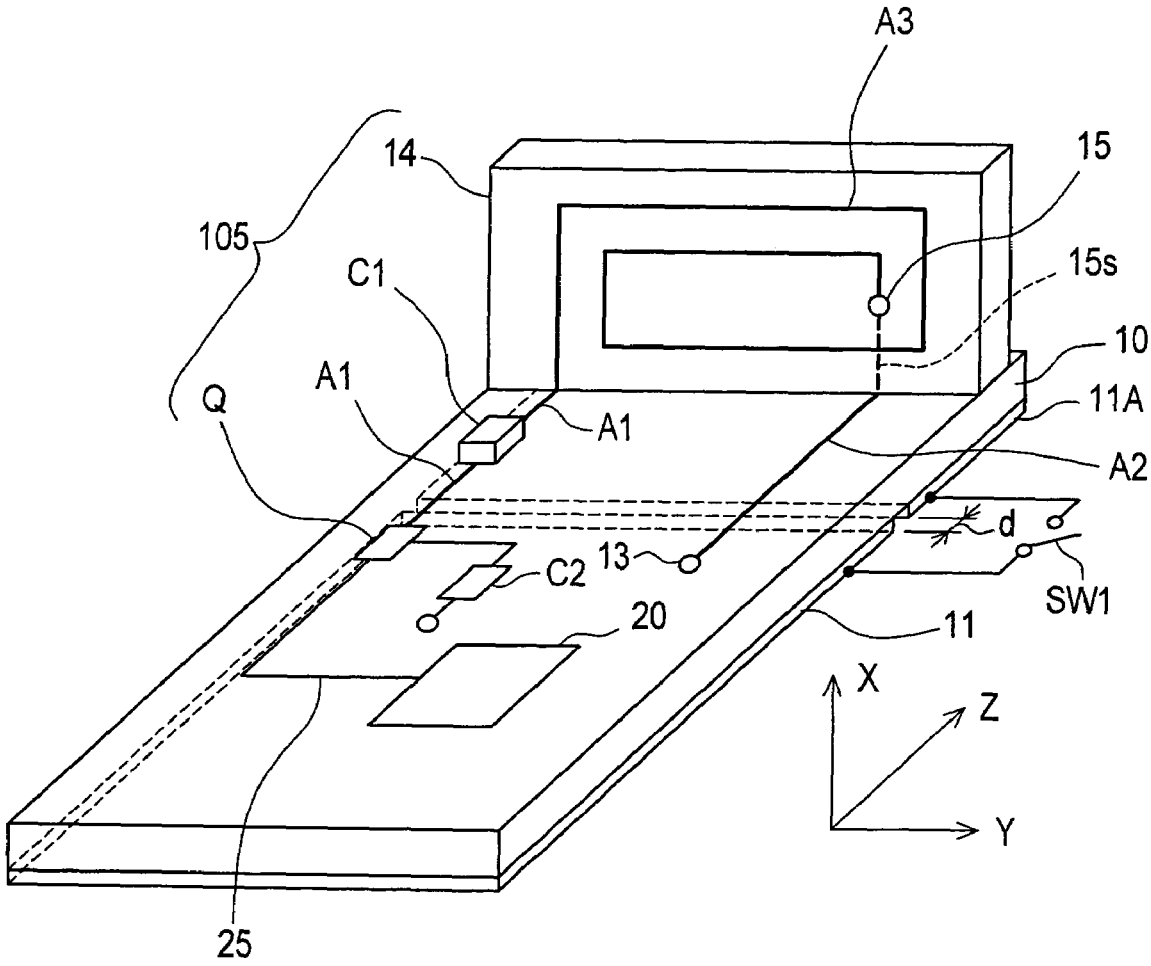
FIG. 27 is a perspective view showing a configuration of an antenna apparatus 105 according to a fifth preferred embodiment of the present invention.

FIG. 27 is a perspective view showing a configuration of an antenna apparatus 105 according to a fifth preferred embodiment of the present invention. The antenna apparatus 105 according to the fifth preferred embodiment differs from the antenna apparatus 104 according to the fourth preferred embodiment in the following respects.

(1) On a rear surface of an inner-part edge portion of the dielectric substrate 10 on which the antenna elements A1 and A2 are formed, a floating conductor 11A is formed so as to be apart from the grounding conductor 11 by a predetermined distance "d" in the longitudinal direction of the dielectric substrate 10 and to be electrically isolated from the grounding conductor 11. In this case, the floating conductor 11A is formed closely to the antenna elements A1 and A2 and the minute loop antenna A3 so as to be electromagnetically coupled with them.

(2) A switch SW1 such as a mechanical contact switch or the like is connected so as to be inserted between the grounding conductor 11 and the floating conductor 11A.

In the antenna apparatus 105 as thus constituted, by switching the switch SW1 in ON or OFF state, grounding states of the antenna elements A1 and A2 through the dielectric substrate 10 are changed. In other words, when the switch SW1 is turned off, the floating conductor 11A is not grounded but electrically floats from the ground potential. Due to this, an influence of strip conductors serving as the minute loop antenna A3 and the antenna elements A1 and A2 that constitute the antenna apparatus 105 onto a potential change is relatively small. At this time, the antenna apparatus 105 has an antenna gain characteristic close to a characteristic shown as a vertically polarized wave component in FIG. 7. When the switch SW1 is turned on, the floating conductor 11A is connected to the grounding conductor 11 through the switch SW1 to be grounded. Therefore, the antenna apparatus 105 has an antenna gain characteristic close to a horizontally polarized wave component, where the antenna gain characteristic corresponds to such a case that the metal plate 30 is located closely to the rear surface side of the dielectric substrate 10 of FIG. 7. In other words, by turning on or off the switch SW1, the directivity characteristic of the antenna apparatus 105 in the radiation direction and the direction of the plane of polarization can be switched over. In particular, the plane of polarization changes substantially by 90 degrees, and this leads to that a diversity effect can be attained and a communication performance of the radio communication circuit 20 can be greatly improved.

In the antenna apparatus 105 according to the fifth preferred embodiment mentioned above, the floating conductor 11A may be formed closely only to a part of the antenna elements A1 and A2. Further, the floating conductor 11A may be formed on an inner layer surface of the dielectric substrate 10 made of a multilayer substrate. In addition, the antenna elements A1 and A2 and the minute loop antenna A3 that constitute the antenna apparatus 105 may be formed not by strip conductors on the dielectric substrates 10 and 14 but by conducting wires.

Figure 28:
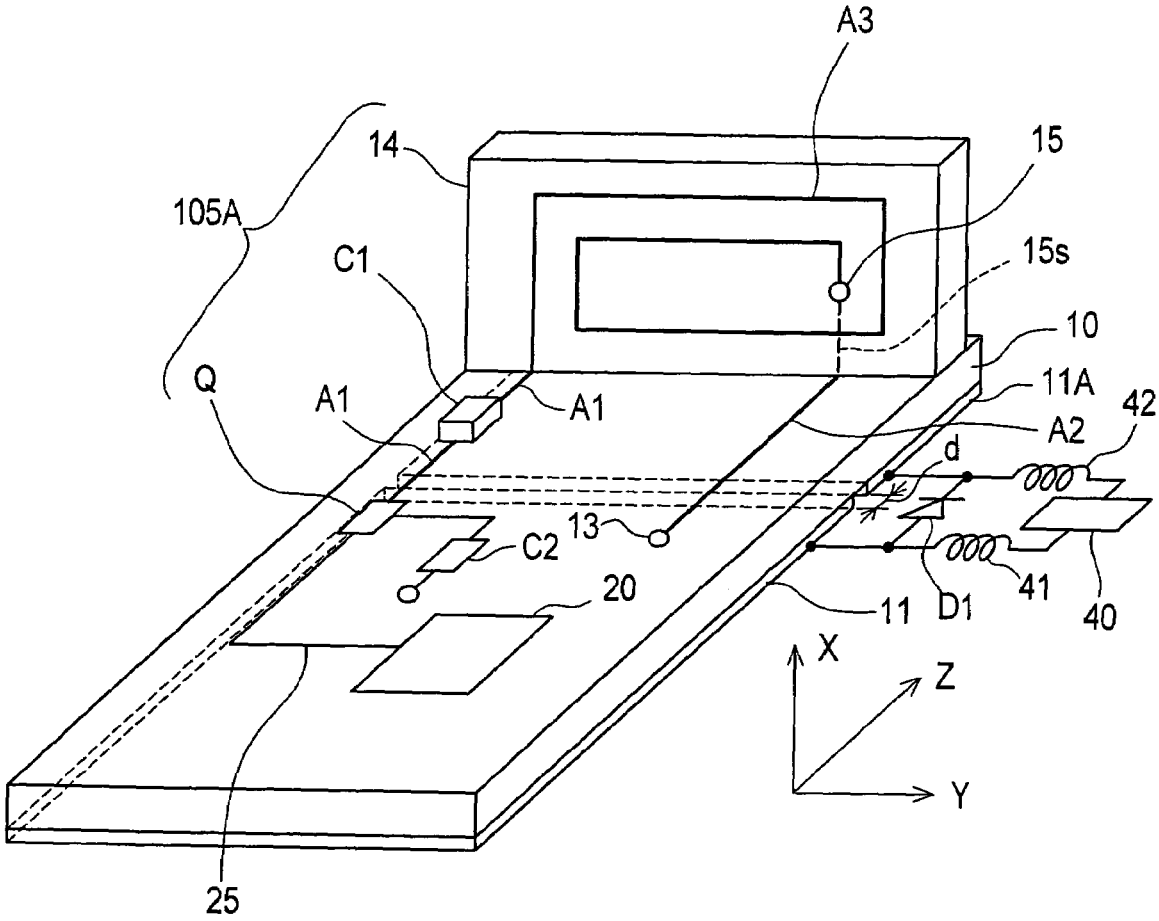
FIG. 28 is a perspective view showing a configuration of an antenna apparatus 105A according to a modified preferred embodiment of the fifth preferred embodiment of the present invention.

FIG. 28 is a perspective view showing a configuration of an antenna apparatus 105A according to a modified preferred embodiment of the fifth preferred embodiment of the present invention. Referring to FIG. 28, the antenna apparatus 105A according to the modified preferred embodiment of the fifth preferred embodiment differs from the antenna apparatus 105 according to the fifth preferred embodiment in the following respects.

(1) The switch SW1 is constituted by a high-frequency semiconductor diode D1.

(2) Both ends of the high-frequency semiconductor diode D1 are connected to a switch controller 40 through high-frequency stopping inductances 41 and 42, respectively.

The switch controller 40 applies two predetermined reverse bias voltages to the high-frequency semiconductor diode D1 so as to switch the high-frequency diode D1 to ON or OFF state, respectively. The directivity characteristic of the antenna apparatus 105 in the radiation direction and the direction of the plane of polarization can be switched over. According to the present preferred embodiment, the antenna apparatus 105A can be constituted with quite a simple structure, a small size, and a lightweight with a lower manufacturing cost.

SIXTH PREFERRED EMBODIMENT

Figure 29:
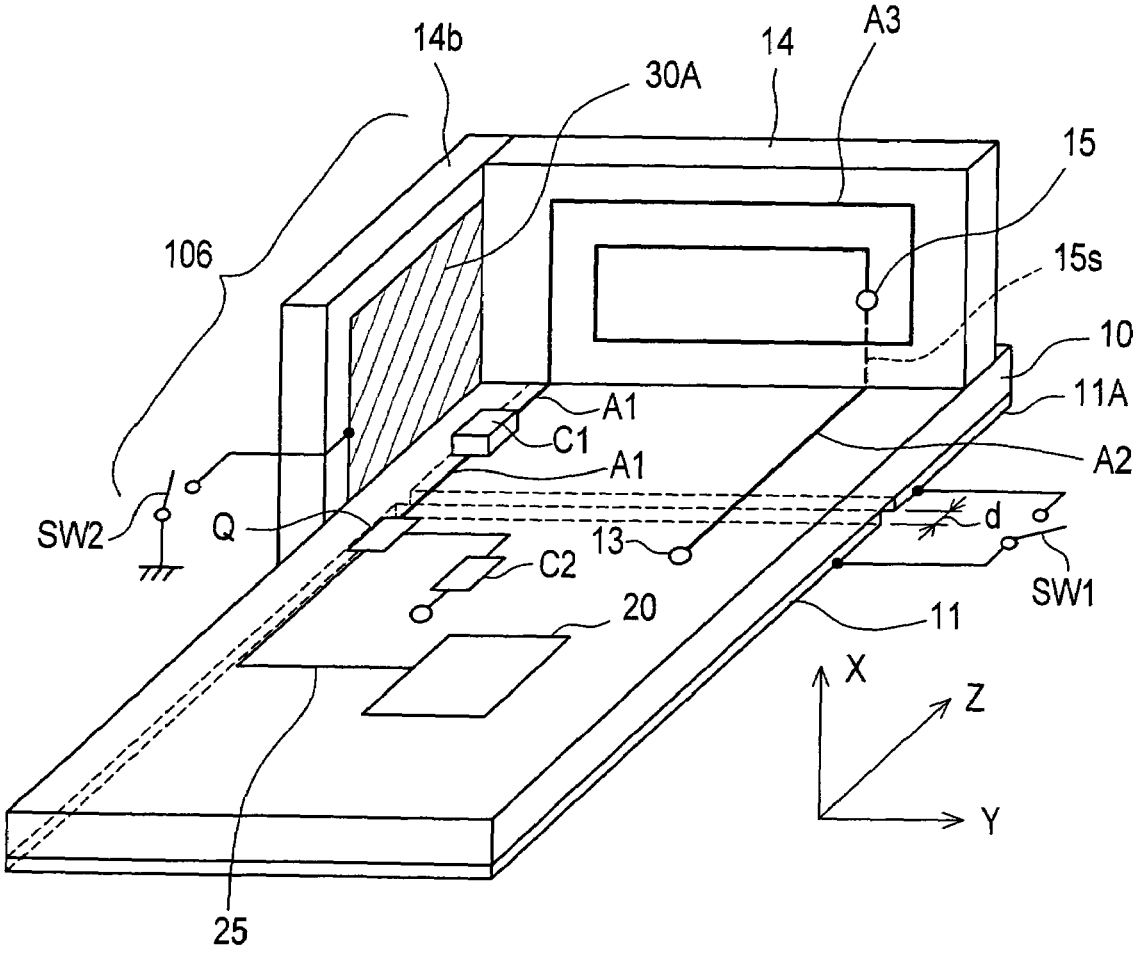
FIG. 29 is a perspective view showing a configuration of an antenna apparatus 106 according to a sixth preferred embodiment of the present invention.

FIG. 29 is a perspective view showing a configuration of an antenna apparatus 106 according to a sixth preferred embodiment of the present invention. Referring to FIG. 29, the antenna apparatus 106 according to the sixth preferred embodiment differs from the antenna apparatus 105 according to the fifth preferred embodiment in the following respects.

(1) A dielectric substrate 14*b* is provided in an inner part as located near the antenna element A1 on the left side surface of the dielectric substrate 10, where a floating conductor 30A is formed on the dielectric substrate 14*b* to be perpendicular to dielectric substrates 10 and 14, and the dielectric substrate 14*b* is provided to be bonded with the left side surface of the dielectric substrate 10. In this case, the floating conductor 30A is formed closely to the antenna elements A1 and A2 and a minute loop antenna A3 so as to be electromagnetically coupled with them.

(2) The floating conductor 30A is connected to the grounding conductor 11 or the like through a switch SW2 made of, for example, a mechanical contact switch or a high-frequency semiconductor diode, so as to be grounded.

According to the present preferred embodiment, two floating conductors 11A and 30A are further provided, and switches SW1 and SW2 are turned on or off, respectively, so as to ground at least one of the floating conductors 11A and 30A. The directivity characteristic of the radio wave of the radio signal to be transmitted or received and the plane of polarization can be switched over. For example, by turning on the switch SW1, a horizontally polarized wave component in the Y direction is dominant as shown in FIG. 7 showing such a state that the metal plate 30 is located closely to the antenna apparatus, and radiation of a horizontally polarized wave component (in the Y direction) to the X direction is dominant when the metal plate 30 is located apart from the antenna apparatus. In addition, by turning on the switch SW2, the floating conductor 30A serving as the grounding conductor functions as a reflecting plate, and the radiation of the horizontally polarized wave component (in the X direction) to the Y direction is increased. Accordingly, when the metal plate 30 is located apart from the antenna apparatus, the two floating conductors 11A and 30A are perpendicular to each other. Therefore, it is possible to change the main beam direction by about 90 degrees.

In the present preferred embodiment, the antenna apparatus 106 includes both of (a) the circuit of the first pair of the floating conductor 11A and the switch SW1 and (b) the circuit of the second pair of the floating conductor 30A and the switch SW2. However, the present invention is not limited to this but the antenna apparatus 106 may include at least one of the pairs.

SEVENTH PREFERRED EMBODIMENT

Figure 30:
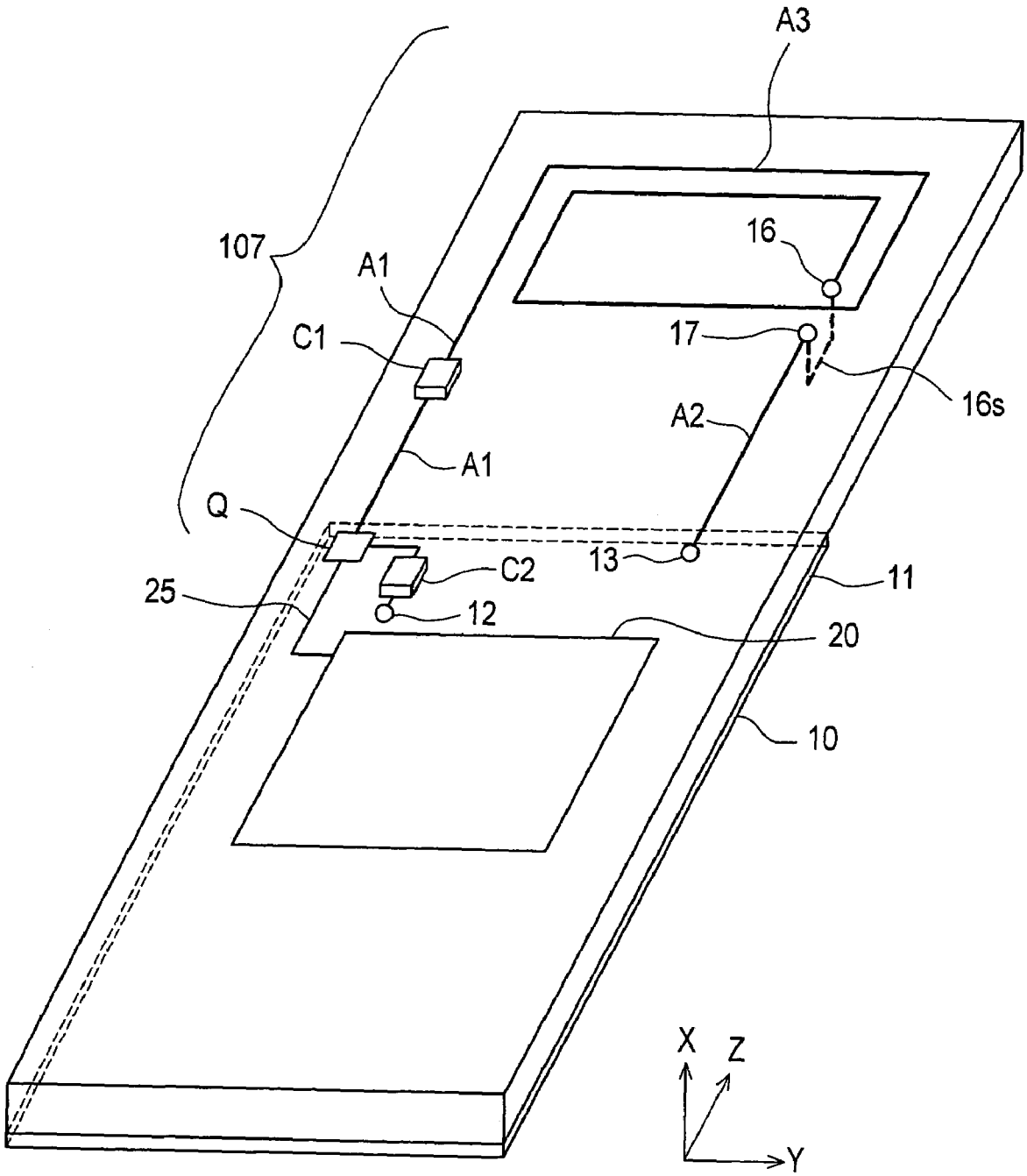
FIG. 30 is a perspective view showing a configuration of an antenna apparatus 107 according to a seventh preferred embodiment of the present invention.

FIG. 30 is a perspective view showing a configuration of an antenna apparatus 107 according to a seventh preferred embodiment of the present invention. Referring to FIG. 30, the antenna apparatus 107 according to the seventh preferred embodiment differs from the antenna apparatus 102 according to the second preferred embodiment shown in FIG. 2 in the following respects.

(1) The antenna elements A1 and A2 and the minute loop antenna A3 are constituted by forming copper foil strip conductors on the dielectric substrate 10 using the printed wiring method, respectively. On the rear surface of the inner-part edge portion of the dielectric substrate 10 on which the antenna elements A1 and A2 and the minute loop antenna A3 are formed, any grounding conductor 11 is not formed.

(2) In an end portion of the minute loop antenna A3 as located near the ground side, a through-hole conductor 16 is formed by filling a conductor into a through hole which penetrates the dielectric substrate 10 in the thickness direction thereof. The end portion of the minute loop antenna A3 as located near the ground side is connected to a strip conductor 16*s* formed on the rear surface of the dielectric substrate 10, through the through-hole conductor 16. A through-hole conductor 17 is formed at a position near the through-hole conductor 16, so that the strip conductor of the minute loop antenna A3 is sandwiched between the through-hole conductor 16 and the through-hole conductor 17, by filling a conductor into a through hole which penetrates the dielectric substrate 10 in the thickness direction thereof. The strip conductor 16*s* is connected to one end of the strip conductor of the antenna element A2 through the through-hole conductor 17.

Figure 33:
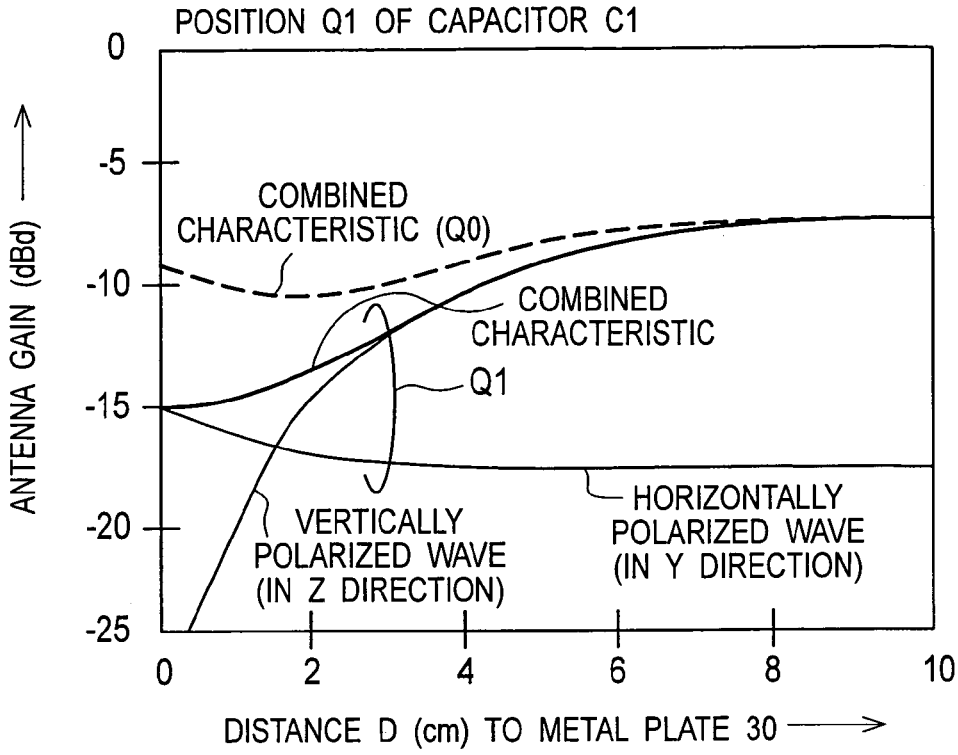
FIG. 33 is a graph showing an antenna gain of the antenna apparatus 108 shown in FIG. 31 relative to the distance D from the metal plate 30 to the antenna apparatus 108 when the capacitor C1 is connected to the end portion Q1 on the side of the feeding point Q of the antenna element A1.
Figure 34:
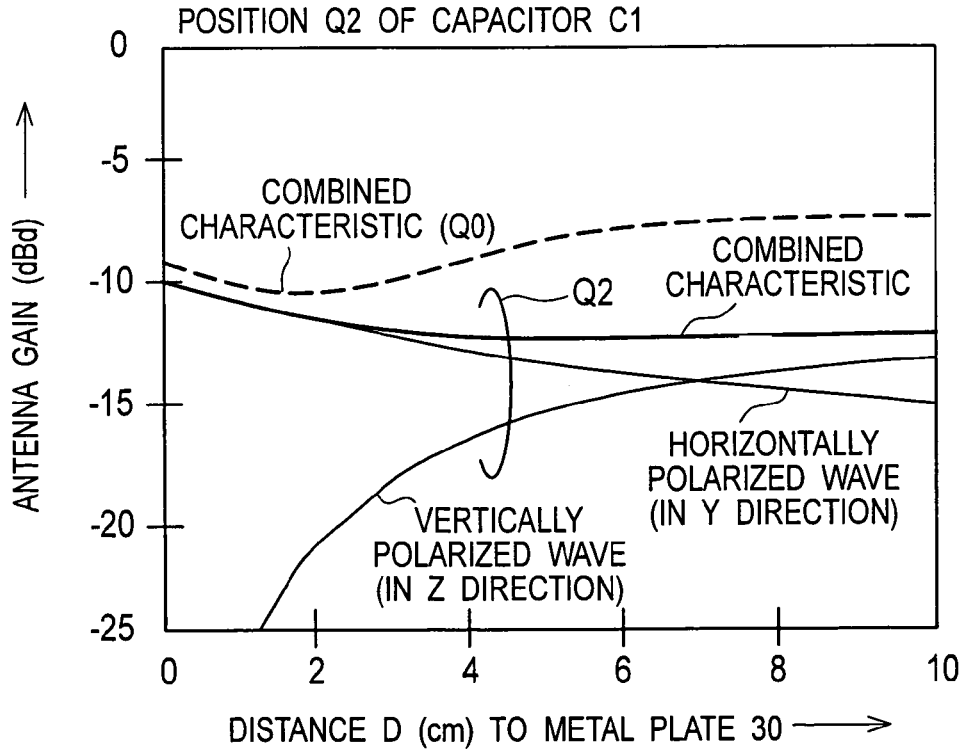
FIG. 34 is a graph showing an antenna gain of the antenna apparatus 108 shown in FIG. 31 relative to the distance D from the metal plate 30 to the antenna apparatus 108 when the capacitor C1 is connected to the end portion Q2 on the side of the loop antenna A3 of the antenna element A1.

(3) The capacitor C1 is connected to a substantially central point Q0 of the antenna element A1, and functions and advantageous effects of the capacitor C1 are described later in detail with reference to FIGS. 32 to 34.

According to the present preferred embodiment, the antenna elements A1 and A2 and the minute loop antenna A3 are formed using the respective strip conductors. Therefore, the antenna apparatus 107 can be produced with a higher dimensional accuracy using the printed wiring method, and exhibits the advantageous effects similar to those of the antenna apparatus 104 according to the fourth preferred embodiment shown in FIG. 26. However, the fundamental operation of the antenna apparatus 107 as an antenna apparatus is similar to that of the antenna apparatus 102 according to the second preferred embodiment shown in FIG. 2.

EIGHTH PREFERRED EMBODIMENT

Figure 31:
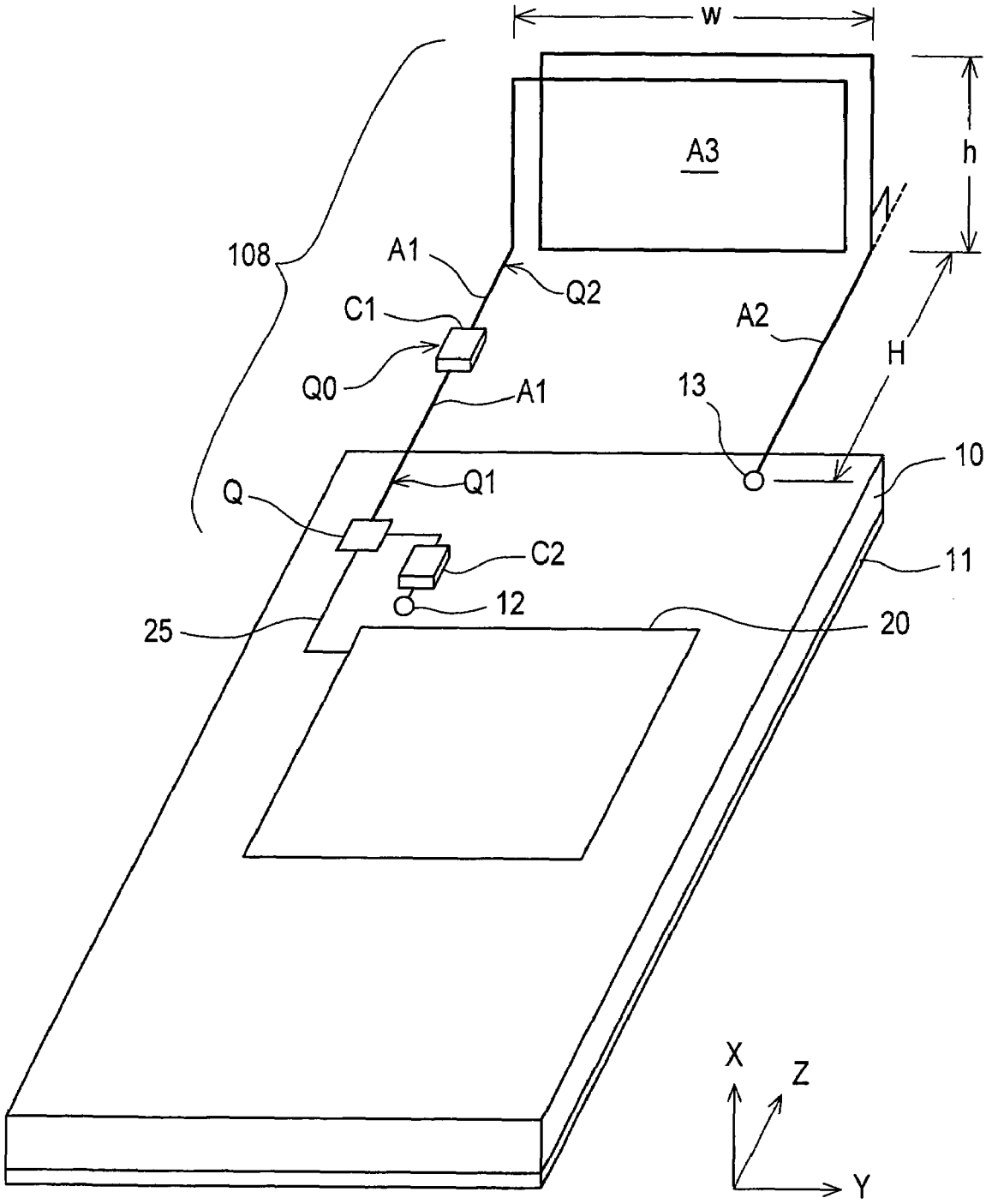
FIG. 31 is a perspective view showing a configuration of an antenna apparatus 108 according to an eighth preferred embodiment of the present invention.

FIG. 31 is a perspective view showing a configuration of an antenna apparatus 108 according to an eighth preferred embodiment of the present invention. Referring to FIG. 31, the antenna apparatus 108 according to the eighth preferred embodiment is characterized, as compared with the antenna apparatus 101 according to the first preferred embodiment shown in FIG. 1, in that a capacitor C1 is connected to a substantially central point Q0 of the antenna element A1. An optimum insertion position of the capacitor C1 on the antenna element A1 is described hereinafter.

Figure 32:
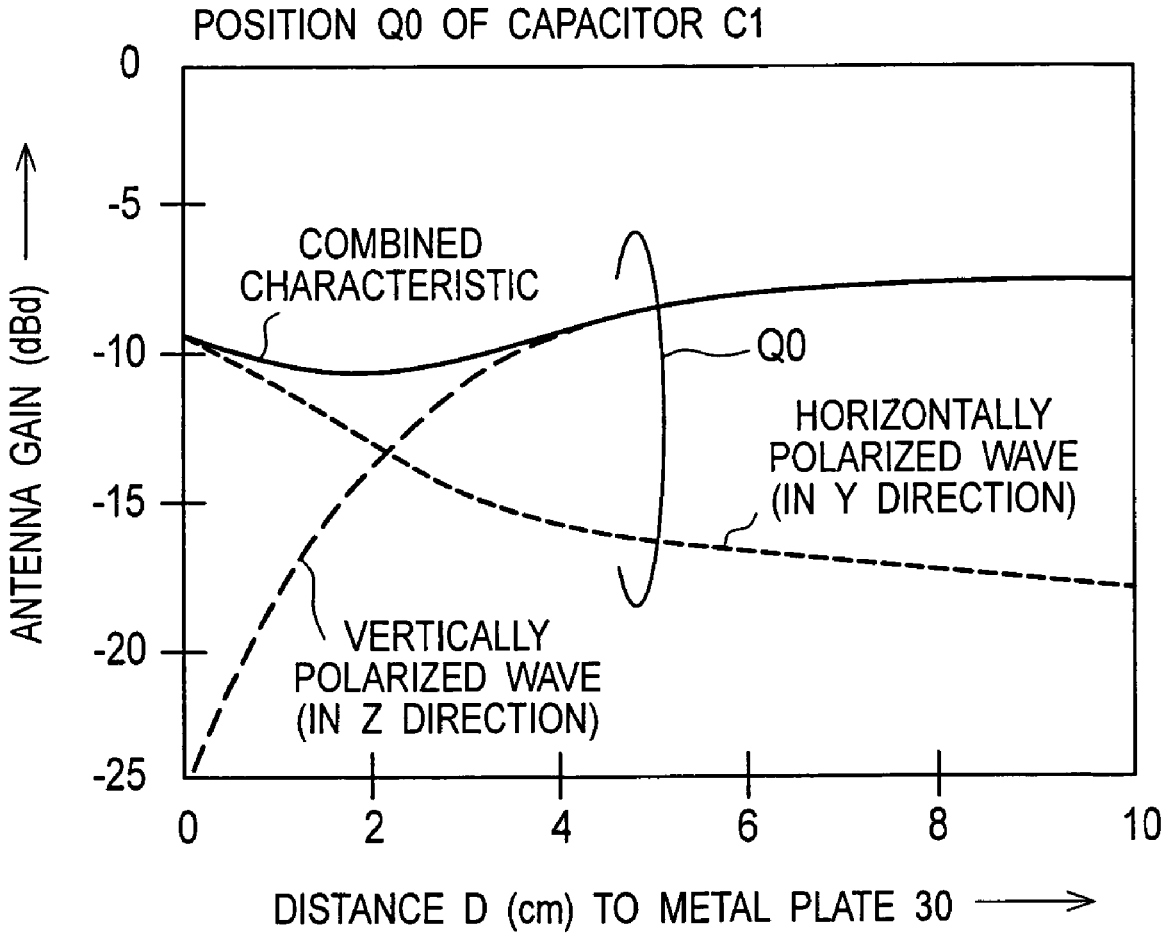
FIG. 32 is a graph showing an antenna gain of the antenna apparatus 108 shown in FIG. 31 relative to a distance D from a metal plate 30 to the antenna apparatus 108 when a capacitor C1 is connected to a central position Q0 of the antenna element A1.

FIG. 32 is a graph showing an antenna gain of the antenna apparatus 108 shown in FIG. 31 relative to a distance D from a metal plate 30 to the antenna apparatus 108 when the capacitor C1 is connected to the central position Q0 of the antenna element A1. FIG. 33 is a graph showing an antenna gain of the antenna apparatus 108 shown in FIG. 31 relative to the distance D from the metal plate 30 to the antenna apparatus 108 when the capacitor C1 is connected to the end portion Q1 on the side of the feeding point Q of the antenna element A1. FIG. 34 is a graph showing an antenna gain of the antenna apparatus 108 shown in FIG. 31 relative to the distance D from the metal plate 30 to the antenna apparatus 108 when the capacitor C1 is connected to the end portion Q2 on the side of the loop antenna A3 of the antenna element A1.

As is apparent from FIG. 32, when the capacitor C1 is connected to the central point Q0 of the antenna element A1, and the metal plate 30 is located apart from the antenna apparatus 108, the antenna apparatus 108 exhibits a radiation characteristic similar to that of a monopole antenna. When the capacitor C1 is connected to the central point Q0 of the antenna element A1 and the metal plate 30 is located closely to the antenna apparatus, the antenna apparatus 108 exhibits a radiation characteristic similar to that of a loop antenna of an ordinary magnetic ideal dipole (or magnetic current antenna). Therefore, the antenna apparatus 108 can always exhibit a favorable antenna gain characteristic independently of the distance D from the metal plate 30. Further, as shown in FIG. 33, when the capacitor C1 is connected near the feeding point Q, a horizontally polarized wave component is relatively small. As a result, when the metal plate 30 is located closely to the antenna apparatus, in particular, the antenna gain is lowered. As shown in FIG. 34, when the capacitor C1 is connected to one end on the side of the minute loop antenna A3, a vertically polarized wave component is relatively small. As a result, when the metal plate 30 is located apart from the antenna apparatus, the antenna gain is lowered. Accordingly, by inserting and connecting the capacitor C1 the position as located near the substantially central point Q0 of the antenna element A1, it is possible to establish a favorable antenna gain irrespectively of the position of the metal plate 30.

In the present preferred embodiment, the capacitor C1 is connected to be inserted into one of the central point Q0 of the antenna element A1, and otherwise it is connected to be inserted into one of the both end portions Q1 and Q2 of the antenna element A1. However, the present invention is not limited to this. The capacitor C1 may be inserted into any midway position of the antenna element A1. Alternatively, the capacitor C1 may be connected to be inserted into any position of either the antenna element A2 or the minute loop antenna A3. Further, the capacitor C1 may be divided into a plurality of capacitors and the divided capacitors may be connected to be inserted into a plurality of any positions of at least one of the antenna elements A1 and A2 and the minute loop antenna A3, respectively.

MODIFIED PREFERRED EMBODIMENTS OF FOURTH PREFERRED EMBODIMENT

Figure 35:
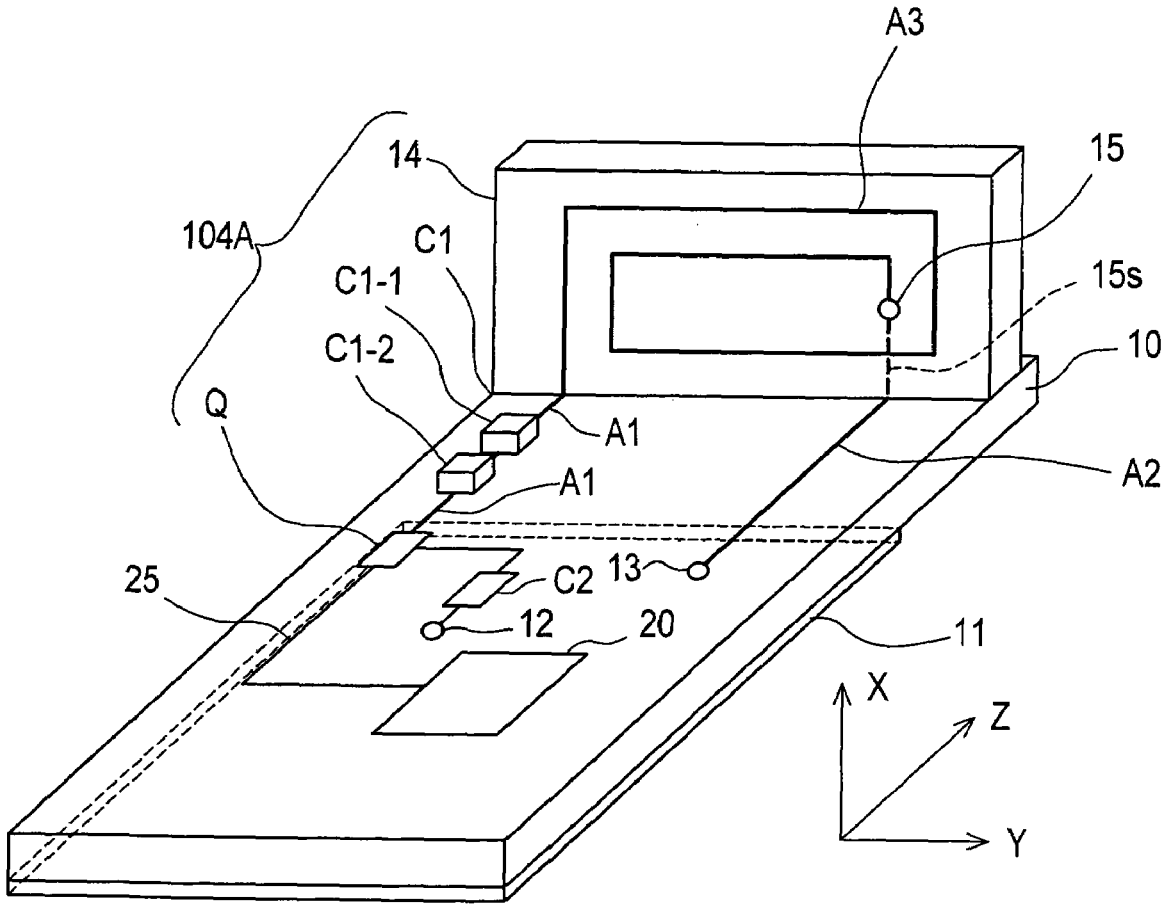
FIG. 35 is a perspective view showing a configuration of an antenna apparatus 104A according to a first modified preferred embodiment of the fourth preferred embodiment of the present invention.

FIG. 35 is a perspective view showing a configuration of an antenna apparatus 104A according to a first modified preferred embodiment of the fourth preferred embodiment of the present invention. Referring to FIG. 35, the antenna apparatus 104A according to the first modified preferred embodiment of the fourth preferred embodiment is characterized, as compared with the antenna apparatus 104 according to the fourth preferred embodiment shown in FIG. 26, in that two capacitors C1-1 and C1-2 as connected in series are connected to the antenna element A1 in place of the capacitor C1 shown in FIG. 26. By thus constituting, it is possible to reduce the variation upon manufacturing in the resonance frequency of the antenna apparatus 104A as described below.

The antenna apparatus 104A according to the present preferred embodiment uses the capacitors C1-1 and C1-2 each having a relatively small capacitance of a value such as 1 pF. As for a commercially available high-accuracy ceramic stacked chip capacitor having a capacitance of 0.5 pF to 10 pF, the capacitance error is specified not by a ratio but by an absolute value. For example, a capacitor having a capacitance of 1 pF has a capacitance error of ±0.1 pF. This corresponds to a capacitance variation of ±10%. When the capacitance variation is 10%, the resonance frequency of the antenna apparatus 104A varies in a range of ±4.9%. In the antenna apparatus 104A according to the present preferred embodiment, the fractional band width in which VSWR<2 is satisfied is about 10%. As a result, a manufacturing margin is hardly present. Therefore, in the present preferred embodiment, the combined capacitance of 1 pF is obtained by connecting in series the two capacitors C1-1 and C1-2 each having a capacitance of a value such as 2 pF. Since the capacitance error of each of the two-pF capacitors C1-1 and C1-2 is ±0.1 pF, the combined capacitance error is ±5%, and this leads to suppressing the variation in the resonance frequency into ±2.5%. Consequently, the manufacturing yield can be improved even if the resonance frequency is not adjusted during manufacturing.

In the present preferred embodiment, the two capacitors C1-1 and C1-2 are directly connected to each other. However, the present invention is not limited to this. A plurality of capacitors may be connected in series.

Figure 36:
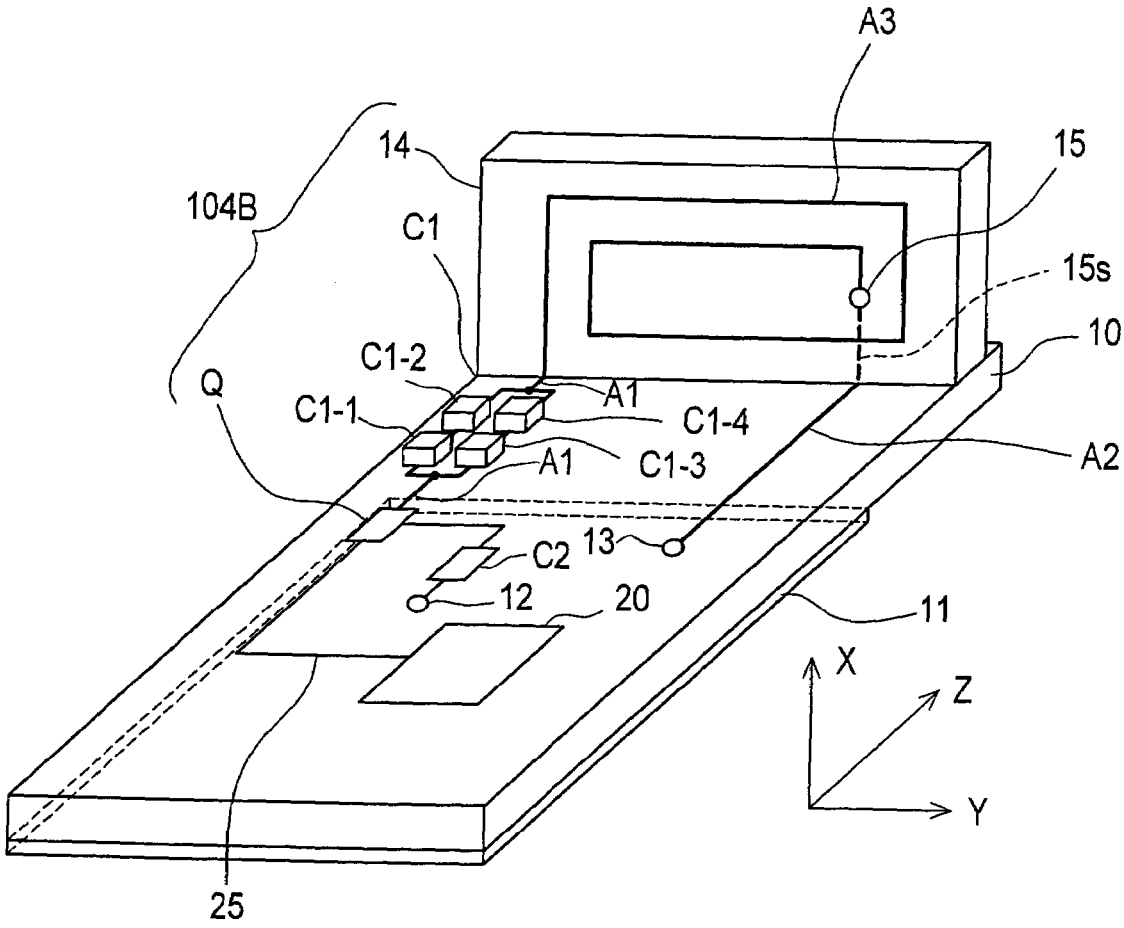
FIG. 36 is a perspective view showing a configuration of an antenna apparatus 104B according to a second modified preferred embodiment of the fourth preferred embodiment of the present invention.

FIG. 36 is a perspective view showing a configuration of an antenna apparatus 104B according to a second modified preferred embodiment of the fourth preferred embodiment of the present invention. Referring to FIG. 36, the antenna apparatus 104B according to the second modified preferred embodiment of the fourth preferred embodiment is characterized, as compared with the antenna apparatus 104 according to the fourth preferred embodiment shown in FIG. 26, in that two capacitors C1-1 and C1-2 as connected in series and two capacitors C1-3 and C1-4 as connected in series are connected in parallel to each other, respectively, and this parallel element circuit is connected to an antenna element A1 in place of the capacitor C1 shown in FIG. 26. By thus constituting, it is possible to reduce the variation upon manufacturing in the resonance frequency of the antenna apparatus 104B, and reduce the loss of the high-frequency signal as caused by the capacitor as described below.

When two capacitors are connected in series, two high-frequency resistance components of capacitor parts are connected in series. As a result, the loss is increased and the antenna gain is reduced in some cases. Therefore, in the present preferred embodiment, four capacitors C1-1 to C1-4 each having a capacitance of a value such as 1 pF, and two pairs of the capacitors of them are connected in series and the two pairs are connected in parallel to each other. Provided that a high-frequency resistance component of each of the capacitors C1-1 to C1-4 is one Ω, the combined resistance obtained when the two capacitors are connected in series is two Ω. The combined resistance as obtained when the four capacitors are connected is one Ω. Accordingly, the loss of the high-frequency signal when the four capacitors are connected is half the loss when the two capacitors are connected in series.

The capacitance error will be next considered. When the two capacitors each having a capacitance of a value such as 2±0.1 pF are connected in series, the capacitance variation is ±5%. When the four capacitors each having a capacitance of 1±0.1 pF are connected by the above-mentioned configuration, the capacitance variation is ±10%, which appears to be greater than that in such a case of connecting the two capacitors in series. However, actually, the variations of the respective capacitors C1-1 to C1-4 form a distribution similar to a normal distribution around the central value thereof, and the respective variations have no correlation to each other. Therefore, the width of the variation when the four capacitors are connected is in a range within about ±5%, which is substantially similar to that when the two capacitors are connected. In other words, with the four-capacitor configuration, while suppressing the capacitance variation to be substantially equivalent to that of the two-capacitor configuration, a loss component can be suppressed to be half of that of the two-capacitor configuration.

In the present preferred embodiment, two pairs of capacitors connected in series are connected in parallel. However, the present invention is not limited to this. A plurality of pairs of capacitors connected in series may be connected in parallel to each other.

NINTH PREFERRED EMBODIMENT

Figure 37:
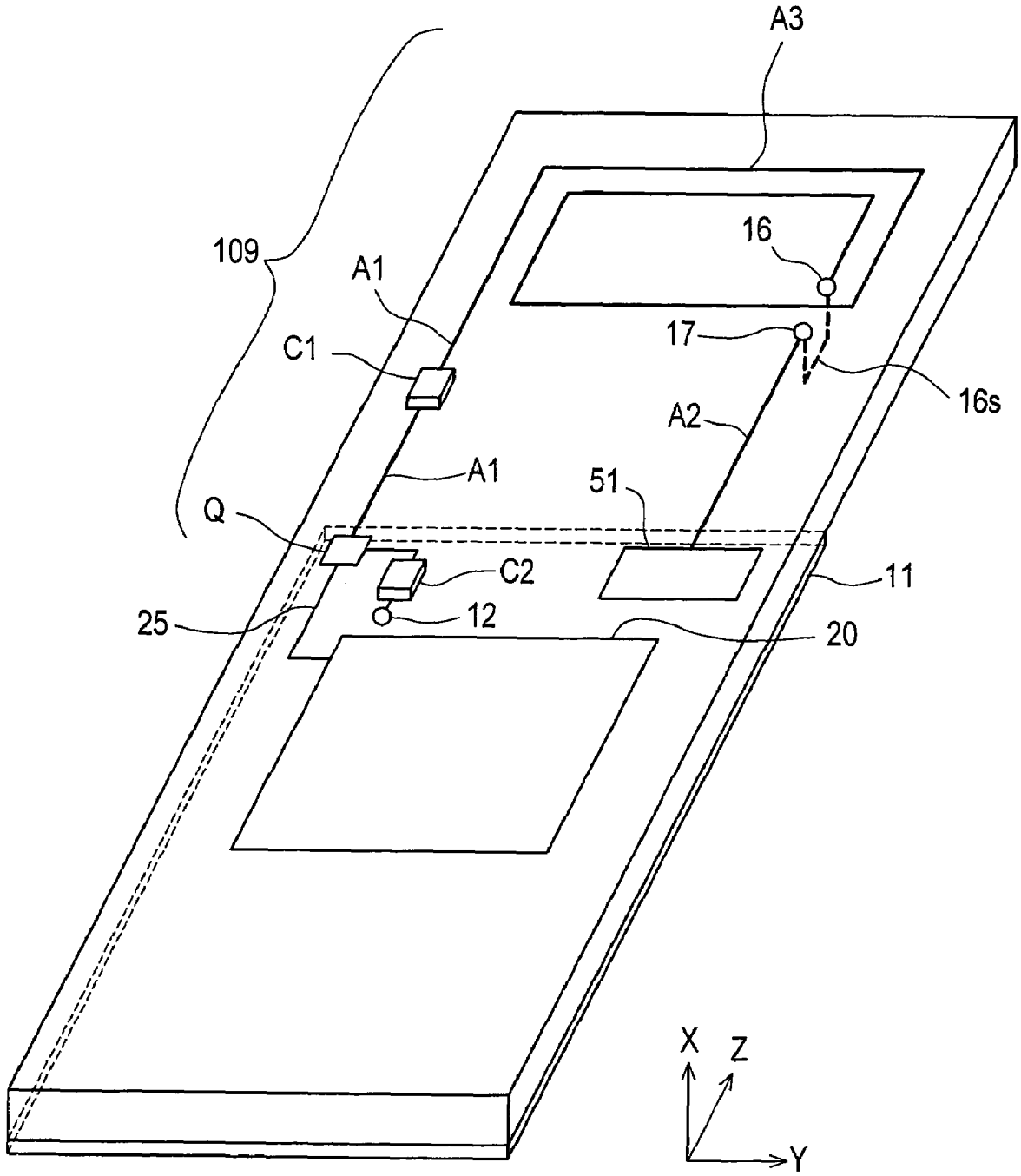
FIG. 37 is a perspective view of a configuration of an antenna apparatus 109 according to a ninth preferred embodiment of the present invention.

FIG. 37 is a perspective view of a configuration of an antenna apparatus 109 according to a ninth preferred embodiment of the present invention.

Referring to FIG. 37, the antenna apparatus 109 according to the ninth preferred embodiment is characterized, as compared with the antenna apparatus 107 according to the seventh preferred embodiment shown in FIG. 30, in that a frequency switching circuit 51 is connected to the one end on the side of the ground of the antenna element A2. The detail of the frequency switching circuit 51 is described later with reference to FIGS. 41 to 44.

TENTH PREFERRED EMBODIMENT

Figure 38:
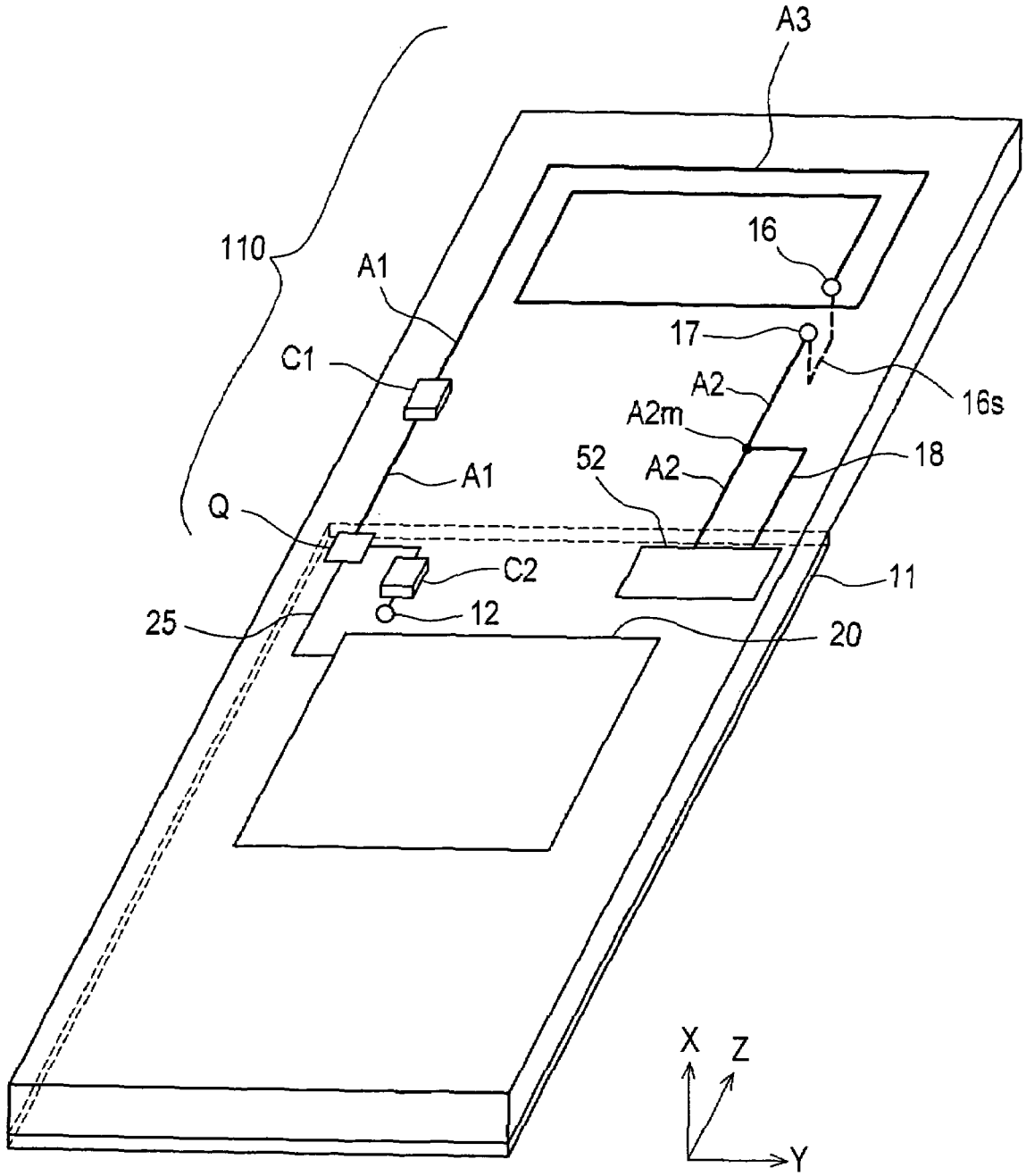
FIG. 38 is a perspective view of a configuration of an antenna apparatus 110 according to a tenth preferred embodiment of the present invention.

FIG. 38 is a perspective view of a configuration of an antenna apparatus 110 according to a tenth preferred embodiment of the present invention.

Referring to FIG. 38, the antenna apparatus 110 according to the tenth preferred embodiment is characterized, as compared with the antenna apparatus 107 according to the seventh preferred embodiment shown in FIG. 30, in that a frequency switching circuit 52 is connected to the one end on the side of ground of the antenna element A2 and to a substantially central point A2*m* of the antenna element A2. The detail of the frequency switching circuit 52 is described later with reference to FIGS. 45 to 50.

ELEVENTH PREFERRED EMBODIMENT

Figure 39:
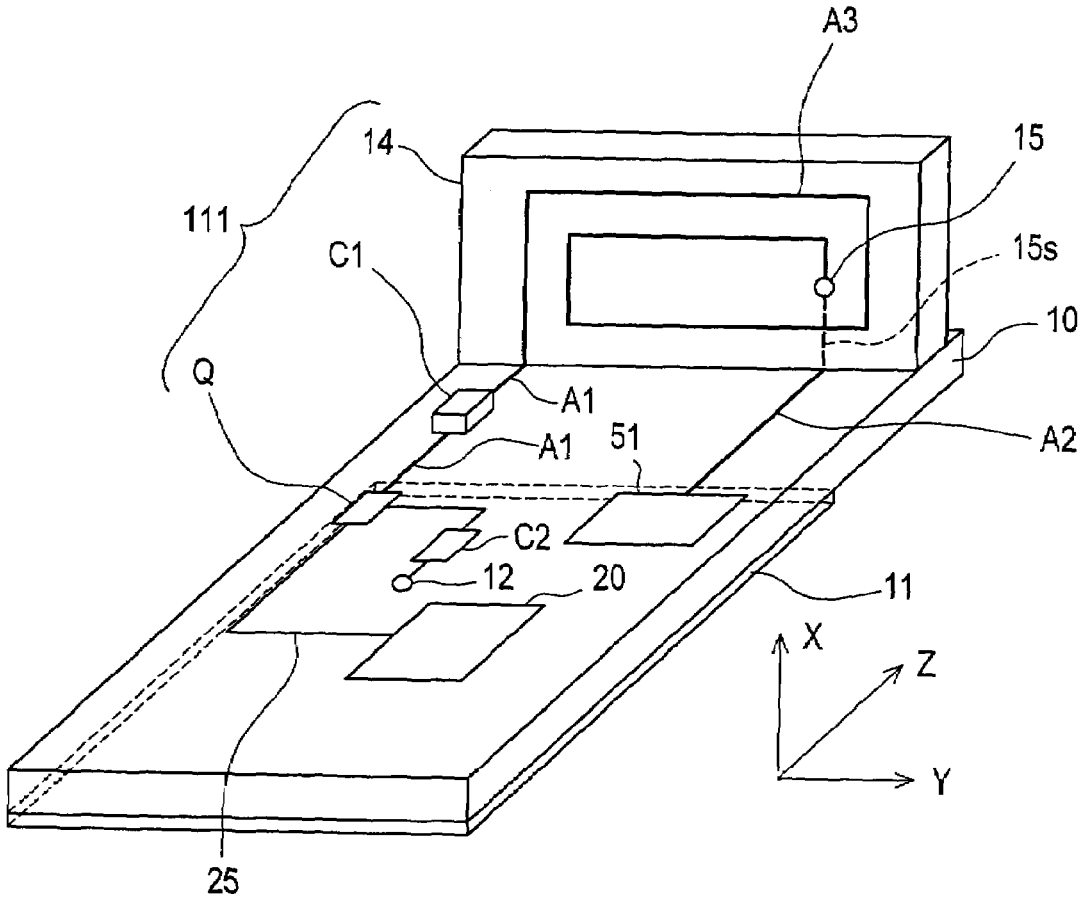
FIG. 39 is a perspective view of a configuration of an antenna apparatus 111 according to an eleventh preferred embodiment of the present invention.

FIG. 39 is a perspective view of a configuration of an antenna apparatus 111 according to an eleventh preferred embodiment of the present invention.

Referring to FIG. 39, the antenna apparatus 110 according to the eleventh preferred embodiment is characterized, as compared with the antenna apparatus 104 according to the fourth preferred embodiment shown in FIG. 26, in that a frequency switching circuit 51 is connected to the one end on the ground side of the antenna element A2. The detail of the frequency switching circuit 51 is described later with reference to FIGS. 41 to 44.

TWELFTH PREFERRED EMBODIMENT

Figure 40:
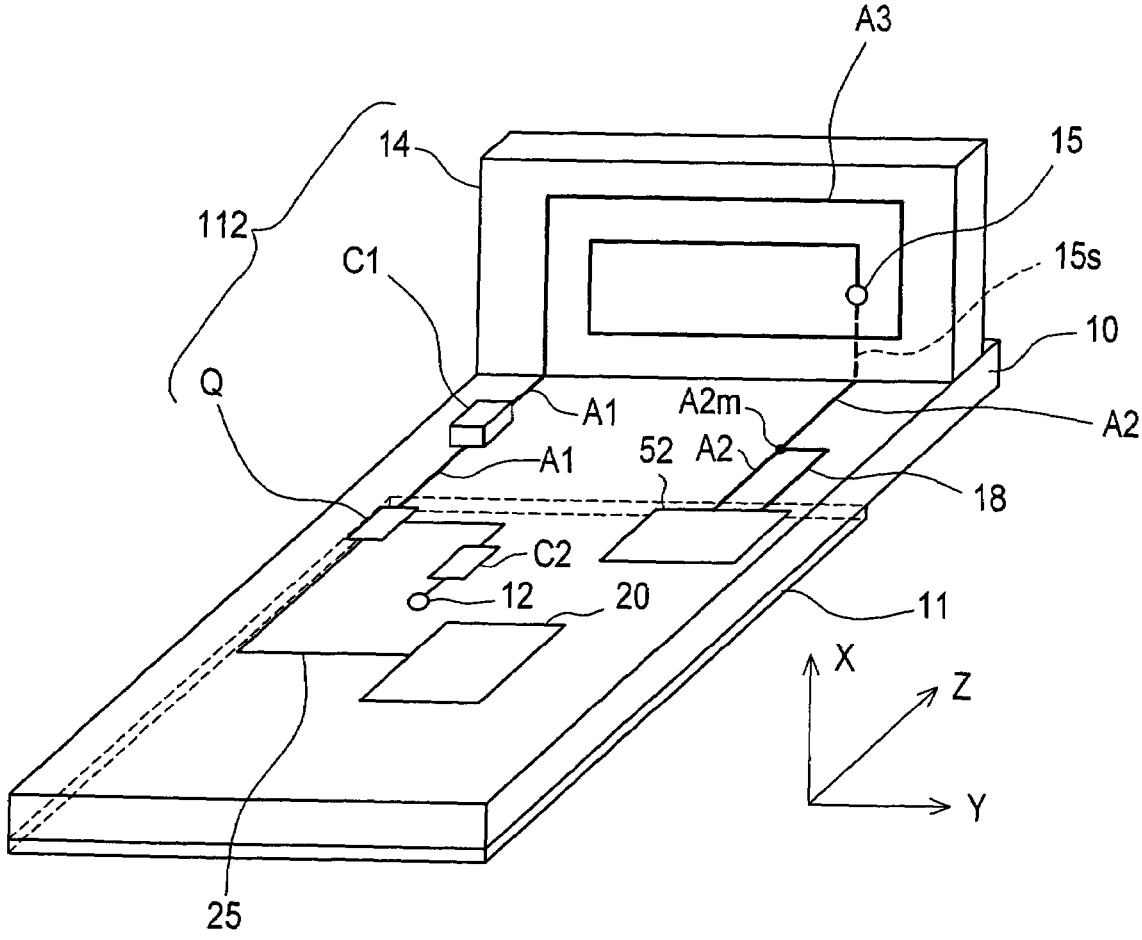
FIG. 40 is a perspective view of a configuration of an antenna apparatus 112 according to a twelfth preferred embodiment of the present invention.

FIG. 40 is a perspective view of a configuration of an antenna apparatus 112 according to a twelfth preferred embodiment of the present invention.

Referring to FIG. 40, the antenna apparatus 112 according to the twelfth preferred embodiment is characterized, as compared with the antenna apparatus 104 according to the fourth preferred embodiment shown in FIG. 26, in that a frequency switching circuit 52 is connected to the one end on the ground side of the antenna element A2 and to a substantially central point A2*m* of the antenna element A2. The detail of the frequency switching circuit 51 is described later with reference to FIGS. 45 to 50.

IMPLEMENTAL EXAMPLES OF FREQUENCY SWITCHING CIRCUIT

Figure 41:
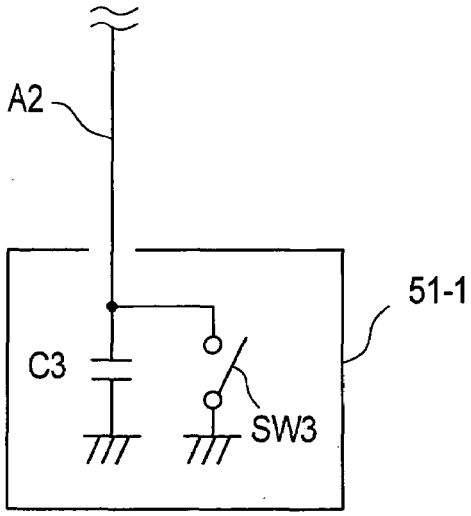
FIG. 41 is a circuit diagram showing an electric circuit of a first implemental example 51-1 of a frequency switching circuit 51 for use in each of the antenna apparatuses 109 and 111 shown in FIGS. 37 and 39, respectively.

FIG. 41 is a circuit diagram showing an electric circuit of a first implemental example 51-1 of the frequency switching circuit 51 in each of the antenna apparatuses 109 and 111 shown in FIGS. 37 and 39, respectively.

Referring to FIG. 41, the one end on the ground side of the antenna element. A2 is grounded through a capacitor C3 to be grounded through a switch SW3. If the capacitance of the capacitor C1 connected to the antenna element A1 has a value such as about 10 pF, that of the capacitor C3 has a value such as about 1 pF, the combined capacitance of the capacitors C1 and C3 when the switch SW3 is turned off is smaller than the capacitance of the capacitor C3. Due to this, when the switch SW3 is turned on, the resonance frequency of the antenna apparatus can be lowered by, for example, about 5%. In other words, by turning on and off the switch SW3, the resonance frequency of the antenna apparatus can be selectively switched over.

Figure 42:
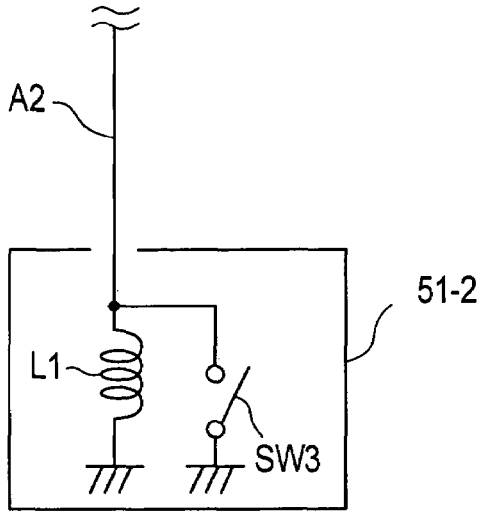
FIG. 42 is a circuit diagram showing an electric circuit of a second implemental example 51-2 of the frequency switching circuit 51 for use in each of the antenna apparatuses 109 and 111 shown in FIGS. 37 and 39, respectively.

FIG. 42 is a circuit diagram showing an electric circuit of a second implemental example 51-2 of the frequency switching circuit 51 in each of the antenna apparatuses 109 and 111 shown in FIGS. 37 and 39, respectively.

Referring to FIG. 42, an inductor L1 is used in place of the capacitor C3 shown in FIG. 41. A reactance element is inserted in each of the circuits shown in FIGS. 41 and 42. In the present implemental example, by turning on the switch SW3 and shorting the inductor L1, the inductance of the antenna apparatus is decreased, and therefore, the resonance frequency of the antenna apparatus can be increased. For example, when the inductance of the inductor L1 is set to 10% of that of the minute loop antenna A3, the resonance frequency can be changed by about 5% by switching over the switch SW3.

Figure 43:
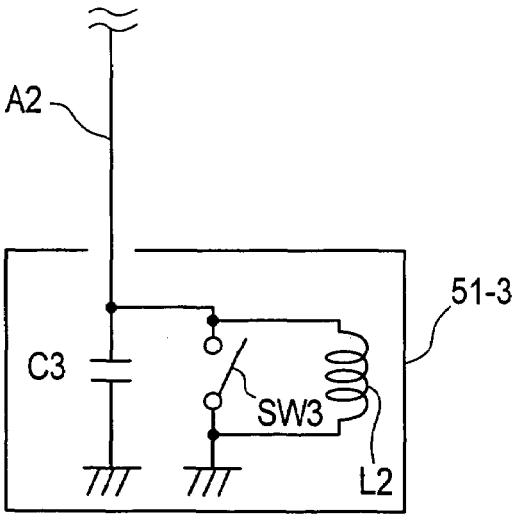
FIG. 43 is a circuit diagram showing an electric circuit of a third implemental example 51-3 of the frequency switching circuit 51 for use in each of the antenna apparatuses 109 and 111 shown in FIGS. 37 and 39, respectively.

FIG. 43 is a circuit diagram showing an electric circuit of a third implemental example 51-3 of the frequency switching circuit 51 in each of the antenna apparatuses 109 and 111 shown in FIGS. 37 and 39, respectively.

Referring to FIG. 43, the electric circuit 51-3 is characterized, as compared with the circuit shown in FIG. 41, in that an inductor L2 is connected in parallel to a switch SW3. The inductance of the inductor L2 is preferably set to cancel a parasitic capacitance of the switch SW3 by parallel resonance when the switch SW3 is turned off, and the switch SW3 is constituted by a high-frequency semiconductor diode. In the present implemental example, the parasitic capacitance of the switch SW3 has a value such as about 2 pF, so that the inductance of the inductor L2 is set to about 68 nH. By setting the same as mentioned above, the influence of the parasitic capacitance of the switch SW3 can be cancelled in a band such as a 429 MHz band. Consequently, such a problem can be solved that the resonance frequency is deviated from a designed value due to the parasitic capacitance of the switch SW3 when the switch SW3 is turned off.

Figure 44:
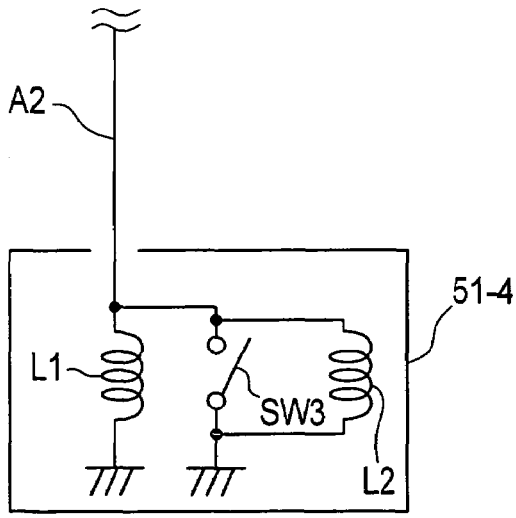
FIG. 44 is a circuit diagram showing an electric circuit of a fourth implemental example 51-4 of the frequency switching circuit 51 for use in each of the antenna apparatuses 109 and 111 shown in FIGS. 37 and 39, respectively.

FIG. 44 is a circuit diagram showing an electric circuit of a fourth implemental example 51-4 of the frequency switching circuit 51 in each of the antenna apparatuses 109 and 111 shown in FIGS. 37 and 39, respectively. The electric circuit shown in FIG. 44 is characterized by adding an inductor L2 to the circuit shown in FIG. 42, and has functions and advantageous effects similar to those of the third implemental example 51-3 .

Figure 45:
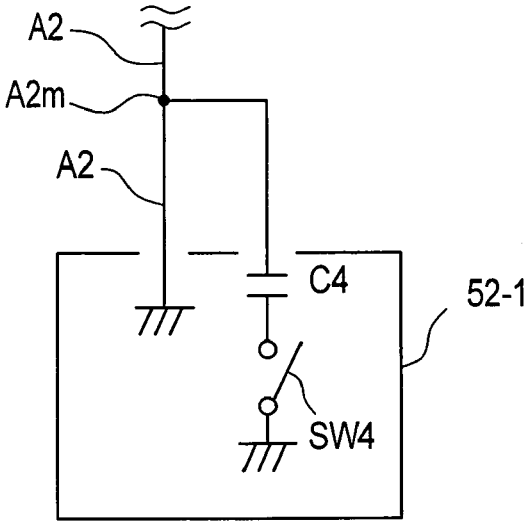
FIG. 45 is a circuit diagram showing an electric circuit of a first implemental example 52-1 of a frequency switching circuit 52 for use in the antenna apparatuses 110 and 112 shown in FIGS. 38 and 40, respectively.

FIG. 45 is a circuit diagram showing an electric circuit of a first implemental example 52-1 of the frequency switching circuit 52 in each of the antenna apparatuses 110 and 112 shown in FIGS. 38 and 40, respectively. Referring to FIG. 45, one end of the antenna element A2 is grounded, and the substantially central point A2*m* of the antenna element A2 is grounded through a capacitor C4 and a switch SW4. The antenna element A2 contains a high-frequency inductance component. When the switch SW4 is turned on, the resonance frequency of the antenna apparatus is changed. The direction of the frequency change varies depending on the capacitance of the capacitor C4.

In a prototype antenna apparatus produced by the inventors of the present invention, when the capacitance of the capacitor C1 has a value of about 1 pF and that of the capacitance C4 has a value of about 10 pF, and the resonance frequency of the antenna apparatus is switched over between 429 MHz and 426 MHz. When the switch SW4 is turned on, the resonance frequency is heightened. This is because the central point A2*m* of the antenna element A2 is shorted to be grounded by the capacitor C4, and therefore, the inductance of the minute loop antenna A3 is substantially reduced.

In this case, by appropriately selecting the position or location of the contact A2*m* of the antenna element A2 and the capacitance of the capacitor C4, the change amount in the resonance frequency when the switch SW4 is turned on can be adjusted. In other words, when the connection point A2*m* of the antenna element A2 is arranged at a position as located apart from the minute loop antenna A3 (that is, at a position close to the ground), the inductance component of the antenna apparatus is increased. Further, when the capacitance of the capacitor C4 is increased, the resonance frequency is greatly changed when the switch SW4 is turned on.

Figure 46:
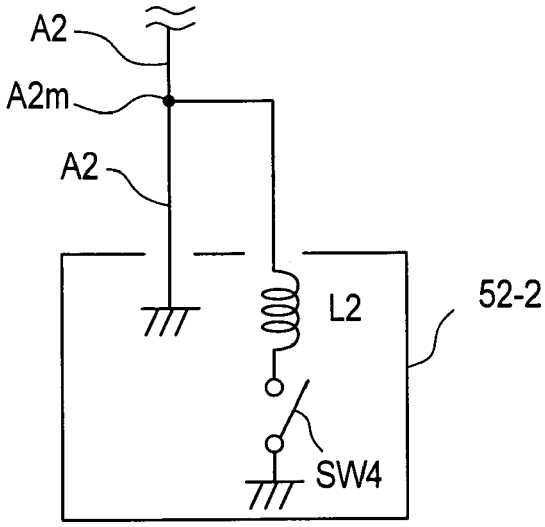
FIG. 46 is a circuit diagram showing an electric circuit of a second implemental example 52-2 of the frequency switching circuit 52 for use in the antenna apparatuses 110 and 112 shown in FIGS. 38 and 40, respectively.

FIG. 46 is a circuit diagram showing an electric circuit of a second implemental example 52-2 of the frequency switching circuit 52 in each of the antenna apparatuses 110 and 112 shown in FIGS. 38 and 40, respectively.

Referring to FIG. 46, the electric circuit is characterized by connecting an inductor L2 in place of the capacitor C4 shown in FIG. 45. A reactance element is inserted in each of the circuits shown in FIGS. 45 and 46. The present implemental example shows that the antenna element A2 contains a high-frequency inductance component and that when the switch SW4 is turned on, the resonance frequency is increased. This is because the inductor L2 is connected in parallel to the inductance component of the antenna element A2, and the combined inductance of the inductance component when the switch SW4 is turned on and the inductance of the inductor L2 is lower than the inductance of the inductance component when the switch. SW4 is turned off.

By selecting the inductance of the inductor L2 of about ten times as large as that of the inductor component, it is possible to slightly change the resonance frequency.

Figure 47:
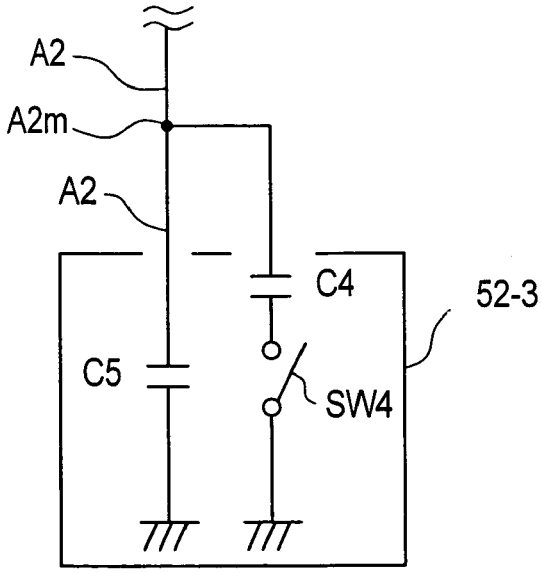
FIG. 47 is a circuit diagram showing en electric circuit of a third implemental example 52-3 of the frequency switching circuit 52 in each of the antenna apparatuses 110 and 112 shown in FIGS. 38 and 40, respectively.

FIG. 47 is a circuit diagram showing an electric circuit of a third implemental example 52-3 of the frequency switching circuit 52 in each of the antenna apparatuses 110 and 112 shown in FIGS. 38 and 40, respectively. Referring to FIG. 47, the electric circuit is characterized by grounding the one end on the ground side of the antenna element A2 in the circuit shown in FIG. 45 through a capacitor C5. In the present implemental example, the resonance frequency when the switch SW4 is turned off is determined by the inductances of the antenna elements A1 and A2, the capacities of the capacitors C1 and C5, and the inductance of the minute loop antenna A3. The resonance frequency when the switch SW4 is turned on is determined by the capacitance of the capacitor C4 as well as the above-mentioned conditions. By turning on and off the switch SW4, the resonance frequency of the antenna apparatus can be changed.

Figure 48:
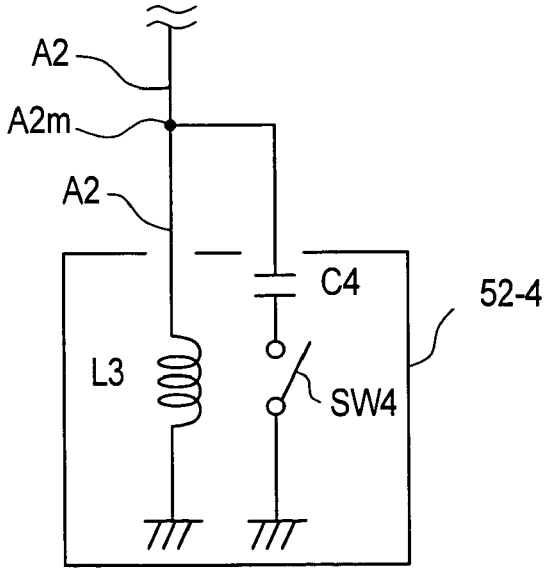
FIG. 48 is a circuit diagram showing en electric circuit of a fourth implemental example 52-4 of the frequency switching circuit 52 in each of the antenna apparatuses 110 and 112 shown in FIGS. 38 and 40, respectively.

FIG. 48 is a circuit diagram showing en electric circuit of a fourth implemental example 52-4 of the frequency switching circuit 52 in each of the antenna apparatuses 110 and 112 shown in FIGS. 38 and 40, respectively. Referring to FIG. 48, the electric circuit is characterized by grounding the one end on the ground side of the antenna element A2 in the circuit shown in FIG. 46 through an inductor L3. A reactance element is inserted in each of the circuits shown in FIGS. 47 and 48. In the present implemental example, the resonance frequency when the switch SW4 is turned off is determined by the inductances of the antenna elements A1 and A2, the capacitance of the capacitor C1, the inductance of the inductor L3, and the inductance of the minute loop antenna A3. The resonance frequency when the switch SW4 is turned on is determined by the capacitance of the capacitor C4 as well as the above-mentioned conditions. By turning on and off the switch SW4, the resonance frequency of the antenna apparatus can be changed.

Figure 49:
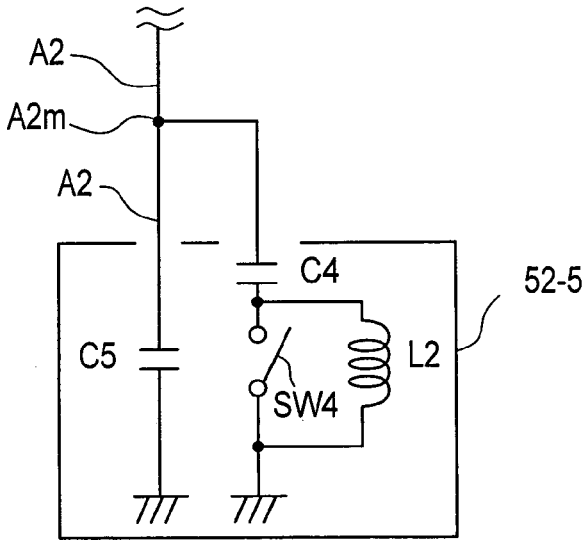
FIG. 49 is a circuit diagram showing en electric circuit of a fifth implemental example 52-5 of the frequency switching circuit 52 in each of the antenna apparatuses 110 and 112 shown in FIGS. 38 and 40, respectively.

FIG. 49 is a circuit diagram showing en electric circuit of a fifth implemental example 52-5 of the frequency switching circuit 52 in each of the antenna apparatuses 110 and 112 shown in FIGS. 38 and 40, respectively. Referring to FIG. 49, the electric circuit is characterized by connecting an inductance L2 in parallel to the switch SW4 in the circuit shown in FIG. 47. The inductance of the inductor L2 is preferably set to cancel the parasitic capacitance of the switch SW4 by parallel resonance when the switch SW4 is turned off and the switch SW4 is constituted by a high-frequency semiconductor diode. In the present implemental example, the parasitic capacitance of the switch SW4 has a value such as about 2 pF, so that the inductance of the inductor L2 is set to about 68 nH. By setting the same as mentioned above, the influence of the parasitic capacitance of the switch SW4 can be cancelled in a band such as a 429 MHz band. Consequently, such a problem can be solved that the resonance frequency is deviated from a designed value due to the parasitic capacitance of the switch SW4 when the switch SW4 is turned off.

Figure 50:
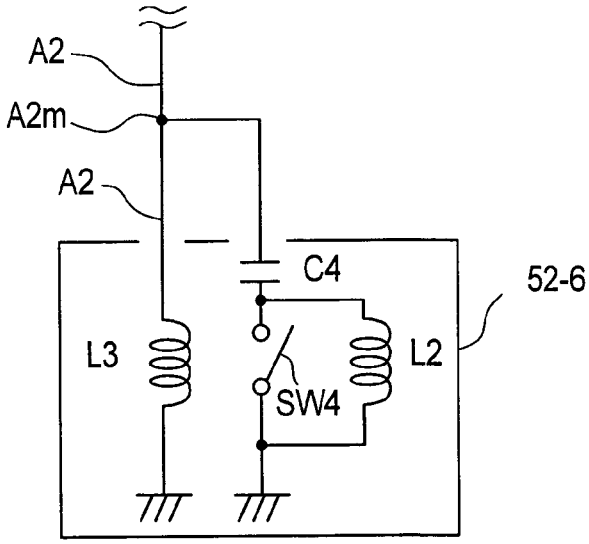
FIG. 50 is a circuit diagram showing en electric circuit of a sixth implemental example 52-6 of the frequency switching circuit 52 in each of the antenna apparatuses 110 and 112 shown in FIGS. 38 and 40, respectively.

FIG. 50 is a circuit diagram showing en electric circuit of a sixth implemental example 52-6 of the frequency switching circuit 52 in each of the antenna apparatuses 110 and 112 shown in FIGS. 38 and 40, respectively. Referring to FIG. 50, the electric circuit is characterized by connecting an inductor L2 in parallel to the switch SW4 in the circuit, shown in FIG. 48. In this case, the influence of the parasitic capacitance of the switch SW4 when the switch SW4 is turned off can be substantially cancelled in a manner similar to that of the implemental example of FIG. 49.

In each of the circuits shown in FIGS. 45 and 46, the inductor L2 may be connected in parallel to the switch SW4 so as to cancel the influence of the parasitic capacitance of the switch SW4 when the switch SW4 is turned off.

The frequency switching circuit 51 or 52 according to the above-mentioned preferred embodiments is employed so as to enlarge a frequency band to be used. Alternatively, the frequency switching circuit 51 or 52 may be employed for the purpose of frequency adjustment so that the resonance frequency is matched with a desirable frequency.

In the above-mentioned preferred embodiments, the frequency switching circuit 51 is inserted between the antenna element A2 and the ground. However, the present invention is not limited to this. The frequency switching circuit 51 may be connected to at least one of the minute loop antenna A3 and the antenna elements A1 and A2, and the switch SW3 for shorting in parallel the additionally inserted reactance element may be connected.

In the above-mentioned preferred embodiments, the connection point of the frequency switching circuit 52 to which the reactance element is connected is the central point A2*m* of the antenna element A2 or the end portion on the ground side of the antenna element A2. However, the present invention is not limited to this. The reactance element may be connected to at least one of the minute loop antenna A3 and the antenna elements A1 and A2, and the switch SW4 for grounding and shorting the additionally inserted reactance element may be connected.

THIETEENTH PREFERRED EMBODIMENT

Figure 51:
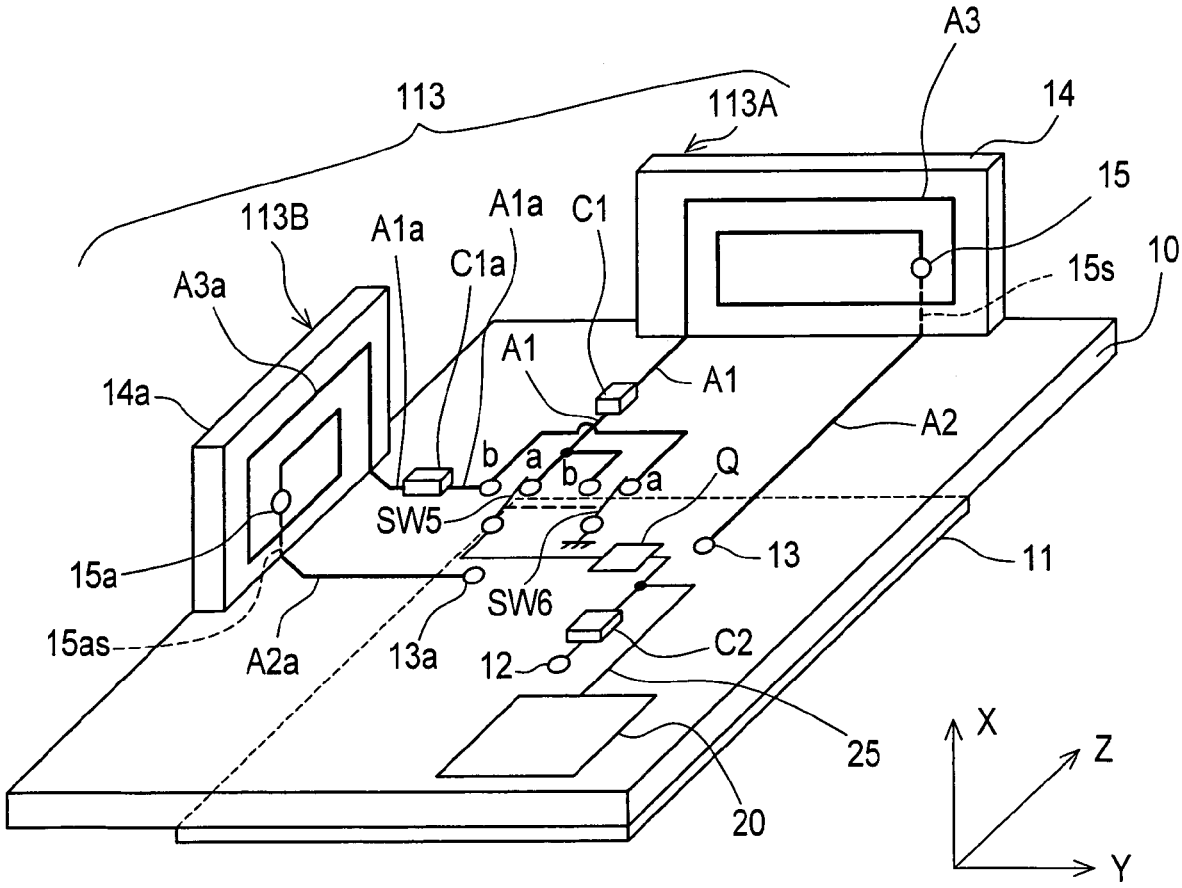
FIG. 51 is a perspective view showing a configuration of an antenna apparatus 113 according to a thirteenth preferred embodiment of the present invention.

FIG. 51 is a perspective view showing a configuration of an antenna apparatus 113 according to a thirteenth preferred embodiment of the present invention. The antenna apparatus 113 according to the thirteenth preferred embodiment differs from the antenna apparatus 104 according to the fourth preferred embodiment shown in FIG. 26 in the following respects.

(1) Antenna elements A1*a* and A2*a*, which are made of substantially linear copper foil strip conductors, respectively, are formed on the front surface of the left inner part of the dielectric substrate 10 so as to be perpendicular to antenna elements A1 and A2 using the printed wiring method. It is noted that the grounding conductor 11 is not formed on the rear surface of the left inner-part portion of the dielectric substrate 10 on which the antenna elements A1*a* and A2*a* are formed. Further, the end portion on the ground side of the antenna element A2*a* is connected to the grounding conductor 11 through a through-hole conductor 13*a* filled into a through hole which penetrates in the thickness direction of the dielectric substrate 10, so as to be grounded.

(2) In the left inner-part portion of the dielectric substrate 10 in the longitudinal direction thereof, a dielectric substrate 14*a* having the same width as that of the dielectric substrate 14 is provided to stand so as to perpendicular to dielectric substrates 10 and 14. The width direction of the dielectric substrate 14*a* is parallel to the longitudinal direction of the dielectric substrate 10.

(3) A minute loop antenna A3*a* is constituted by forming a copper foil strip conductor on the dielectric substrate 14*a* by the printed wiring method. At the end portion as located on the ground side of the minute loop antenna A3*a*, a through-hole conductor 15*a* is formed by filling a conductor into a through hole which penetrates the dielectric substrate 14*a* in the thickness direction thereof. The end portion as located near the ground side of the minute loop antenna A3*a* is connected to the antenna element A2*a* through the through-hole conductor 15*a* and a strip conductor 15 as formed on the rear surface of the dielectric substrate 14*a*.

(4) A capacitor C1*a* is connected not to near the feeding point Q but, preferably and generally to the central point of the antenna element A1*a* as shown in FIG. 51.

(5) The end portion on the side of the feeding point Q of the antenna element A1 is connected to a contact "a" of a switch SW5 and a contact "b" of a switch SW6, and the end portion on the side of the feeding point Q of the antenna element Ala is connected to a contact "b" of the switch SW5 and contact "a" of the switch SW6. The common terminal of the switch SW5 is connected to the feeding point Q, and the common terminal of the switch SW6 is grounded. These switches SW5 and SW6 are sequentially controlled by a controller 24 of FIG. 1, which is provided in, for example, a radio communication circuit 20.

The antenna apparatus 113 as thus constituted includes two antennas 113A and 113B which include the minute loop antennas A3 and A3*a* having loop axis directions perpendicular to each other, and the antenna elements A1 and A2 and the antenna elements A1*a* and A2*a* perpendicular to each other, respectively. When the level of the radio signal received by, for example, the antenna 113A is larger than that of the radio signal received by the antenna 113B, the controller 24 (See FIG. 1) switches the switch SW5 to the contact "a" thereof, and switches the switch SW6 to the contact "b" thereof. In the opposite case, the controller 24 switches the switch SW5 to the contact "b" thereof, and switches the switch SW6 to the contact "a" thereof. In this case, the antenna having a larger receiving level is selected and the selected antenna is connected to the radio communication circuit 20 (where the selected antenna is referred to as "an antenna in use" hereinafter). In addition, the unused antenna which is not connected to the radio communication circuit 20 is grounded. By grounding the unused antenna, it is possible to prevent the operation characteristic of the antenna in use from deterioration by the influence of the unused antenna.

The two antennas 113A and 113B exhibit directivity characteristics and polarization characteristics perpendicular to each other, so that a route diversity effect and a polarization diversity effect can be attained. For example, in an environment in which many walls and the like are present such as a home or the like, signals are received from a plurality of directions through multiple paths. Therefore, by switching over the directivity characteristic, the route diversity effect can be attained. If the antenna apparatus 113 is located closely to the metal plate 30, the polarization diversity effect can be attained using the two antennas 113A and 113B having the polarization characteristics perpendicular to each other. Further, the directivity characteristic and planes of polarization are changed according to the distance D from the metal plate 30. However, since the directivity characteristics and the planes of polarization of the respective antennas 113A and 113B are changed so as to be perpendicular to each other, the diversity effect can be constantly maintained.

In the above-mentioned preferred embodiment, the antenna apparatus 113 is constituted to include the two antennas 113A and 113B. Alternatively, the antenna apparatus may include a plurality of similar antennas and the antennas may be selectively switched over using the switch SW5.

FOURTEENTH PREFERRED EMBODIMENT

Figure 52:
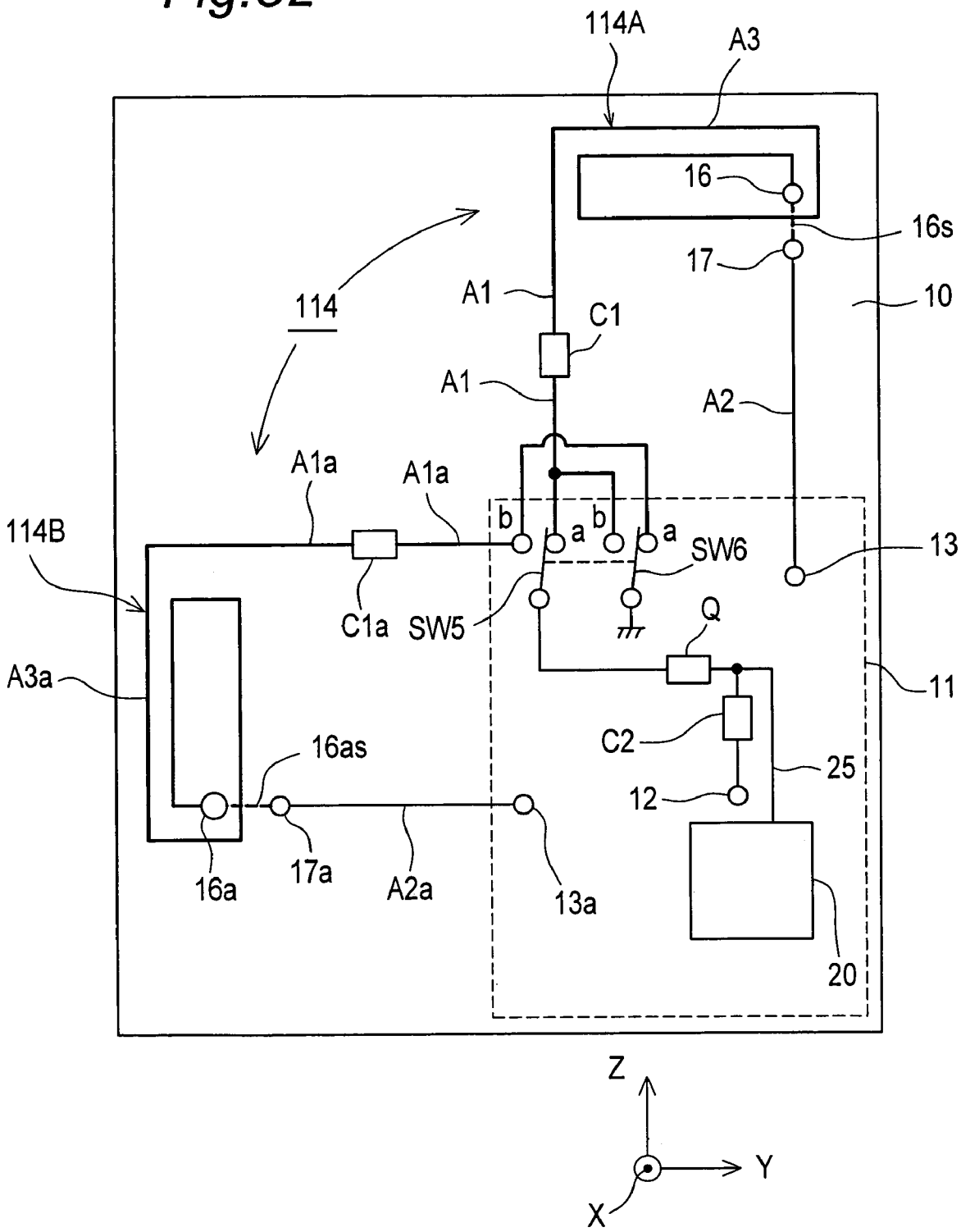
FIG. 52 is a plan view showing a configuration of an antenna apparatus 114 according to a fourteenth preferred embodiment of the present invention.

FIG. 52 is a plan view showing a configuration of an antenna apparatus 114 according to a fourteenth preferred embodiment of the present invention. The antenna apparatus 114 according to the fourteenth preferred embodiment differs from the antenna apparatus 107 according to the seventh preferred embodiment shown in FIG. 30 in the following respects.

(1) The antenna elements A1*a* and A2*a*, which are made of substantially linear copper foil strip conductors, respectively, are formed on the left-side front surface of the dielectric substrate 10 so as to be perpendicular to the antenna elements A1 and A2 using the printed wiring method. It is noted that the grounding conductor 11 is not formed on a rear surface of the left-side portion of the dielectric substrate 10 on which the antenna elements A1*a* and A2*a* are formed. Further, the end portion on the ground side of the antenna element A2*a* is connected to the grounding conductor 11 through the through-hole conductor 13*a* filled into the through hole which penetrates in the thickness direction of the dielectric substrate 10, so as to be grounded.

(2) The minute loop antenna A3*a* is constituted by forming the copper foil strip conductor on the front surface of the left-side edge portion of the dielectric substrate 10 by the printed wiring method. In the end portion as located near the ground side of the minute loop antenna A3*a*, the through-hole conductor 16*a* is formed by filling the conductor into the through hole which penetrates the dielectric substrate 10 in the thickness direction thereof. In addition, the through-hole conductor 17*a* is formed at the position near the through-hole conductor 16*a* so that the strip conductor of the minute loop antenna A3*a* is sandwiched between the through-hole conductor 16*a* and the through-hole conductor 17*a*, by filling the conductor into the through hole which penetrates the dielectric substrate 10 in the thickness direction thereof. The end portion of the minute loop antenna A3*a* as located near the ground side is connected to the antenna element A2*a* through a strip conductor 16 as formed on the rear surface of the dielectric substrate 10 and the through-hole conductor 17*a*.

(3) The capacitor C1*a* is connected not to near the feeding point Q, but preferably and generally to the central point of the antenna element A1*a* as shown in FIG. 52.

(4) The end portion on the side of the feeding point Q of the antenna element A1 is connected to the contact "a" of the switch SW5, and the end portion on the side of the feeding point Q of the antenna element A1*a* is connected to the contact "b" of the switch SW5. A common terminal of the switch SW5 is connected to the feeding point Q.

The antenna apparatus 114 as thus constituted includes two antennas 114A and 114B which include the minute loop antennas A3 and A3*a* having loop axis directions parallel to each other, and the antenna elements A1 and A2 and the antenna elements A1*a* and A2*a* perpendicular to each other, respectively. When the level of the radio signal received by, for example, the antenna 114A is larger than that of the radio signal received by the antenna 114B, the controller 24 of FIG. 1 switches the switch SW5 to the contact "a" thereof. In the opposite case, the controller 24 switches the switch SW5 to the contact "b" thereof. The two antennas 114A and 114B exhibit directivity characteristics and polarization characteristics different from each other, so that the route diversity effect and the polarization diversity effect can be attained.

In the present preferred embodiment, in particular, when the antenna apparatus 113 is located closely to a metal plate 30, the antenna gain decreases. However, since the diversity antenna which includes the two antennas 114A and 114B can be constituted on one dielectric substrate 10, it is effective to make the radio communication apparatus including the antenna apparatus 114 thin and small in size. The present invention is suitably applied to a portable radio communication apparatus or a radio communication apparatus in which the metal plate 30 is not arranged to oppose to the antenna apparatus.

In the above-mentioned preferred embodiment, the antenna apparatus 114 is constituted to include the two antennas 114A and 114B. Alternatively, the antenna apparatus may include a plurality of similar antennas and the antennas may be selectively switched over using a switch SW5.

FIFTEENTH PREFERRED EMBODIMENT

Figure 53:
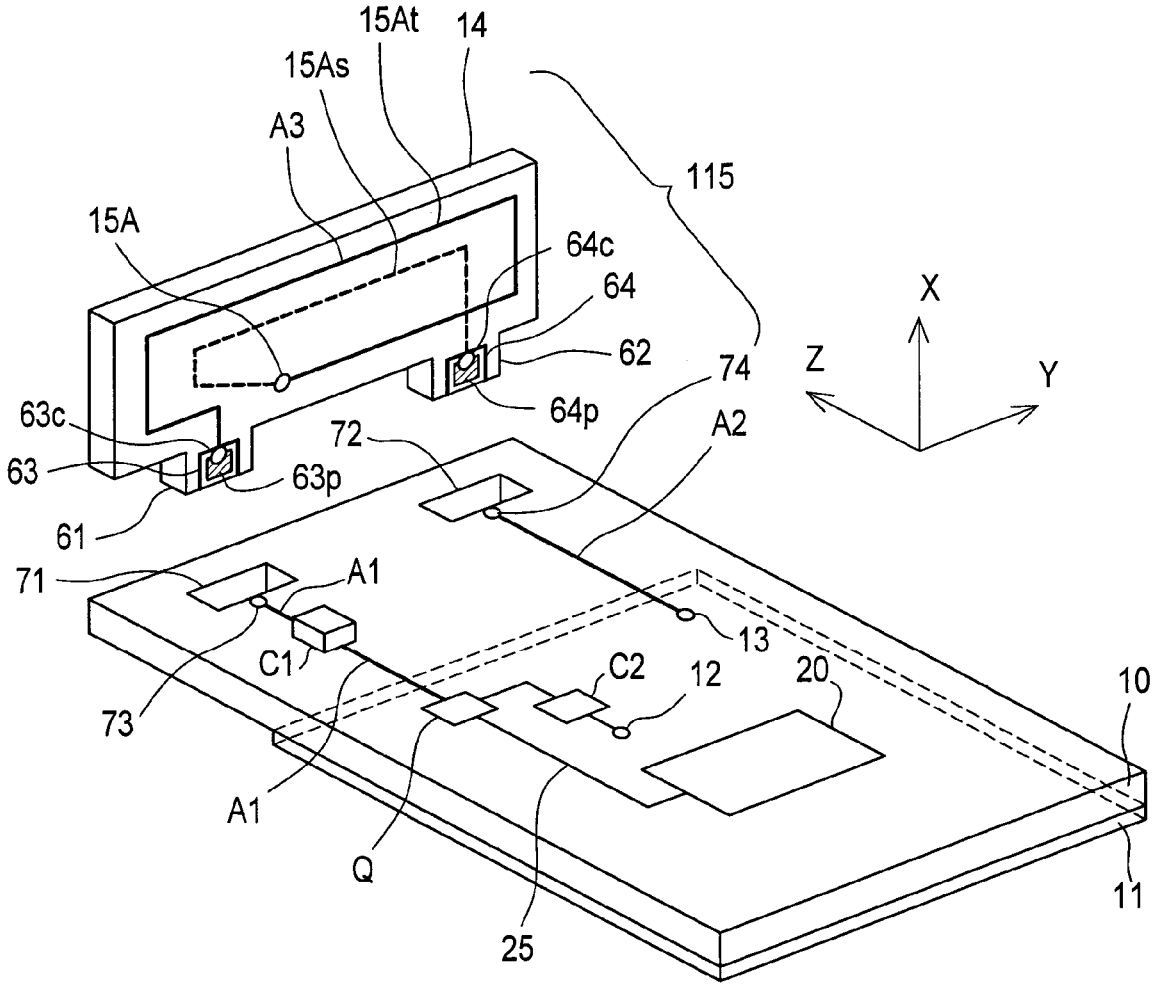
FIG. 53 is a perspective view showing a configuration of an antenna apparatus 115 according to a fifteenth preferred embodiment of the present invention.
Figure 54:
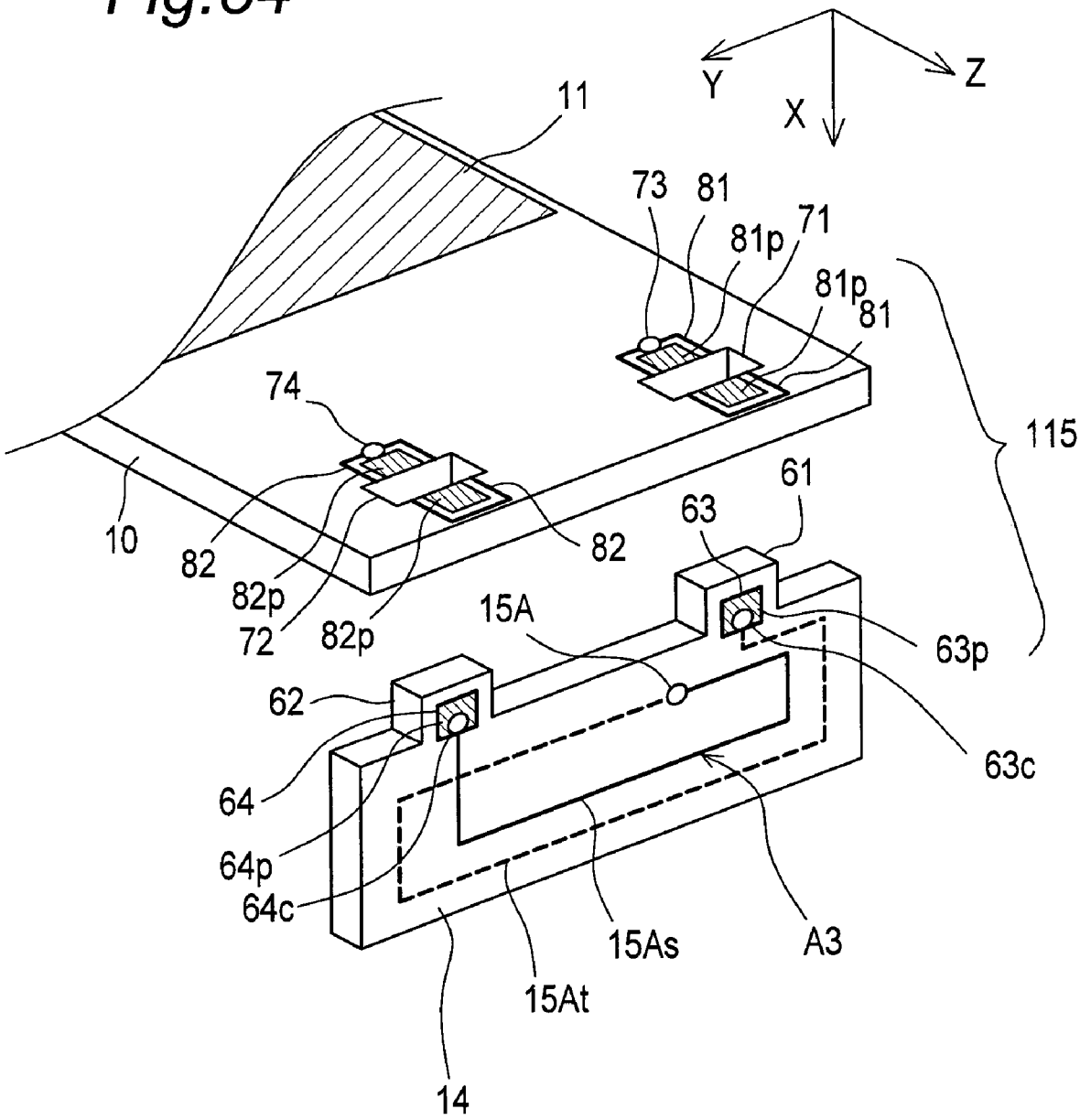
FIG. 54 is a perspective view showing a rear-side structure of the antenna apparatus 115 shown in FIG. 53.
Figure 55:
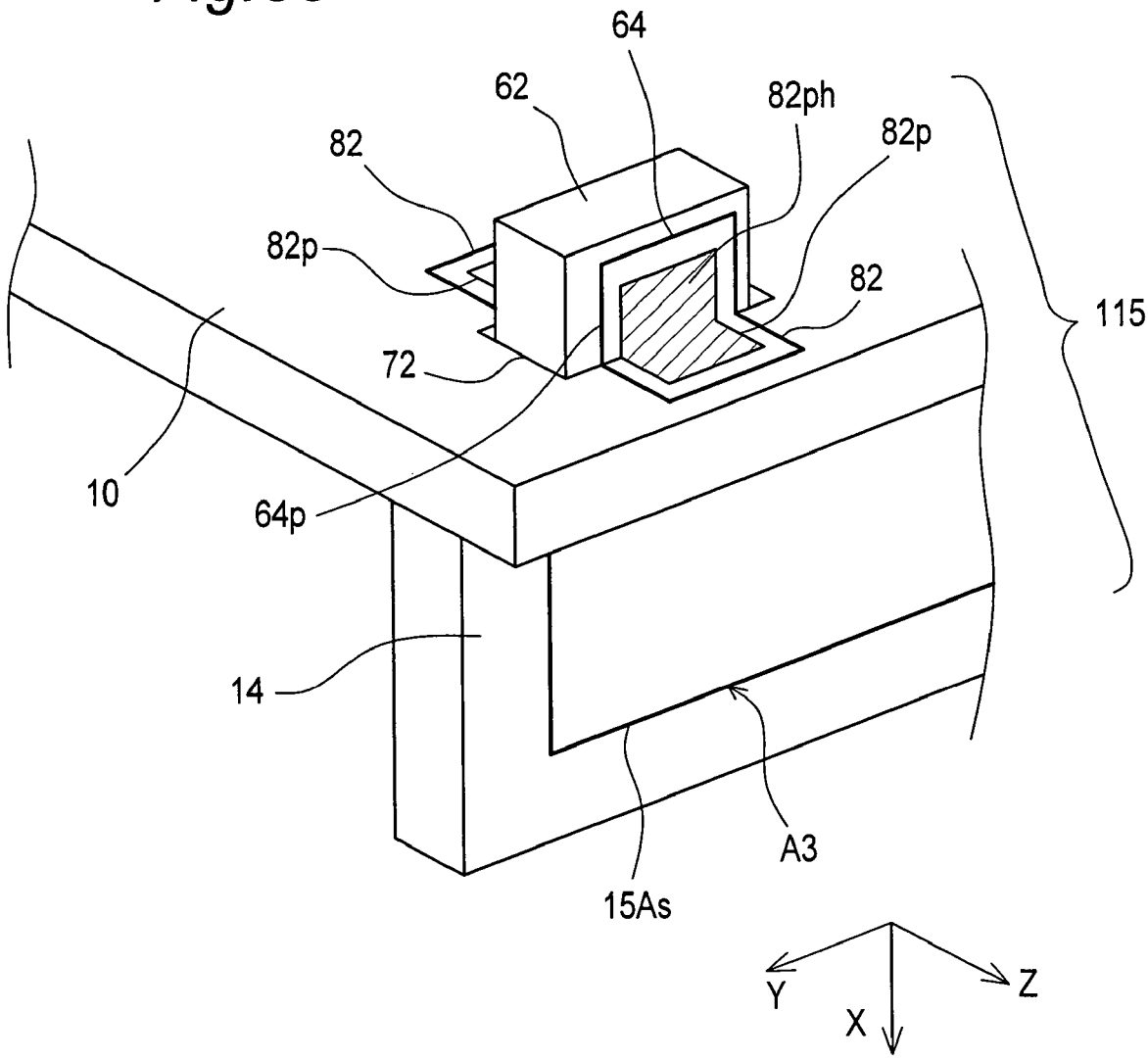
FIG. 55 is a perspective view showing in detail a substrate fitting and coupling section shown in FIG. 54.

FIG. 53 is a perspective view showing a configuration of an antenna apparatus 115 according to a fifteenth preferred embodiment of the present invention. FIG. 54 is a perspective view showing a rear-side structure of the antenna apparatus 115 shown in FIG. 53. FIG. 55 is a perspective showing in detail a substrate fitting and coupling section shown in FIG. 54.

The antenna apparatus 115 according to the fifteenth preferred embodiment is characterized, as compared with the antenna apparatus 104 according to the fourth preferred embodiment shown in FIG. 26, by including substrate fitting and coupling sections which fit convex portions 61 and 62 formed on the lower end surface of the dielectric substrate 14 so as to protrude in a height direction into hole portions 71 and 72 formed in the inner-part edge portion of the dielectric substrate 10, respectively, when a dielectric substrate 14 is provided to stand on the dielectric substrate 10. The substrate fitting and coupling section is described in detail.

Referring to FIGS. 53 and 54, the rectangular hole portions 71 and 72 which penetrate the dielectric substrate 10 in the thickness direction thereof are formed in the inner-part edge portion of the dielectric substrate 10. On the other hand, the rectangular columnar convex portions 61 and 62 are formed on the lower end surface of the dielectric substrate 14 so as to be fitted into the respective hole portions 71 and 72.

In this case, the strip conductor which constitutes the antenna element A1 is formed to extend to the position as located near the hole portion 71 of the dielectric substrate 10. The through-hole conductor 73 is formed at the position near the hole portion 71 by filling a conductor into the through hole which penetrates the dielectric substrate 10 in the thickness direction thereof. The end portion of the antenna element A1 is connected to connection conductors 81 on the rear surface of the dielectric substrate 10 through the through-hole conductor 73. The connection conductors 81 are formed to sandwich the hole portion 71 between the connection conductors 81 on the both sides of the hole portion 71 in the longitudinal direction of the dielectric substrate 10. In the connection conductors 81, conductor exposed portions 81*p* thereof each having a predetermined area are formed in the central portion in which the hole portion 71 is sandwiched between the conductor exposed portions 81*p*, and a resist pattern (not shown) is formed in portions other than the conductor exposed portions 81*p* so as to expose the conductor only to the conductor exposed portions 81*p*. Then only the respective conductor exposed portions 81*p* can be soldered.

Further, the strip conductor which constitutes the antenna element A2 is formed to extend to the position as located near the hole portion 72 of the dielectric substrate 10. A through-hole conductor 74 is formed at the position as located near the hole portion 72 by filling the conductor into the through hole which penetrates the dielectric substrate 10 in the thickness direction thereof. The end portion of the antenna element A2 is connected to connection conductors 82 on the rear surface of the dielectric substrate 10 through the through-hole conductor 74. The connection conductors 82 are formed to sandwich the hole portion 72 between the connection conductors 82 on both sides of the hole portion 72 in the longitudinal direction of the dielectric substrate 10. In the connection conductors 82, conductor exposed portions 82*p* thereof each having a predetermined area are formed in the central portion, in which the hole portion 72 is sandwich between the conductor exposed portions 81*p*, and a resist pattern (not shown) is formed in portions other than the conductor exposed portions 82*p* so as to expose the conductor only in the conductor exposed portions 82*p*. Then only the respective conductor exposed portions 81*p* can be soldered.

On the first surface on the side of the antenna elements A1 and A2 of the dielectric substrate 14 (it is noted that a surface parallel and opposite to the first surface is referred to as a second surface of the dielectric substrate 14), a strip conductor 15At which constitutes the minute loop antenna A3 is formed. One end of the strip conductor 15At is connected to the rectangular connection conductor 63 formed on the first surface on the side of the antenna elements A1 and A2 of the convex portion 61 (it is noted that a surface parallel and opposite to the first surface is referred to as a second surface of the convex portion 61 hereinafter). Another end of the strip conductor 15At is connected to a strip conductor 15As which constitutes the minute loop antenna A3 formed on the second surface of the dielectric substrate 14 through the through-hole conductor 15A formed by filling the conductor into the through hole which penetrates the dielectric substrate 14 in the thickness direction thereof. The end portion of the strip conductor 15As extends to the second surface of the convex portion 62, and is connected to a connection conductor 64 formed on the second surface of the convex portion 62.

Further, the rectangular connection conductor 63 is formed on each of the first surface and the second surface of the convex portion 61. The respective rectangular connection conductors 63 formed on the first and the second surfaces are connected to each other through the through-hole conductor 63*c* as formed by filling the conductor into the through hole which penetrates the dielectric substrate 14 in the thickness direction thereof, in a formation region of the connection conductor 63. In addition, a resist pattern (not shown) is formed in portions other than a conductor exposed portion 63*p* as formed in the central portion of a part of each of the connection conductors 63 so that the conductor is exposed only to the conductor exposed portion 63*p*. Then the conductor exposed portions 63*p* of the respective connection conductors 63 can be soldered. The rectangular connection conductor 64 is formed on each of the first surface and the second surface of the convex portion 62. The respective rectangular connection conductors 64 as formed on the first and the second surfaces are connected to each other through the through-hole conductor 64*c* as formed by filling the conductor into a through hole which penetrates the dielectric substrate 14 in the thickness direction thereof, in a formation region of the connection conductor 64. In addition, a resist pattern (not shown) is formed in portions other than a conductor exposed portion 64*p* as formed in the central portion of a part of each connection conductor 64 so that the conductor is exposed only to the conductor exposed portion 64*p*. Then only the conductor exposed portions 64*p* of the respective connection conductors 64 can be soldered.

After fitting the convex portions 61 and 62 of the dielectric substrate 14 into the hole portions 71 and 72 of the dielectric substrate 10, respectively, the conductor exposed portions 63*p* and 64*p* of the convex portions 61 and 62 are electrically connected to the conductor exposed portions 81*p* and 82*p* on the side of the dielectric substrate 10, respectively by soldering, such as soldering with a solder 82*ph* or the like, as shown in FIG. 55. As a result, the dielectric substrate 10 is fixedly connected or coupled with the dielectric substrate 14.

There may be used as the dielectric substrates 10 and 14, any substrate material such as a glass epoxy substrate, a paper phenol substrate, a ceramic substrate, Teflon (registered trademark) or the like. A material different from that of each of the substrates 10 and 14 may be used for the two dielectric substrates 10 and 14. For example, the glass epoxy substrate (FR4) on which a microscopic pattern can be formed can be used as the dielectric substrate 10, and an inexpensive paper phenol substrate or the like can be used as the dielectric substrate 14.

In the present preferred embodiment, the dielectric substrates 10 and 14 have predetermined thicknesses, and can be strongly fixed to each other by the structure of the substrate fitting and coupling sections provided between the convex portions 61 and 62 and the hole portions 71 and 72, respectively. Further, the convex portions 61 and 62 and the hole portions 71 and 72 can be easily produced by a data machining method or a die-cut machining method which is executed on the dielectric substrates 10 and 14, and this leads to reduction in the dimensional error. Since the constituent elements of the antenna apparatus 115 are formed by the strip conductors, it is possible to suppress the variation in the electric circuit element value and the variation in the resonance frequency of the antenna apparatus 115, and to omit a step of adjusting the frequency during manufacturing.

Furthermore, the conductor exposed portions 63*p*, 64*p*, 81*p* and 82*p* each having a predetermined area are formed in the central portions of the respective connection conductors 63, 64, 81 and 82 and soldered. When a high-frequency signal flows in the connection conductors 63, 64, 81 and 82, a higher-frequency current flows in each peripheral portion by the skin effect. By forming the respective peripheral portions not as conductor exposed portions but unsoldered regions, and this leads to minimizing the change amounts of the capacitance and inductance due to quantities of deposits on the solders, it is possible to suppress the variation in the resonance frequency of the antenna apparatus.

In the above-mentioned preferred embodiment, the two convex portions 61 and 62 are fitted into the two hole portions 71 and 72, respectively. However, the present invention is not limited to this. At least one convex portion may be fitted into at least one hole portion corresponding to the convex portion.

SIXTEENTH PREFERRED EMBODIMENT

Figure 56:
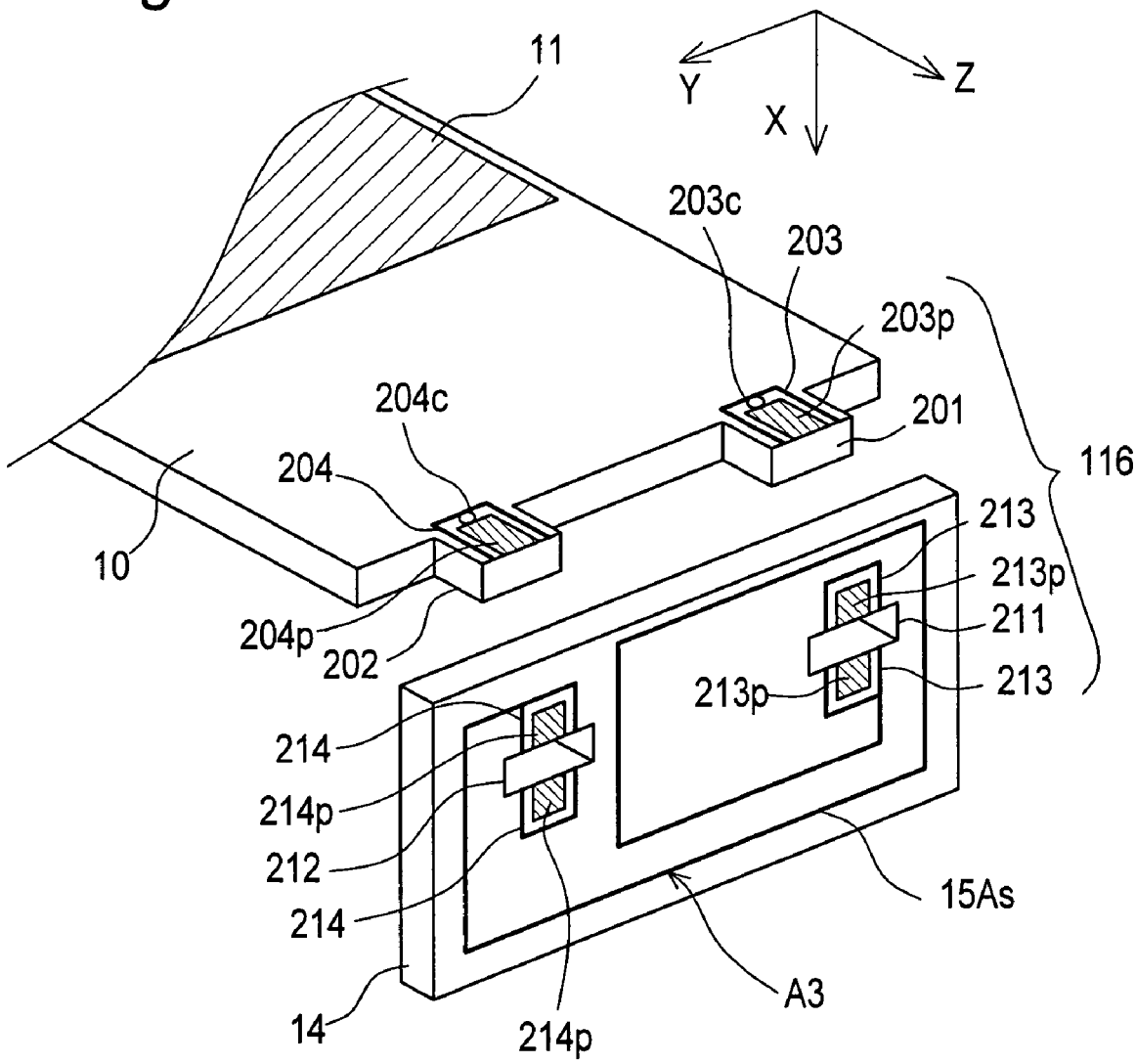
FIG. 56 is a perspective view showing a configuration of an antenna apparatus 116 according to a sixteenth preferred embodiment of the present invention.

FIG. 56 is a perspective view showing a configuration of an antenna apparatus 116 according to a sixteenth preferred embodiment of the present invention. The antenna apparatus 116 according to the sixteenth preferred embodiment differs from the antenna apparatus 115 according to the fifteenth preferred embodiment shown in FIG. 53 in the substrate fitting and coupling structure as follows.

Referring to FIG. 56, the dielectric substrate 10 includes rectangular columnar convex portions 201 and 202 as formed to protrude from the end surface in the longitudinal direction of the dielectric substrate 10. The dielectric substrate 14 includes rectangular hole portions 211 and 212 penetrating the dielectric substrate 14 in the thickness direction thereof. Rectangular connection conductors 203 are formed on both surfaces of the convex portion 201 in the thickness direction thereof, respectively, and rectangular connection conductors 204 are formed on both surfaces of the convex portion 202 in the thickness direction thereof, respectively. The connection conductors 203 are electrically connected to each other by a through-hole conductor 203*c*, and the connection conductors 204 are electrically connected to each other by a through-hole conductor 204*c*. In addition, conductor exposed portions 203*p* and 204*p* similar to the conductor exposed portions 63*p*, 64*p*, 81*p*, and 82*p* according to the fifteenth preferred embodiment are formed in the central portions on the end surface face side of the connection conductors 203 and 204 on both surfaces thereof.

On one of the surfaces of the dielectric substrate 14, a strip conductor 15As which constitutes the minute loop antenna A3 is formed. One end of the strip conductor 15As is connected to connection conductors 213 as formed near a hole portion 211, and another end of the strip conductor 15As is connected to connection conductors 214 as formed near a hole portion 212. The connection conductors 213 and 214 sandwich the hole portions 211 and 212 between them, respectively, and include conductor exposed portions 213*p* and 214*p* as formed on both sides in the height direction of the dielectric substrate 14, respectively, and similar to the conductor exposed portions 63*p*, 64*p*, 81*p* and 82*p* according to the fifteenth preferred embodiment.

In the above-mentioned preferred embodiment, the convex portions 201 and 202 of the dielectric substrate 10 are inserted into the hole portions 211 and 212 of the dielectric substrate 14, respectively, and the conductor exposed portions 203*p* and 204*p* are connected to the conductor exposed portions 213*p* and 214*p* by soldering, respectively. Then, it is possible to fixedly couple or connect and fix the dielectric substrate 10 to the dielectric substrate 14. The antenna apparatus 116 according to the present preferred embodiment exhibit functions and advantageous effects similar to those of the antenna apparatus 115 according to the fifteenth preferred embodiment.

Furthermore, according to the present preferred embodiment, the dielectric substrate 14 is inserted into the dielectric substrate 10. Therefore, the shape of the strip conductor which constitutes the minute loop antenna A3 can be made to be larger than that of the fifteenth preferred embodiment. In particular, when the antenna apparatus 116 according to the present preferred embodiment is used while being stored in a resin case or the like, the dielectric substrate 14 can be advantageously enlarged up to the thickness direction of the resin case.

In the above-mentioned preferred embodiment, the two convex portions 201 and 202 are fitted into the two hole portions 211 and 212, respectively. However, the present invention is not limited to this. At least one of the convex portions may be fitted into at least one of the hole portions corresponding to the convex portion.

INDUSTRIAL APPLICABILITY

As mentioned above, the present invention can provide an antenna apparatus and a radio communication apparatus using the same antenna apparatus, capable of attaining an antenna gain larger than that of the conventional minute loop antenna whether the conductor is located closely to or apart from the antenna apparatus. Accordingly, the antenna apparatus according to the present invention can be widely applied as an antenna apparatus for use in a radio communication apparatus installed in or mounted on a portable radio communication apparatus such as a pager and mobile telephone, a household electric appliance or the like. It can also be used as an antenna apparatus for use in an automatic measuring apparatus installed in a gas meter, an electric meter, a water meter or the like.

The invention claimed is:

1. An antenna apparatus comprising:

a dielectric substrate including a grounding conductor;

a minute loop antenna provided to be electromagnetically close to said dielectric substrate, said minute loop antenna having a predetermined number N of turns and having a predetermined minute length, said minute loop antenna operating as a magnetic ideal dipole so that a magnetic current flows so as to cross said minute loop antenna when a predetermined metal plate is located closely to the antenna apparatus; and at least one antenna element connected to said minute loop antenna, said at least one antenna element operating as a current antenna so that said at least one antenna element is top-loaded by said minute loop antenna and currents flow in both of said minute loop antenna and said at least one antenna element when said metal plate is located apart from the antenna apparatus;

wherein said antenna apparatus further comprises at least one first capacitor connected to at least one of said minute loop antenna and said antenna element, said at least one capacitor series-resonates with inductances of said minute loop antenna and said antenna element, wherein one end of said antenna apparatus is connected to a feeding point, and another end of said antenna apparatus is connected to the grounding conductor of said dielectric substrate, and wherein said antenna apparatus operates as a magnetic ideal dipole by said minute loop antenna when said metal plate is located closely to the antenna apparatus, while said antenna apparatus operates as a current antenna by said at least one antenna element when said metal plate is located apart from the antenna apparatus.

2. The antenna apparatus as claimed in claim 1, wherein said at least one antenna element is provided to be substantially parallel to a surface of said dielectric substrate.

3. The antenna apparatus as claimed in claim 1, comprising two antenna elements.

4. The antenna apparatus as claimed in claim 3, wherein said two antenna elements are substantially linear and provided to be parallel to each other.

5. The antenna apparatus as claimed in claim 1, wherein said first capacitor is connected so as to be inserted into a substantially central point of said antenna element.

6. The antenna apparatus as claimed in claim 1, wherein said first capacitor is formed by connecting a plurality of capacitor elements in series.

7. The antenna apparatus as claimed in claim 1, wherein said first capacitor is formed by connecting a plurality of pairs of circuits in parallel, each pair of circuits being formed by connecting a plurality of capacitor elements in series.

8. The antenna apparatus as claimed in claim 1, further comprising an impedance matching circuit connected to the feeding point, said impedance matching circuit matching an input impedance of said antenna apparatus with a characteristic impedance of a feeding cable connected to the feeding point.

9. The antenna apparatus as claimed in claim 1, wherein said minute loop antenna is provided so that a loop axis direction of the minute loop antenna is substantially perpendicular to the surface of said dielectric substrate.

10. The antenna apparatus as claimed in claim 1, wherein said minute loop antenna is provided so that a loop axis direction of the minute loop antenna is substantially parallel to the surface of said dielectric substrate.

11. The antenna apparatus as claimed in claim 1, wherein said minute loop antenna is provided so that a loop axis direction of the minute loop antenna is inclined at a predetermined inclination angle with respect to the surface of said dielectric substrate.

12. The antenna apparatus as claimed in claim 1, wherein the number N of turns of said minute loop antenna is substantially set to $N=(n-1)+0.5$, where n is a natural number.

13. The antenna apparatus as claimed in claim 12, wherein the number N of turns of said minute loop antenna is substantially set to $N=1.5$.

14. The antenna apparatus as claimed in claim 1 further comprising:

at least one floating conductor provided to be electromagnetically close to said minute loop antenna and said antenna element; and a first switch device for selectively switching said floating conductor so as to or not to be connected to said grounding conductor, to change one of a directivity characteristic and a plane of polarization of said antenna apparatus.

15. The antenna apparatus as claimed in claim 14, further comprising two floating conductors provided to be substantially perpendicular to each other, wherein said first switch device selectively switches said respective two floating conductors so as to or not to be connected to said grounding conductor, to change at least one of the directivity characteristic and the plane of polarization of said antenna apparatus.

16. The antenna apparatus as claimed in claim 1, further comprising:

a first reactance element connected to at least one of said minute loop antenna and said antenna element; and a second switch device for selectively switching said first reactance element so as to or not to be shorted, to change a resonance frequency of said antenna apparatus.

17. The antenna apparatus as claimed in claim 16, wherein said second switch device includes a high-frequency semiconductor device having a parasitic capacitance when said second switch device is turned off, and wherein the antenna apparatus further includes a first inductor for substantially canceling the parasitic capacitance.

18. The antenna apparatus as claimed in claim 1, further comprising:

a second reactance element having one end connected to at least one of said minute loop antenna and said antenna element; and a third switch device for selectively switching another end of said second reactance element so as to be grounded or not to be grounded, to change the resonance frequency of said antenna apparatus.

19. The antenna apparatus as claimed in claim 18, further comprising a third reactance element connected to at least one of said minute loop antenna and said antenna element.

20. The antenna apparatus as claimed in claim 18, wherein said third switch device includes a high-frequency semiconductor device having a parasitic capacitance when said third switch device is turned off, and wherein the antenna apparatus further includes a second inductor for substantially canceling the parasitic capacitance.

21. The antenna apparatus as claimed in claim 1, wherein said antenna apparatus is formed on a surface of said dielectric substrate on which the grounding conductor is not formed.

22. The antenna apparatus as claimed in claim 21, wherein said minute loop antenna is formed on a further dielectric substrate.

23. The antenna apparatus as claimed in claim 22, wherein said further dielectric substrate includes at least one convex portion, wherein said dielectric substrate includes at least one hole portion fitted into the at least one concave portion of said dielectric substrate, and wherein said at least one convex portion of said further dielectric substrate is fitted into the at least one hole portion of said dielectric substrate, so that said further dielectric substrate is coupled with said dielectric substrate.

24. The antenna apparatus as claimed in claim 22, wherein said dielectric substrate includes at least one convex portion, wherein said further dielectric substrate includes further at least one hole portion for being inserted and fitted into the at least one concave portion of said dielectric substrate, and wherein said at least one convex portion of said dielectric substrate is inserted and fitted into the at least one hole portion of said further dielectric substrate, so that said dielectric substrate is coupled with said further dielectric substrate.

25. The antenna apparatus as claimed in claim 23, further comprising:

a first connection conductor formed on said dielectric substrate, said first connection conductor being connected to said antenna element; and a second connection conductor formed on said further dielectric substrate, said second connection conductor being connected to said minute loop antenna, wherein said first connection conductor is electrically connected to said second connection conductor when said dielectric substrate is coupled with said further dielectric substrate.

26. The antenna apparatus as claimed in claim 25, wherein said first connection conductor includes a first conductor exposed section, which is a part of said first connection conductor and has a predetermined first area, said connection conductor being formed to be soldered so that said first connection conductor is electrically connected to said second connection conductor, and wherein said second connection conductor includes a second conductor exposed section, which is a part of said second connection conductor and has a predetermined second area, said second connection conductor being formed to be soldered so that said second connection conductor is electrically connected to said first connection conductor.

27. An antenna device apparatus comprising:

a plurality of antenna devices; and a fourth switch device for selectively switching said plurality of antenna devices based on radio signals received by the plurality of antenna devices, and for connecting a selected antenna device to the feeding point, wherein said antenna device comprises:

a dielectric substrate including a grounding conductor;

a minute loop antenna provided to be electromagnetically close to said dielectric substrate, said minute loop antenna having a predetermined number N of turns and having a predetermined minute length, said minute loop antenna operating as a magnetic ideal dipole so that a magnetic current flows so as to cross said minute loop antenna when a predetermined metal plate is located closely to the antenna device; and at least one antenna element connected to said minute loop antenna, said at least one antenna element operating as a current antenna so that said at least one antenna element is top-loaded by said minute loop antenna and currents flow in both of said minute loop antenna and said at least one antenna element when said metal plate is located apart from the antenna device;

wherein said antenna device further comprises at least one first capacitor connected to at least one of said minute loop antenna and said antenna element, said at least one capacitor series-resonates with inductances of said minute loop antenna and said antenna element, wherein one end of said antenna device is connected to a feeding point, and another end of said antenna device is connected to the grounding conductor of said dielectric substrate, and wherein said antenna device operates as a magnetic ideal dipole by said minute loop antenna when said metal plate is located closely to the antenna device, while said antenna device operates as a current antenna by said at least one antenna element when said metal plate is located apart from the antenna device.

28. The antenna device apparatus as claimed in claim 27, wherein said fourth switch device grounds said unselected antenna devices.

29. A radio communication apparatus comprising:

an antenna apparatus; and a radio communication circuit connected to said antenna apparatus, wherein said antenna apparatus comprises:

a dielectric substrate including a grounding conductor;

a minute loop antenna provided to be electromagnetically close to said dielectric substrate, said minute loop antenna having a predetermined number N of turns and having a predetermined minute length, said minute loop antenna operating as a magnetic ideal dipole so that a magnetic current flows so as to cross said minute loop antenna when a predetermined metal plate is located closely to the antenna apparatus; and at least one antenna element connected to said minute loop antenna, said at least one antenna element operating as a current antenna so that said at least one antenna element is top-loaded by said minute loop antenna and currents flow in both of said minute loop antenna and said at least one antenna element when said metal plate is located apart from the antenna apparatus;

wherein said antenna apparatus further comprises at least one first capacitor connected to at least one of said minute loop antenna and said antenna element, said at least one capacitor series-resonates with inductances of said minute loop antenna and said antenna element, wherein one end of said antenna apparatus is connected to a feeding point, and another end of said antenna apparatus is connected to the grounding conductor of said dielectric substrate, and wherein said antenna apparatus operates as a magnetic ideal dipole by said minute loop antenna when said metal plate is located closely to the antenna apparatus, while said antenna apparatus operates as a current antenna by said at least one antenna element when said metal plate is located apart from the antenna apparatus.

* * * * *